US011117761B2

(12) United States Patent
Aoki et al.

(10) Patent No.: US 11,117,761 B2
(45) Date of Patent: Sep. 14, 2021

(54) USAGE DETERMINATION OF MULTI-FEED PREVENTION ROLLER

(71) Applicant: HP PRINTING KOREA CO., LTD., Suwon-Si (KR)

(72) Inventors: Eiji Aoki, Suwon-si (KR); Jin Soo Lee, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 201 days.

(21) Appl. No.: 16/474,448

(22) PCT Filed: Jan. 5, 2018

(86) PCT No.: PCT/KR2018/000242

§ 371 (c)(1),
(2) Date: Jun. 27, 2019

(87) PCT Pub. No.: WO2018/131837

PCT Pub. Date: Jul. 19, 2018

(65) Prior Publication Data

US 2019/0344985 A1 Nov. 14, 2019

(30) Foreign Application Priority Data

Jan. 11, 2017 (KR) ..... 10-2017-0004184
Aug. 4, 2017 (KR) ..... 10-2017-0099208

(51) Int. Cl.
*B65H 3/06* (2006.01)
*B65H 7/12* (2006.01)
(Continued)

(52) U.S. Cl.
CPC ..... *B65H 3/0669* (2013.01); *B65H 3/5261* (2013.01); *B65H 7/12* (2013.01);
(Continued)

(58) Field of Classification Search
CPC .... G03G 15/6511; B65H 7/12; B65H 3/5284; B65H 3/0669; B65H 2553/22; B65H 2403/732; B65H 2403/72; B65H 3/5261
See application file for complete search history.

(56) References Cited

U.S. PATENT DOCUMENTS 7,427,061 B2 * 9/2008 Ruthenberg ..... B65H 3/5284 271/122
7,595,912 B2 * 9/2009 Takahashi ..... B41J 13/0009 358/404
(Continued)

FOREIGN PATENT DOCUMENTS

CN 102050339 5/2011
JP 06130747 5/1994
(Continued)

*Primary Examiner* — Jeremy R Severson
(74) *Attorney, Agent, or Firm* — Staas & Halsey, LLP

(57) ABSTRACT

A sheet feeding apparatus includes a sheet stacker to stack at least one sheet; a sheet feed roller disposed at one side of the sheet stacker and to feed a sheet fed from the sheet stacker; a multi-feed prevention roller disposed to face the sheet feed roller and to prevent multi-feed of the sheet fed from the sheet stacker; a magnetic torque limiter disposed coaxially with the multi-feed prevention roller; a hall sensor disposed at one side of the magnetic torque limiter and to detect rotation of the magnetic torque limiter; and a controller configured to rotate the sheet feed roller in a state in which the sheet feed roller and the multi-feed prevention roller are in contact with each other without a sheet and to identify a lifetime of the multi-feed prevention roller by using a signal output from the hall sensor.

14 Claims, 31 Drawing Sheets

(51) Int. Cl.
*G03G 15/00* (2006.01)
*B65H 3/52* (2006.01)

(52) U.S. Cl.
CPC ..... *G03G 15/6511* (2013.01); *B65H 2403/72* (2013.01); *B65H 2403/724* (2013.01); *B65H 2403/732* (2013.01); *B65H 2553/22* (2013.01); *B65H 2553/51* (2013.01)

(56) References Cited

U.S. PATENT DOCUMENTS

| | | | | |
|---|---|---|---|---|
| 8,478,561 | B2 * | 7/2013 | Satoh ..... | G01P 3/44 702/151 |
| 9,079,730 | B2 * | 7/2015 | Helmlinger ..... | B65H 5/066 |
| 2008/0073825 | A1 | 3/2008 | Ruthenberg et al. | |
| 2011/0106489 | A1 | 5/2011 | Satoh | |
| 2014/0125002 | A1 | 5/2014 | Itabashi | |

FOREIGN PATENT DOCUMENTS

| | | |
|---|---|---|
| JP | 11278701 | 10/1999 |
| JP | 2000168983 | 6/2000 |
| JP | 2008164000 | 7/2008 |
| JP | 2008-240805 A | 9/2008 |

* cited by examiner

【Figure 1】
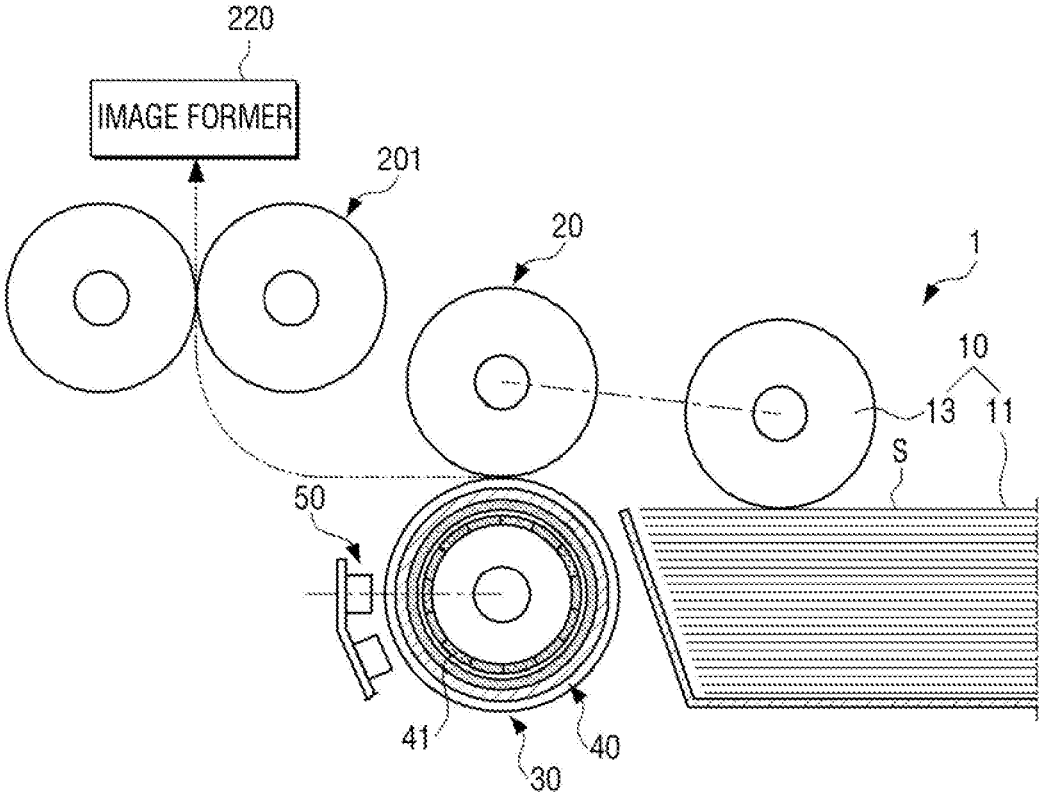

【Figure 2】
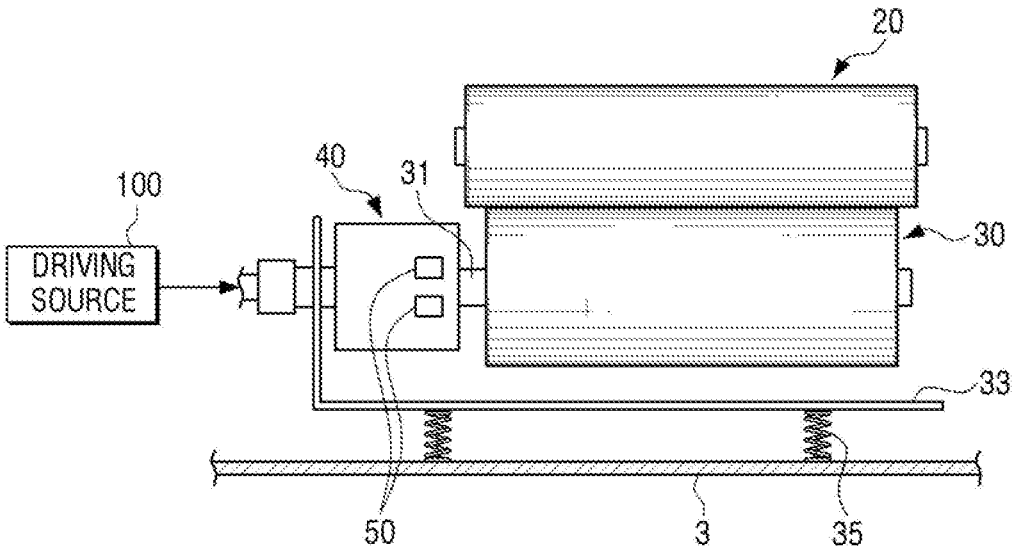
【Figure 3】
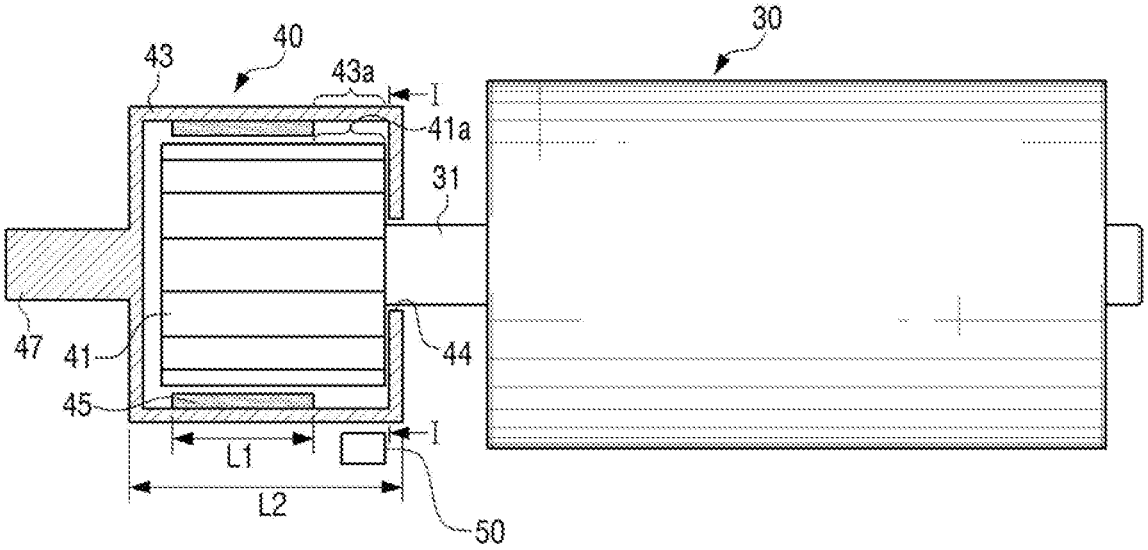

【Figure 4】
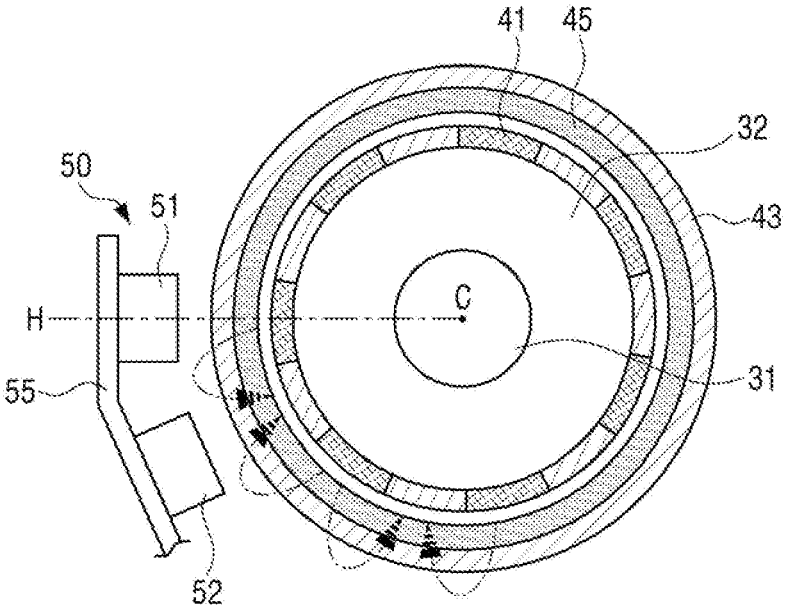
【Figure 5】
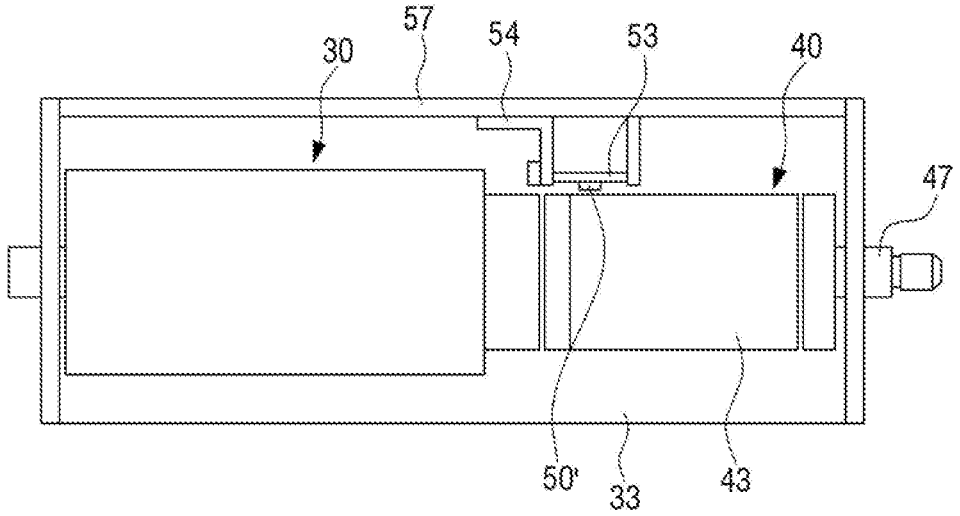

【Figure 6】
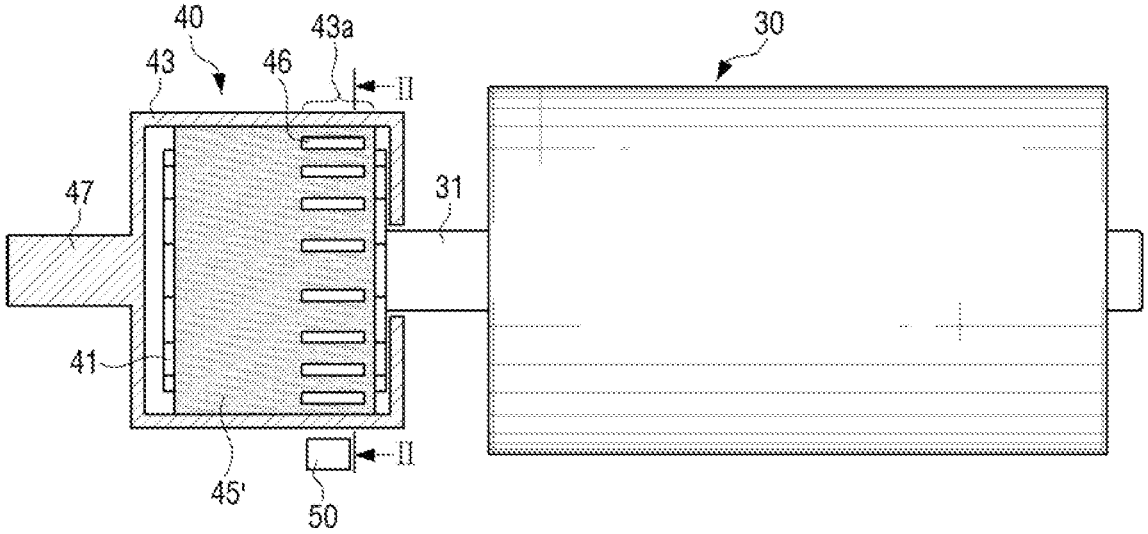
【Figure 7】
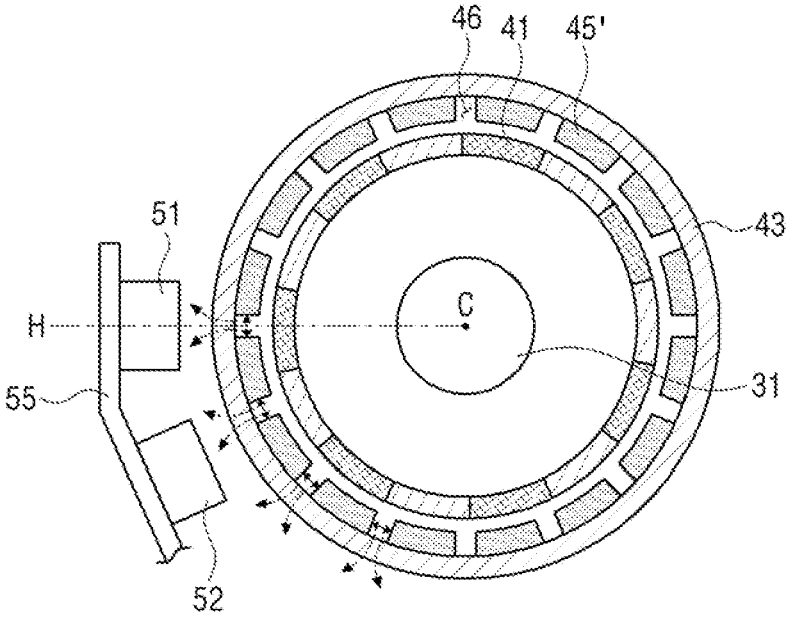

【Figure 8】
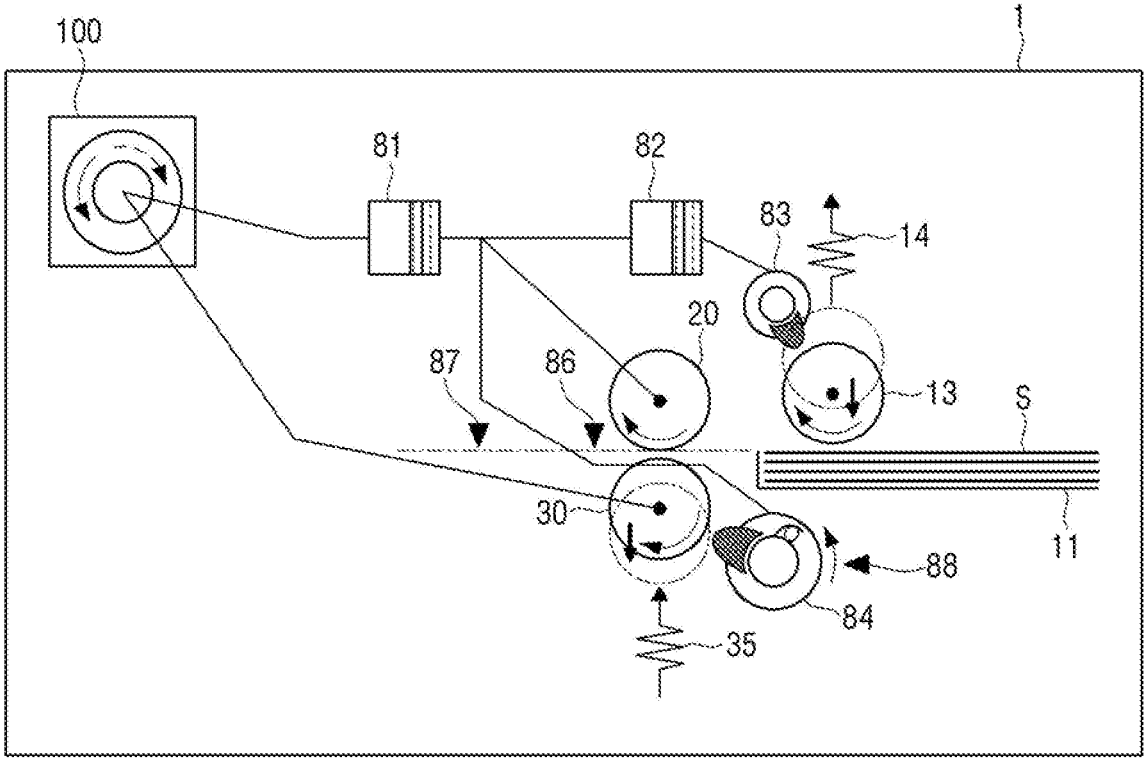

【Figure 9】
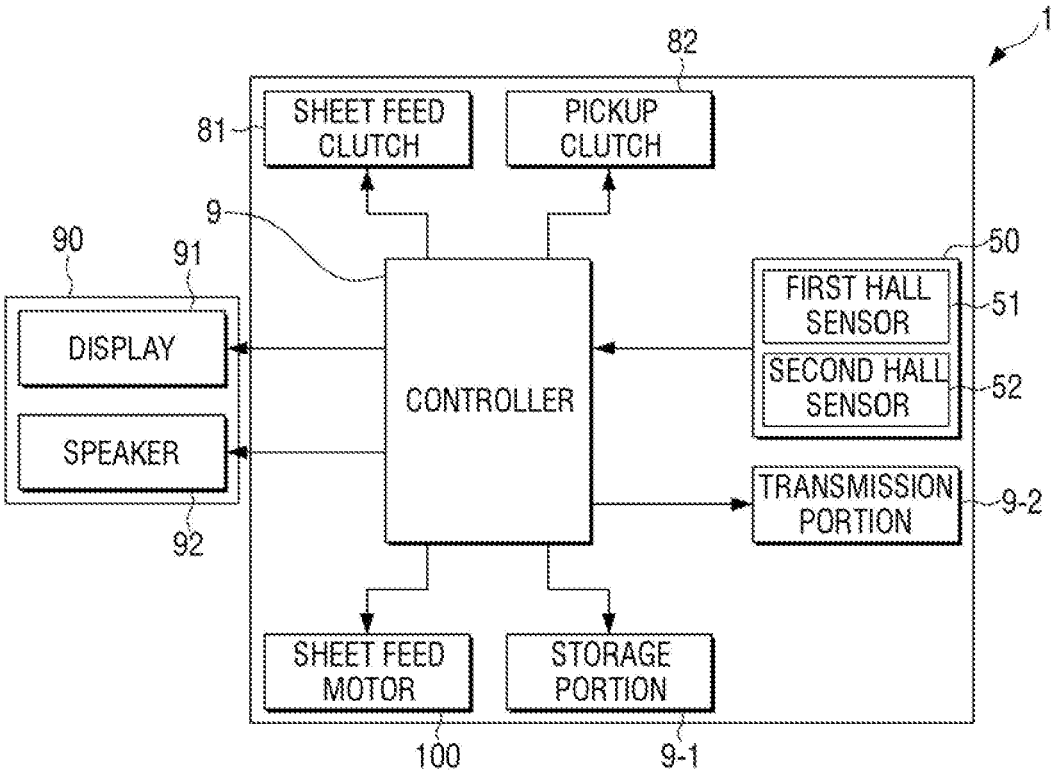

【Figure 10】
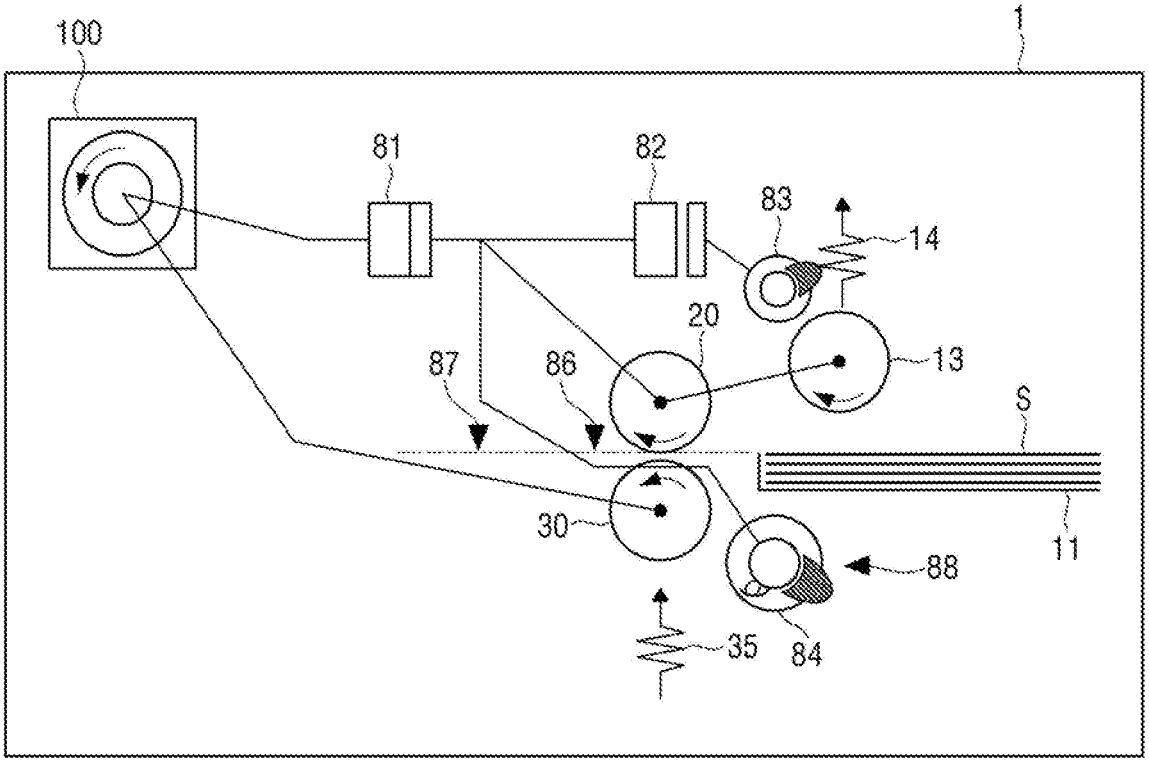
【Figure 11】
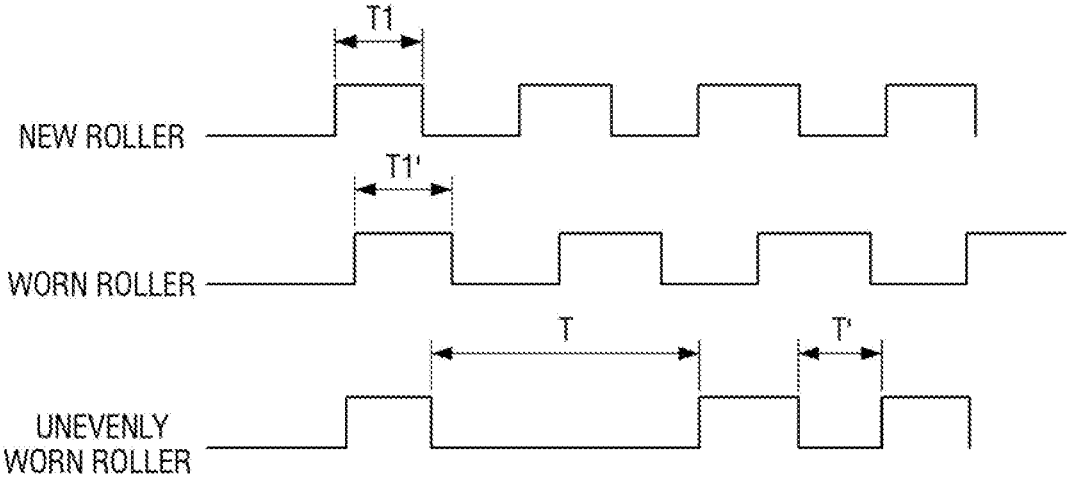

【Figure 12】
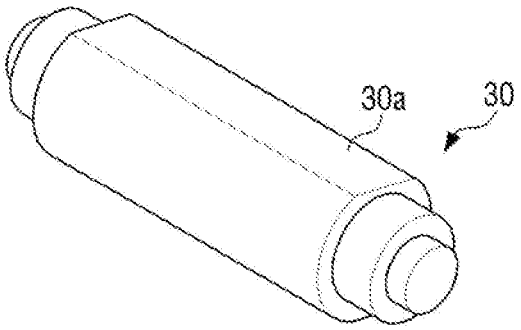

【Figure 13】
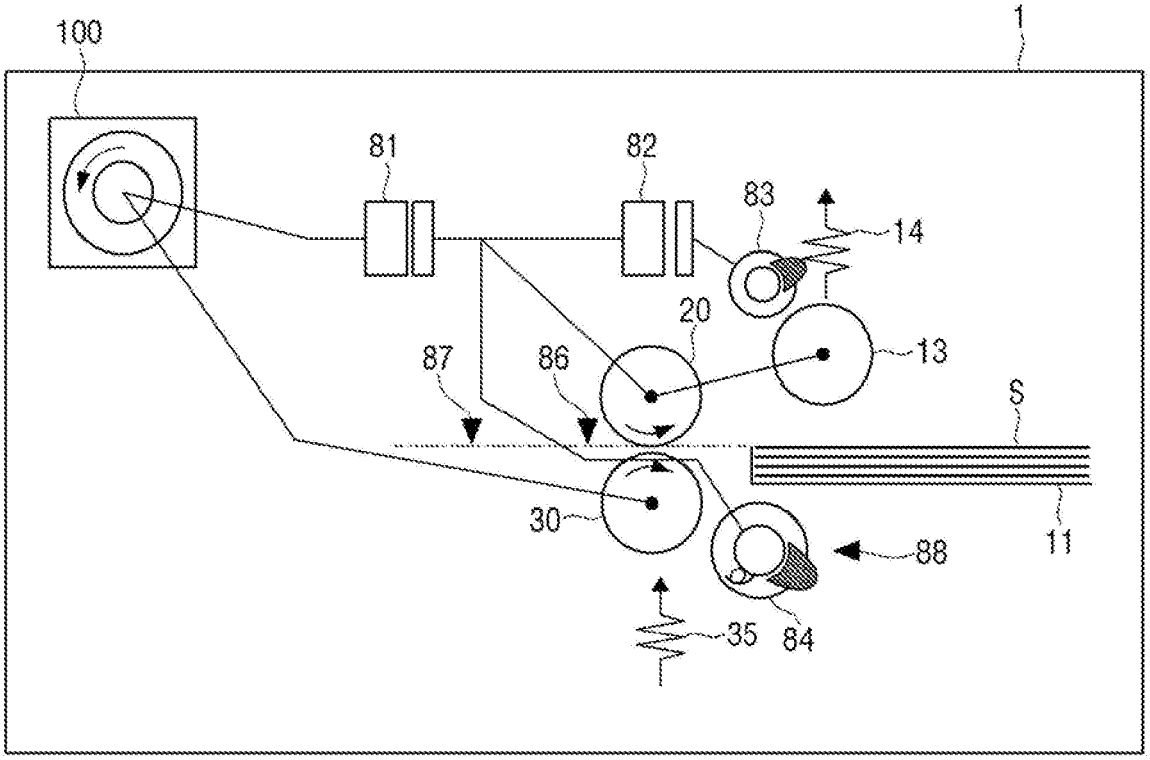
【Figure 14】
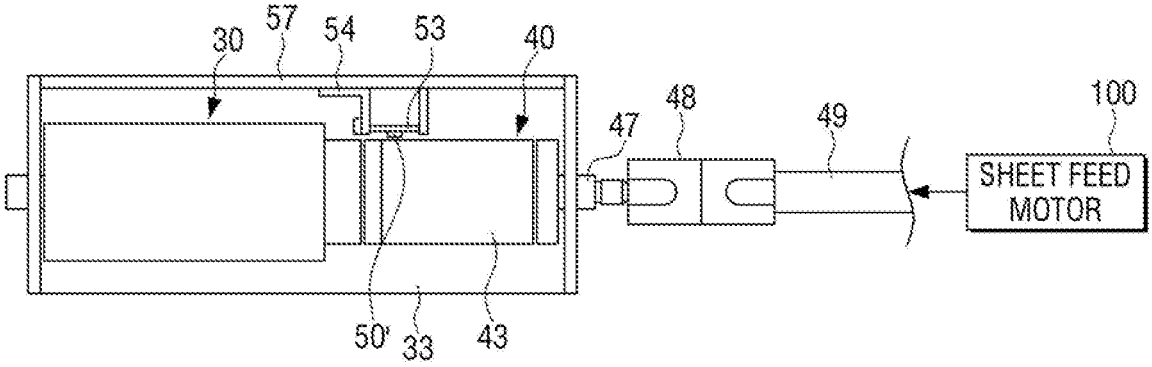

【Figure 15】
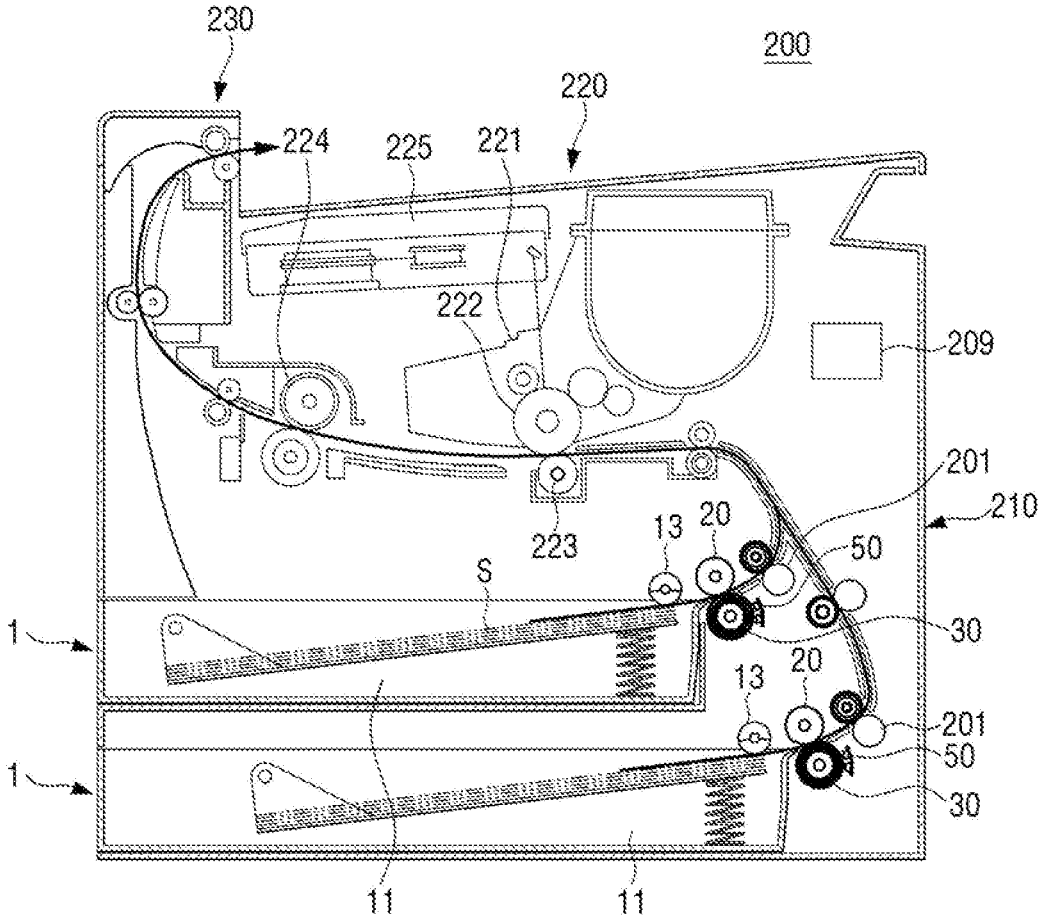

【Figure 16】
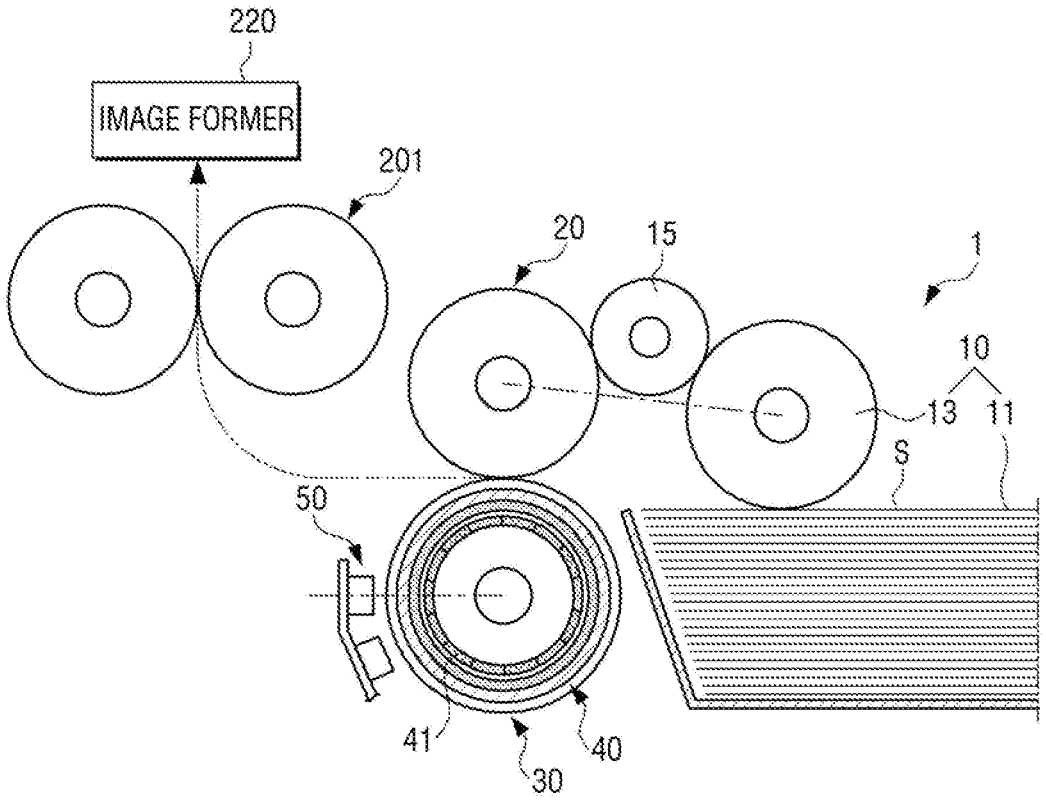

【Figure 17a】
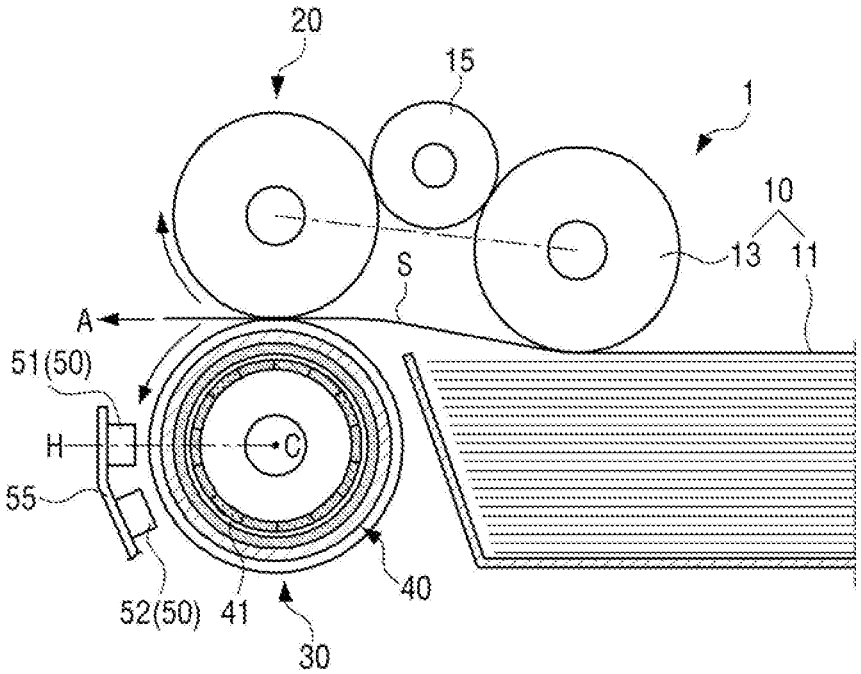
【Figure 17b】
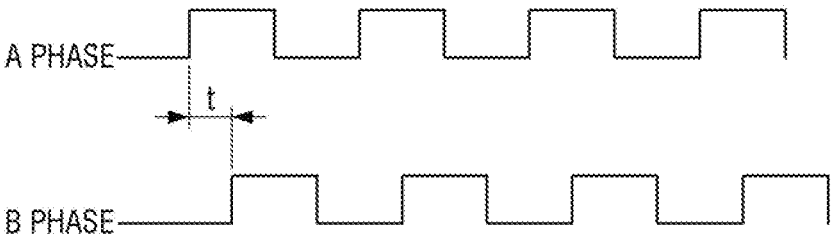

【Figure 18a】
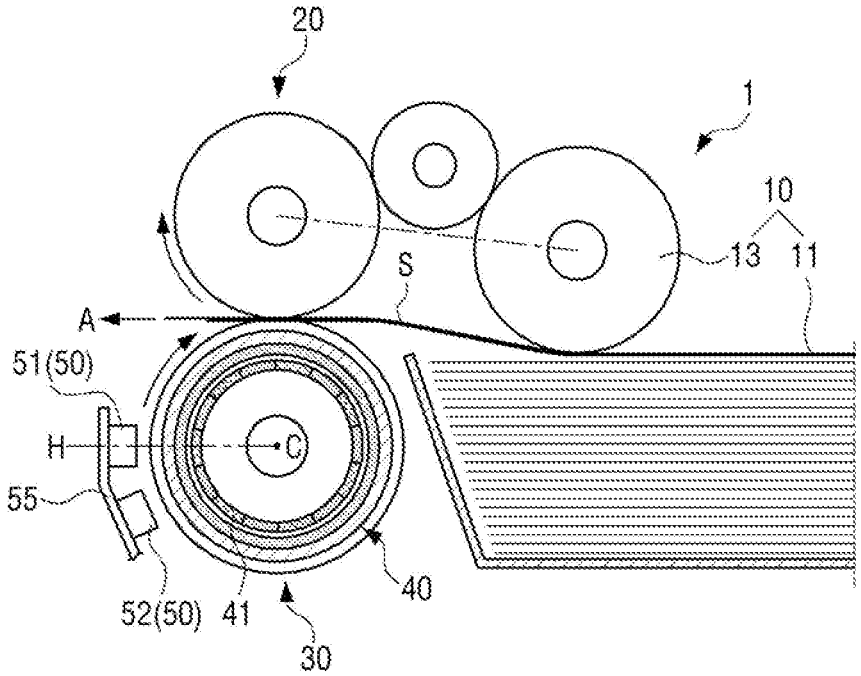
【Figure 18b】
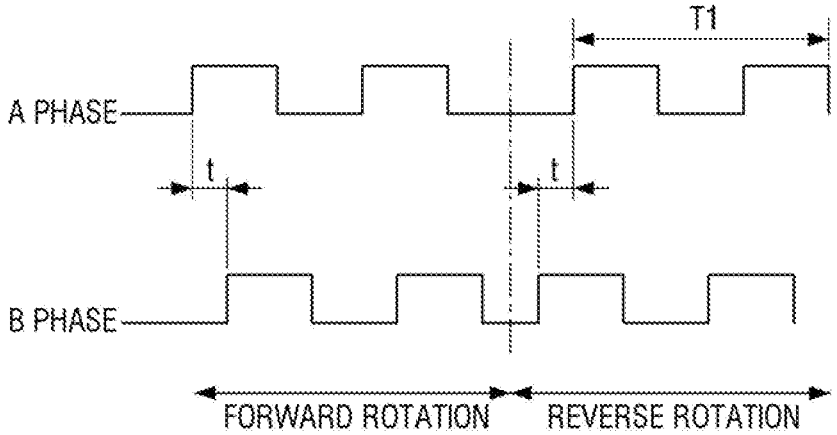

【Figure 19a】
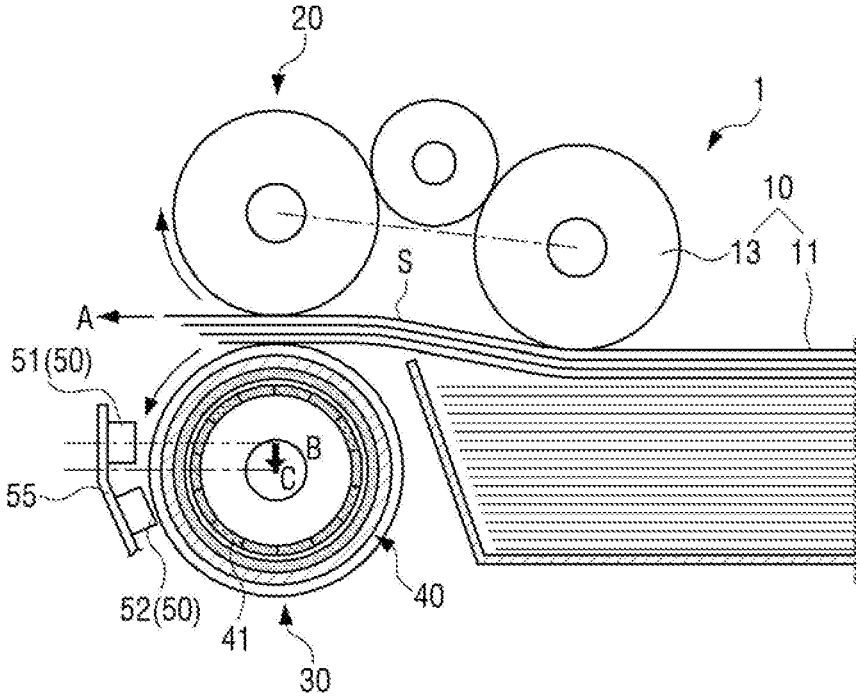
【Figure 19b】
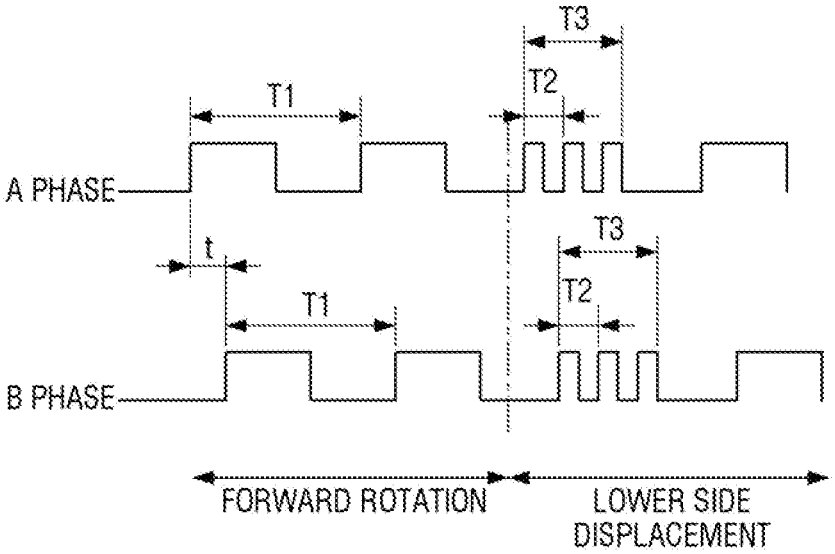

【Figure 20】
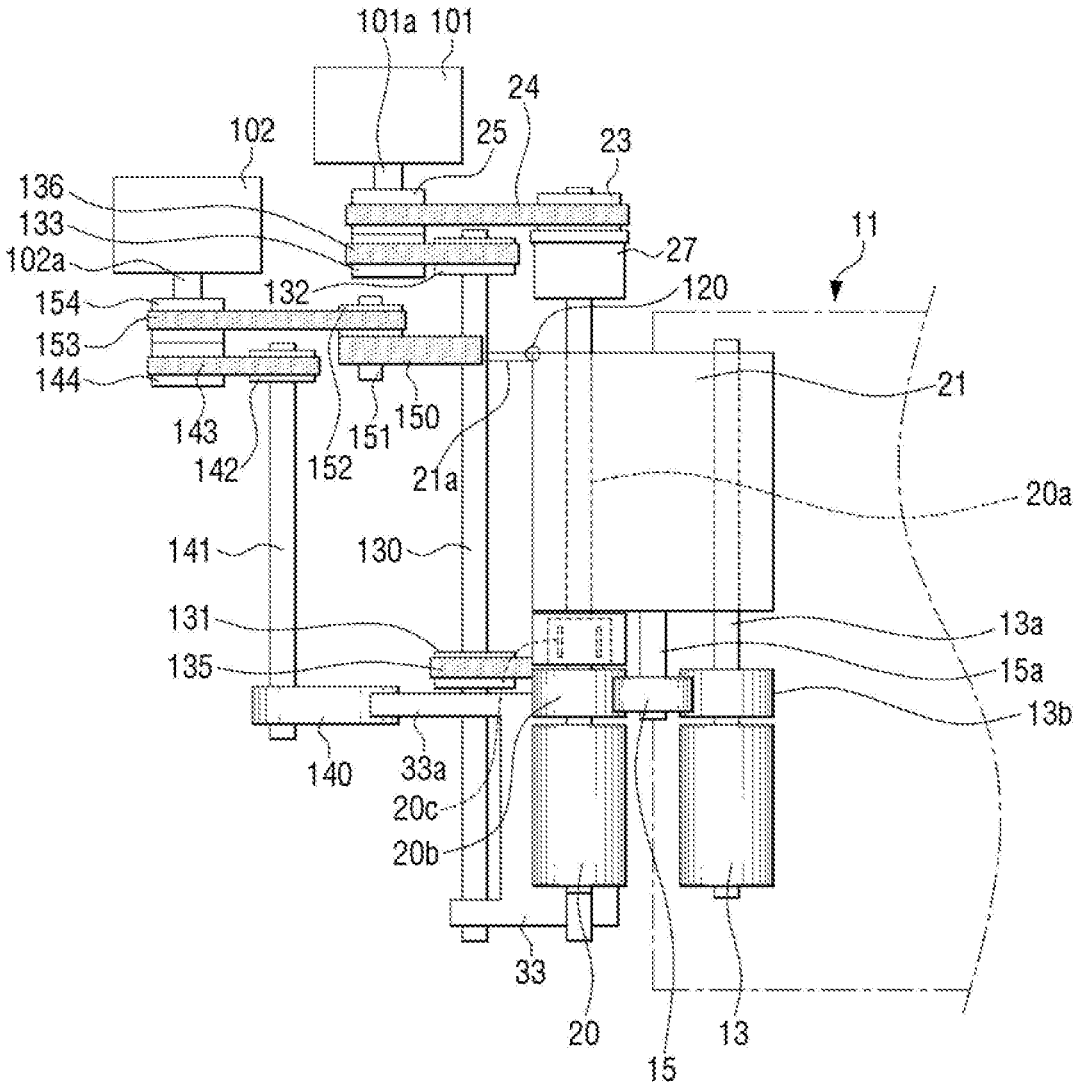

【Figure 21】
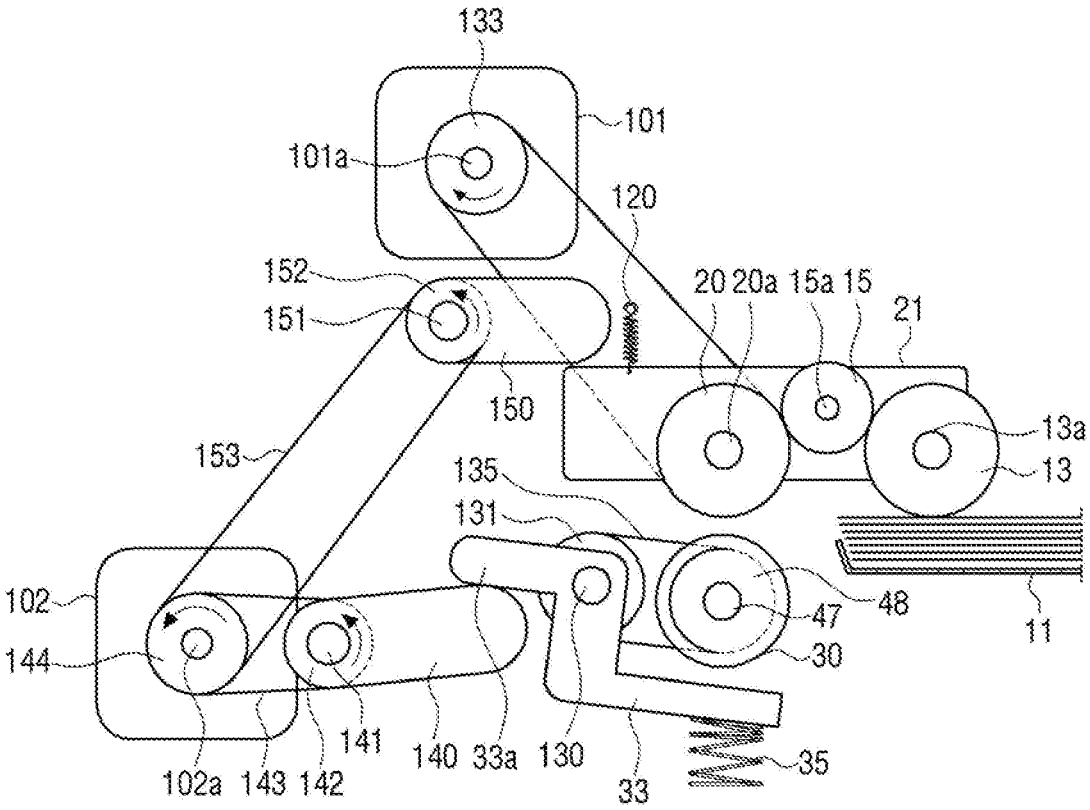

【Figure 22】
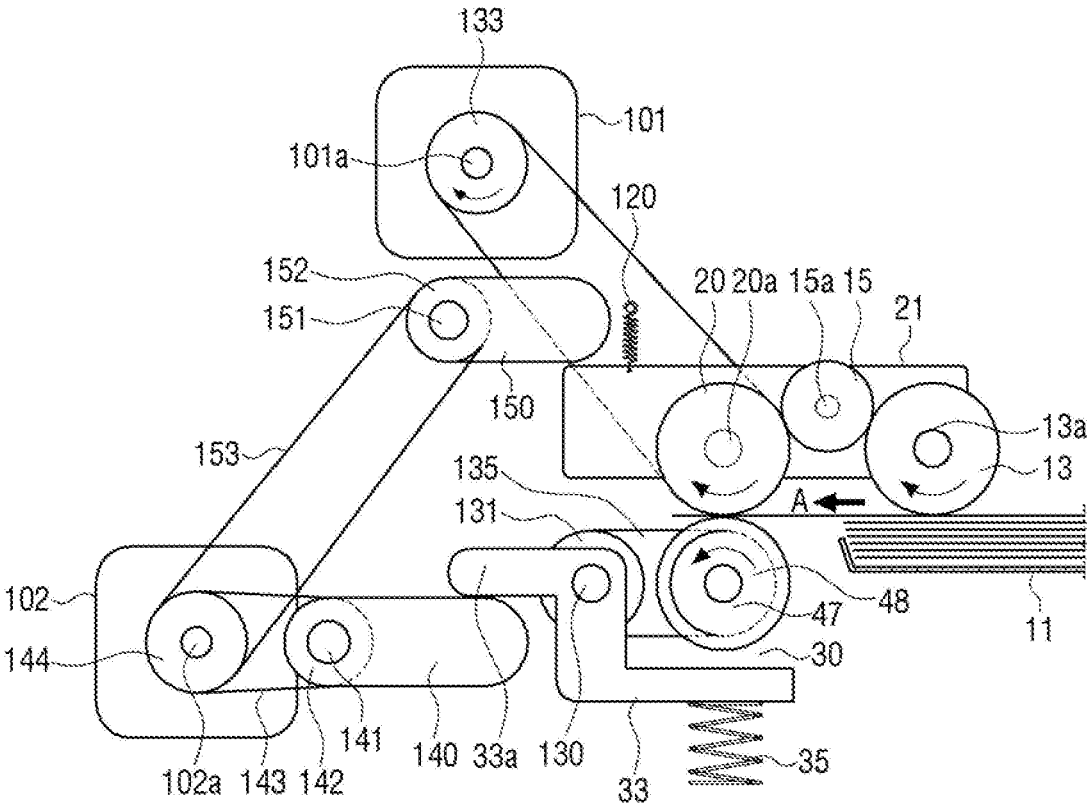

【Figure 23】
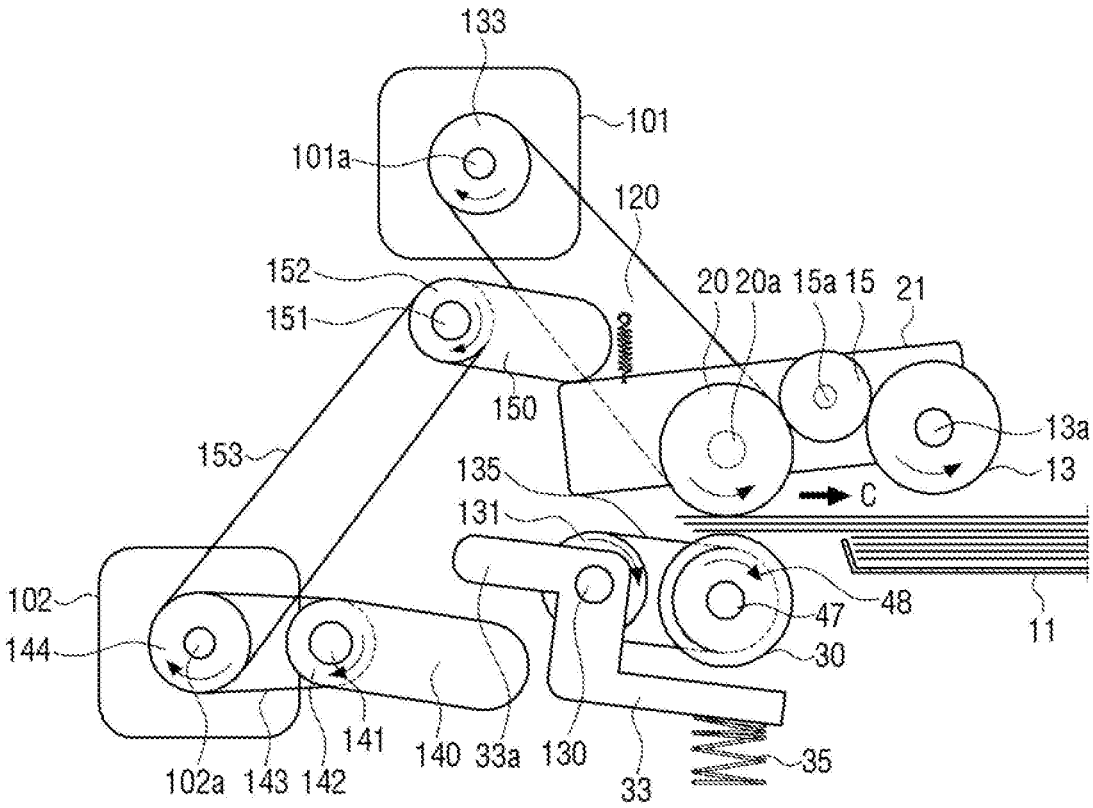

【Figure 24】
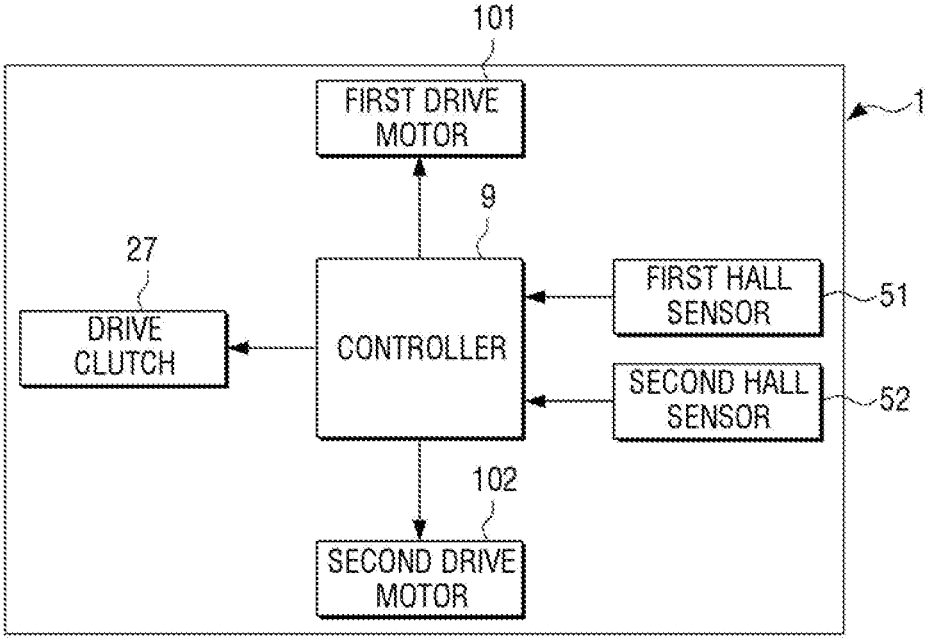
【Figure 25】
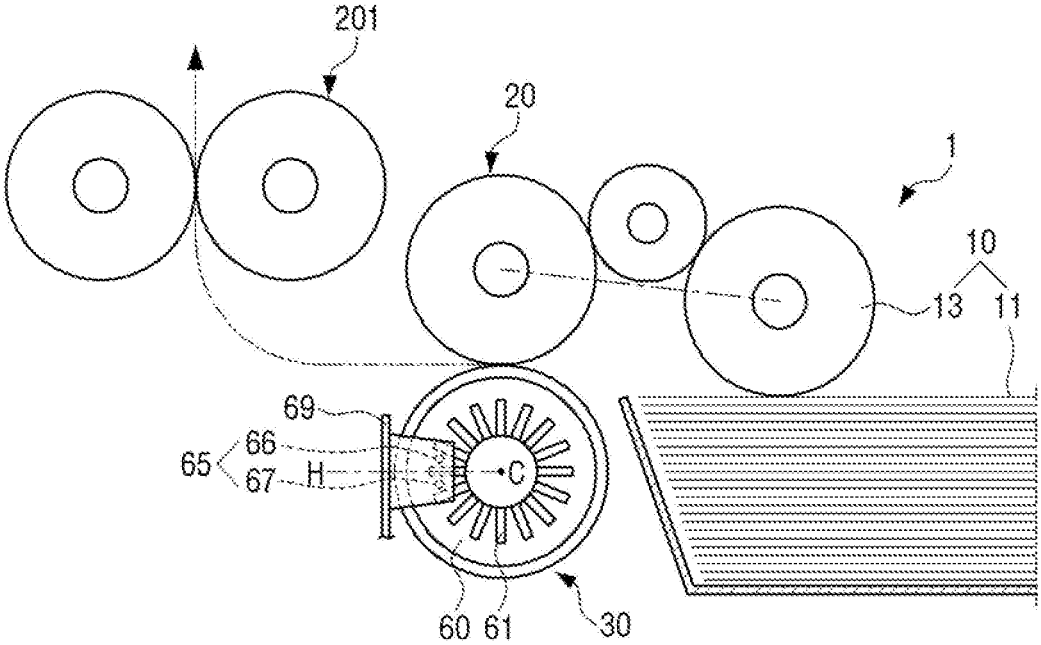

【Figure 26】
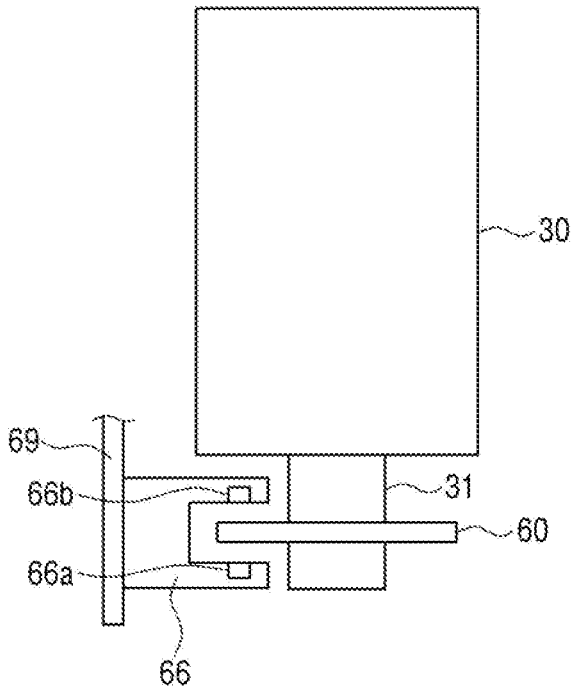

【Figure 27a】
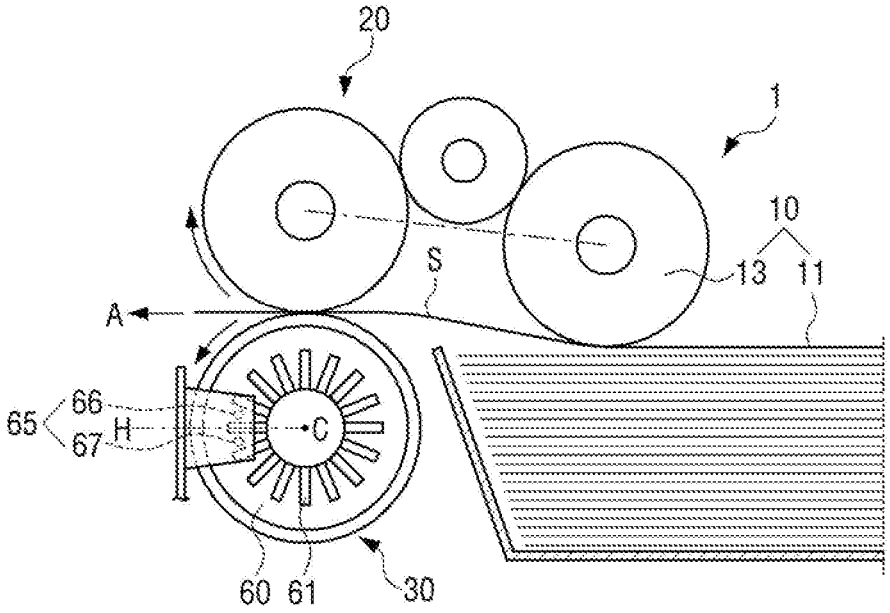
【Figure 27b】
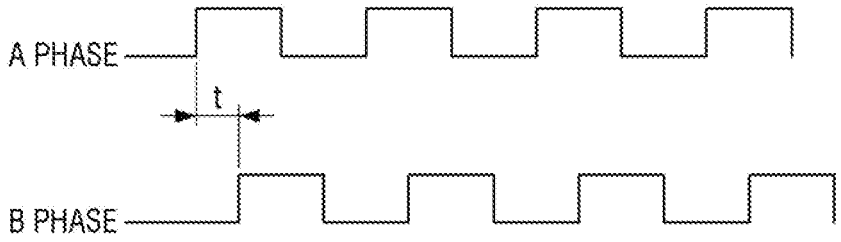

【Figure 28a】
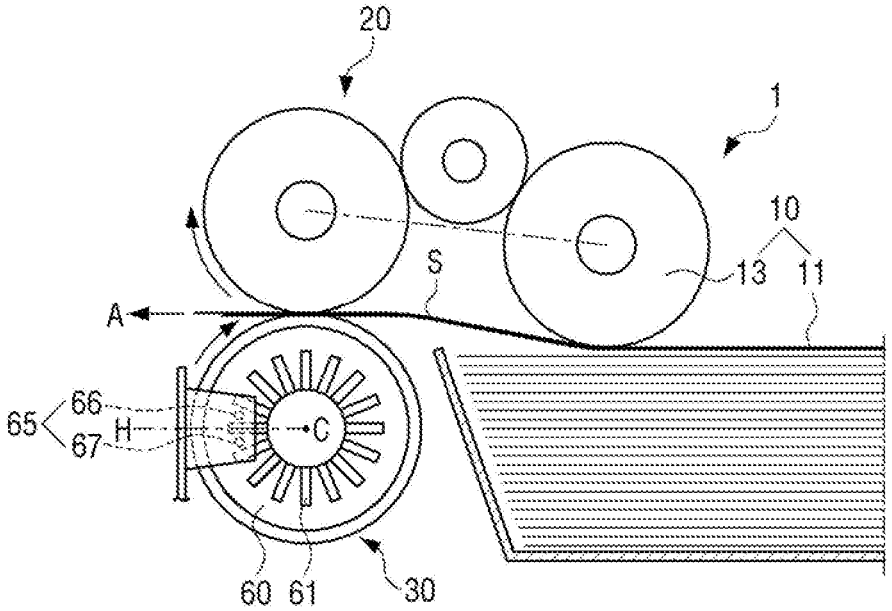
【Figure 28b】
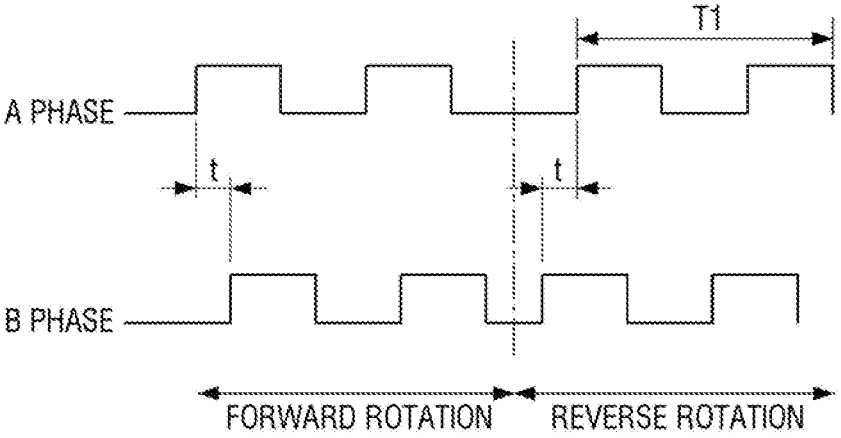

【Figure 29a】
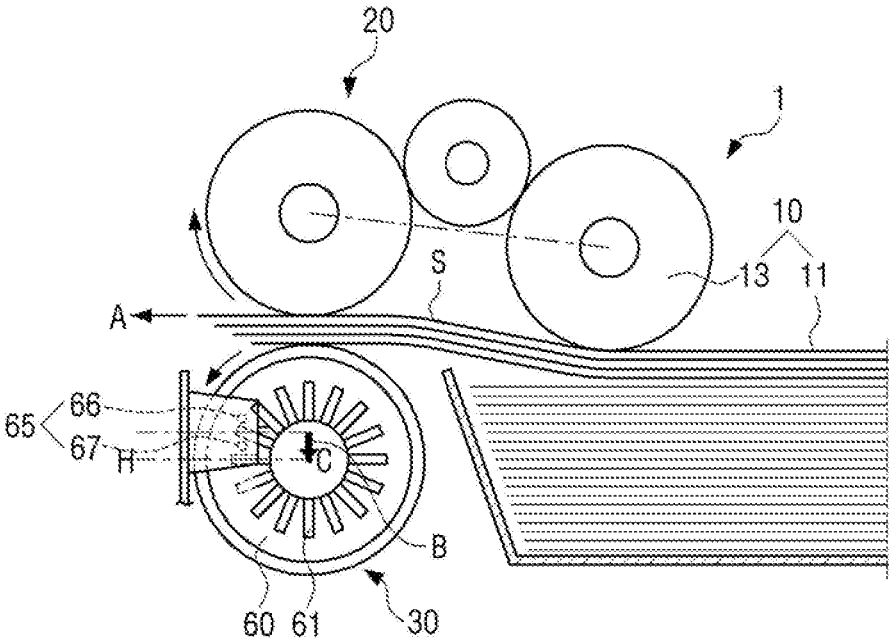
【Figure 29b】
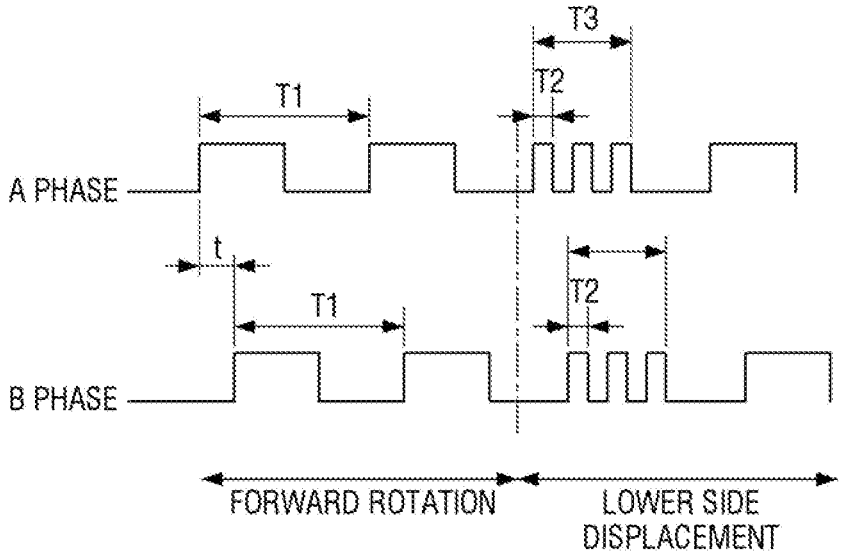

【Figure 30a】
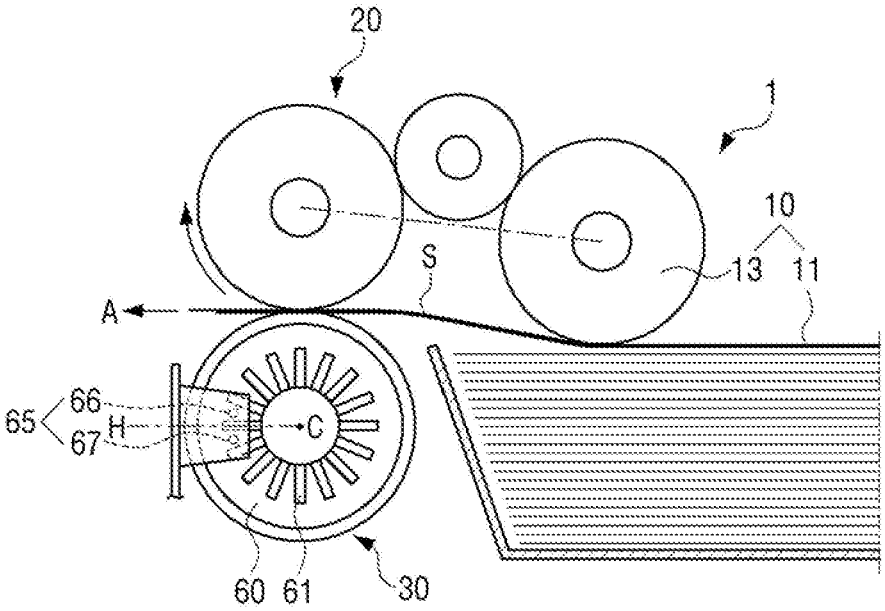
【Figure 30b】
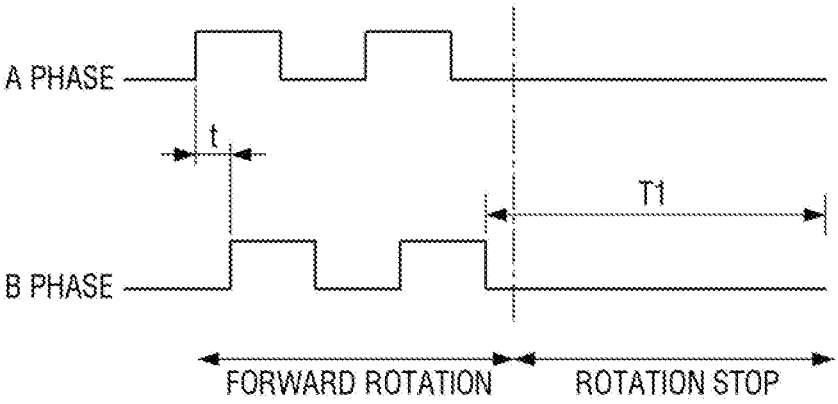

【Figure 31a】
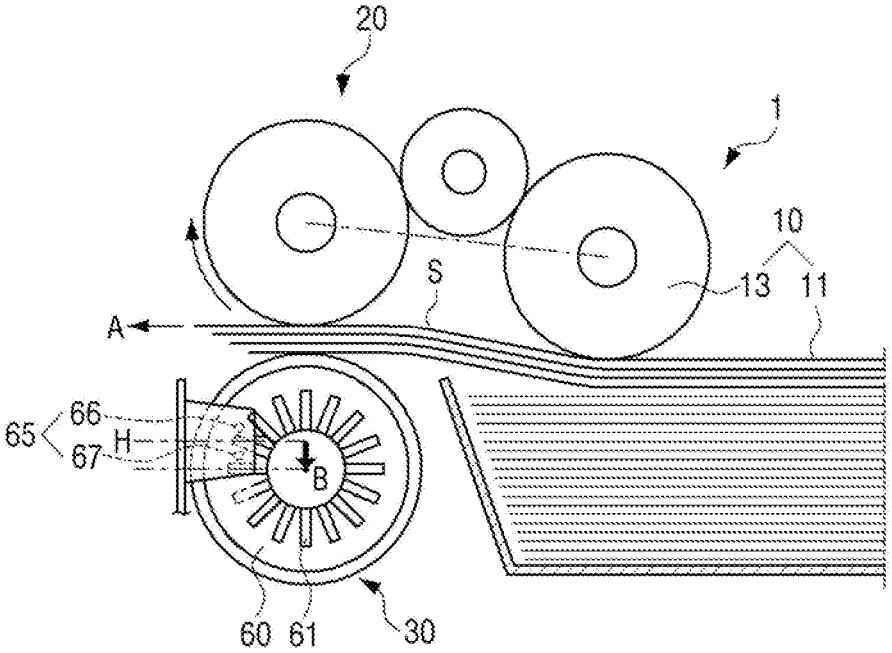
【Figure 31b】
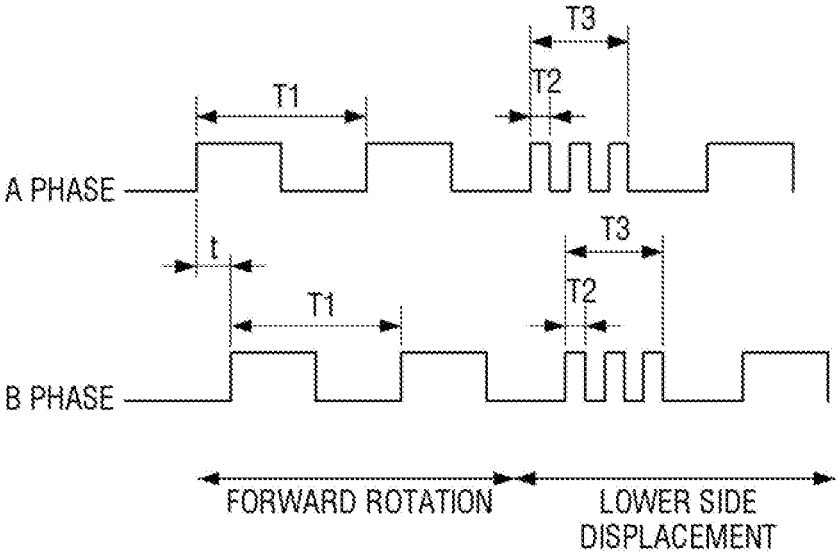

【Figure 32】
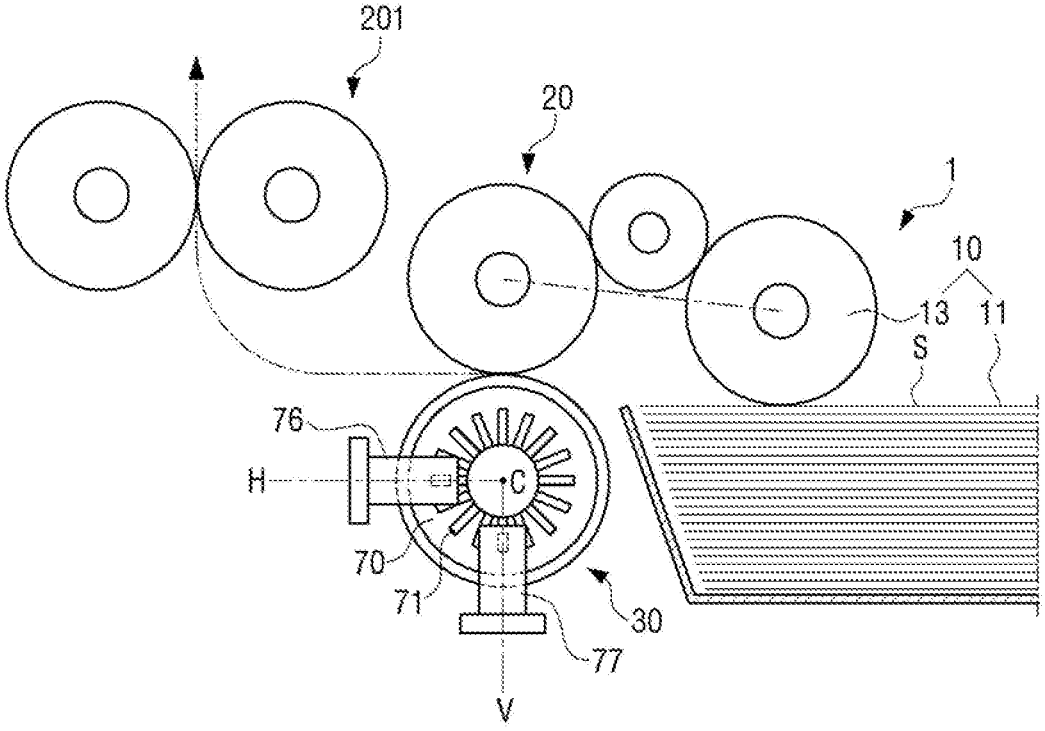

【Figure 33】
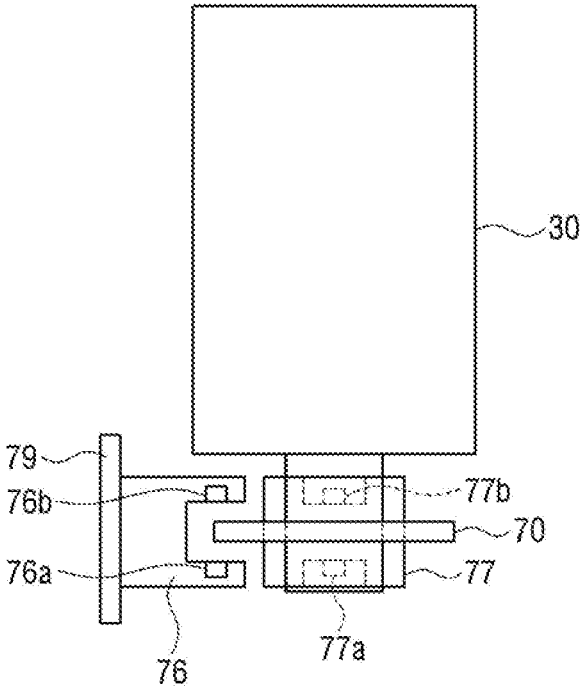

【Figure 34a】
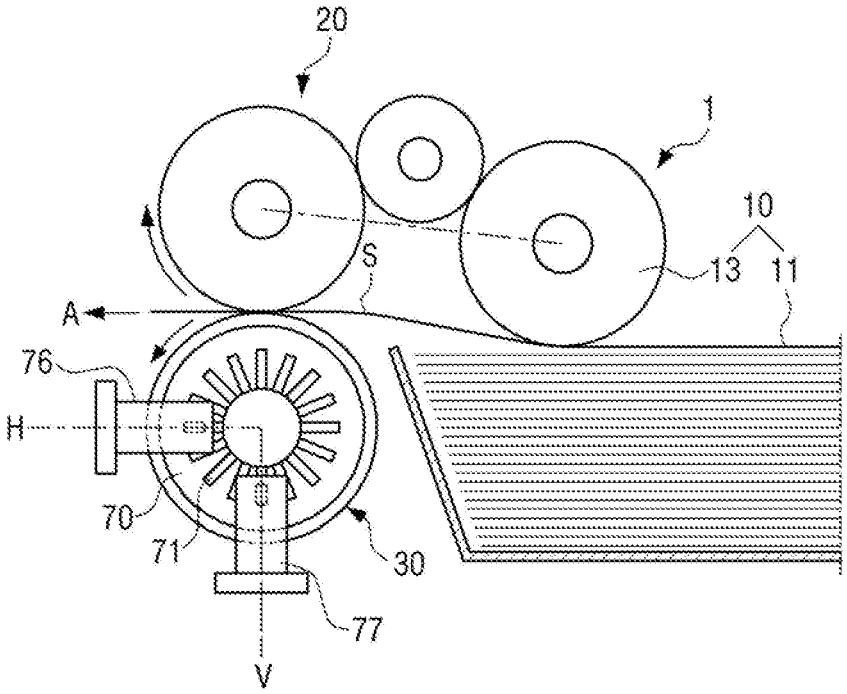
【Figure 34b】
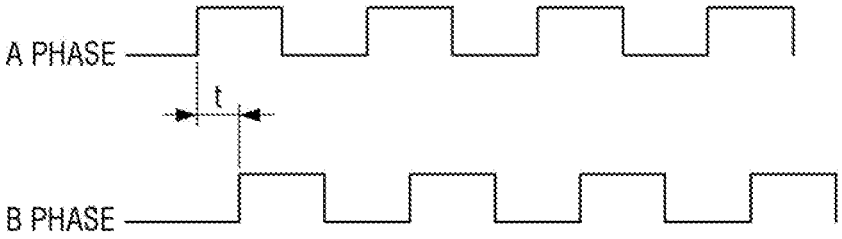

【Figure 35a】
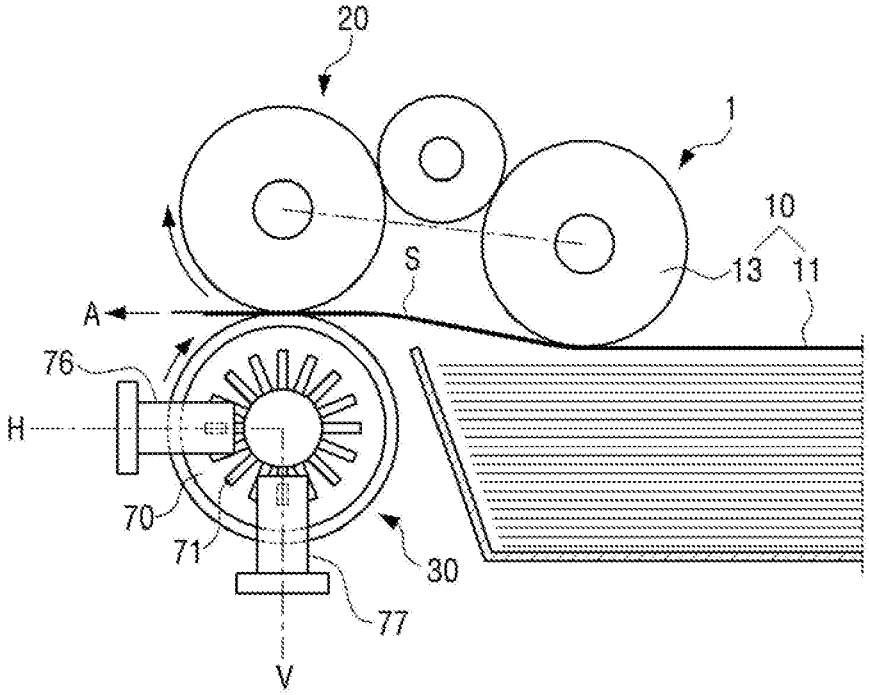
【Figure 35b】
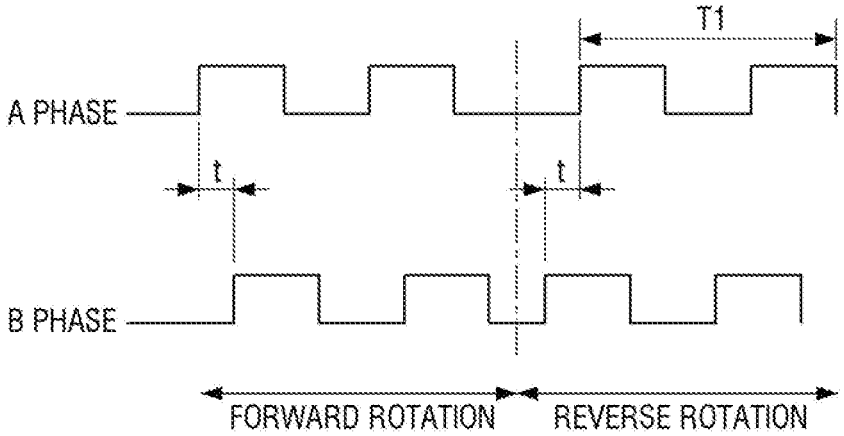

【Figure 36a】
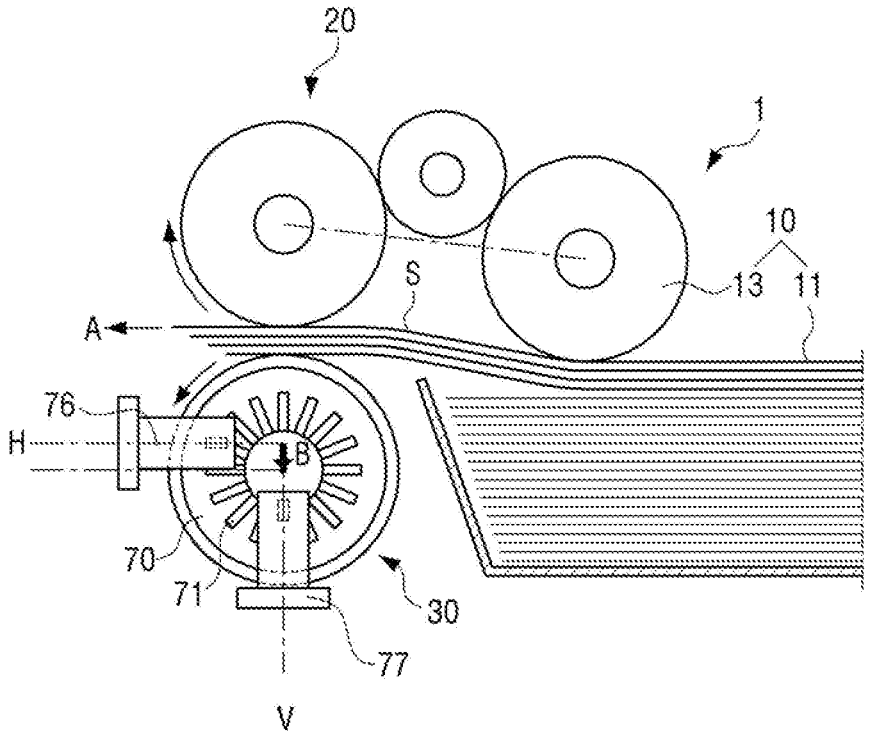
【Figure 36b】
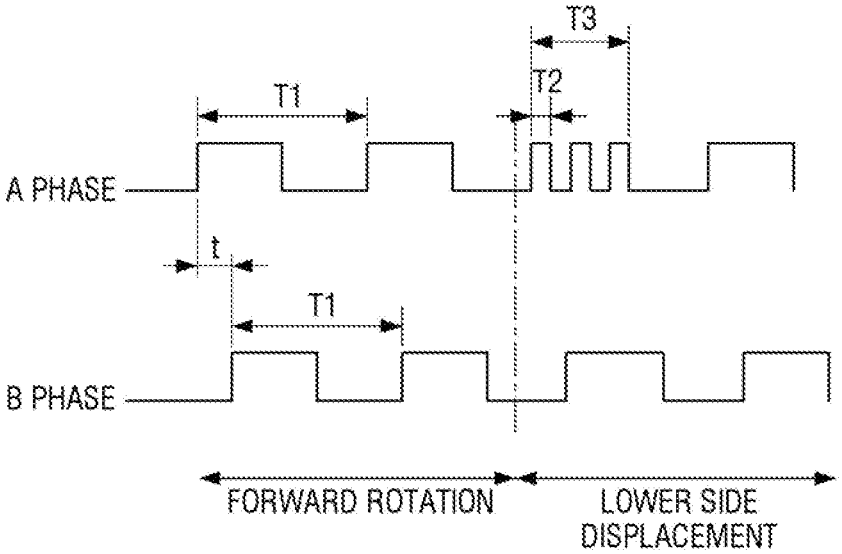

【Figure 36c】
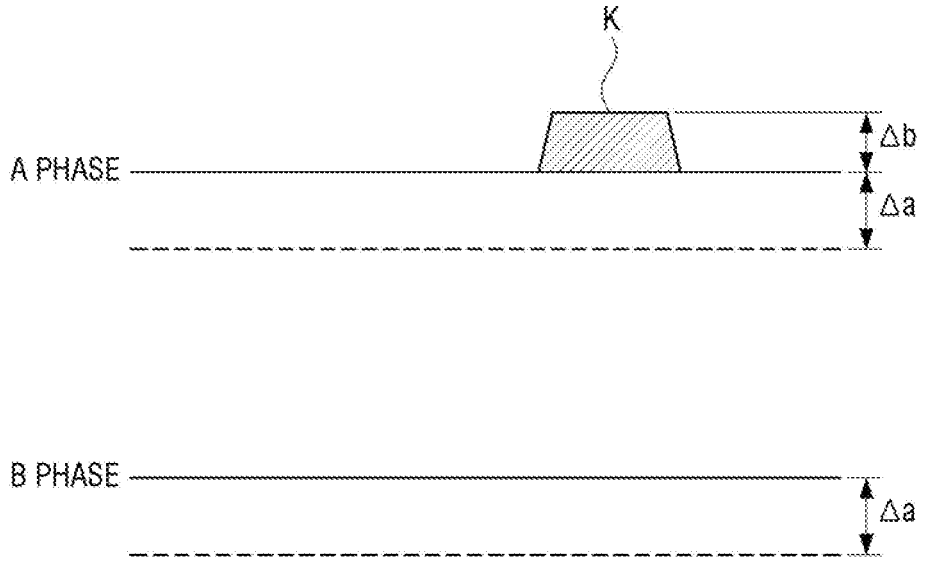

USAGE DETERMINATION OF MULTI-FEED PREVENTION ROLLER

CROSS REFERENCE TO RELATED APPLICATIONS

This application is filed under 35 U.S.C. § 371 as a PCT national stage of PCT International Application No. PCT/KR 2018/000242, filed on Jan. 5, 2018, which claims the priority benefit of Korean Patent Application No. 10-2017-0004184, filed on Jan. 11, 2017 and Korean Patent Application No. 10-2017-0099208, filed on Aug. 4, 2017, the contents of the International Application and the Korean Patent Applications are incorporated by reference herein in their entirety.

BACKGROUND ART

Generally, an image forming apparatus includes a sheet feeding apparatus for feeding sheets one by one to an image former.

Since a pickup roller, a sheet feeding roller, and a multi-feed prevention roller of the sheet feeding apparatus which feeds stacked sheets one by one are worn out, sheet feeding failure such as miss-feed, jam, multi-feed, and the like may occur if the pickup roller, the sheet feeding roller, and the multi-feed prevention roller are not replaced with new ones after a predetermined number of sheets, for example, 200,000 sheets are fed.

Further, when the lifetime of one or more of the rollers is over and two or more sheets stacked on the sheet feeding apparatus are fed to the image former, an appropriate image may not be properly formed on the sheets. Therefore, the sheet feeding apparatus may be provided with a multi-feed detecting apparatus capable of detecting the multi-feed of sheets.

DISCLOSURE

Description of Drawings

These and other aspects and advantages of the present disclosure will become apparent and more readily appreciated from the following description of the examples, taken in conjunction with the accompanying drawings of which:

FIG. 1 is a view schematically illustrating a sheet feeding apparatus according to an example of the present disclosure;

FIG. 2 is a view illustrating a multi-feed prevention roller and a sheet feed roller of the sheet feeding apparatus of FIG. 1;

FIG. 3 is a cross-sectional view illustrating a structure of a magnetic torque limiter of a sheet feeding apparatus according to an example of the present disclosure;

FIG. 4 is a cross-sectional view illustrating the magnetic torque limiter of FIG. 3 taken along a line I-I;

FIG. 5 is a view illustrating a structure of a sheet feeding apparatus with a single hall IC according to an example of the present disclosure;

FIG. 6 is a cross-sectional view illustrating another magnetic torque limiter of a sheet feeding apparatus according to an example of the present disclosure;

FIG. 7 is a cross-sectional view illustrating the magnetic torque limiter of FIG. 6 taken along a line II-II;

FIG. 8 is a view for explaining operation of a sheet feed motor, a pickup roller, a sheet feed roller, and a multi-feed prevention roller of a sheet feeding apparatus according to an example of the present disclosure;

FIG. 9 is a functional block diagram of a sheet feeding apparatus according to an example of the present disclosure;

FIG. 10 is a view for explaining operation of a sheet feed motor, a pickup roller, a sheet feed roller, and a multi-feed prevention roller when a sheet feeding apparatus according to an example of the present disclosure performs a first self-diagnosis;

FIG. 11 is a diagram illustrating pulses output form a hall sensor when a sheet feeding apparatus according to an example of the present disclosure performs a first self-diagnosis;

FIG. 12 is a perspective view illustrating a multi-feed prevention roller of a sheet feeding apparatus which is unevenly worn according to an example of the present disclosure;

FIG. 13 is a view for explaining operation of a sheet feed motor, a pickup roller, a sheet feed roller, and a multi-feed prevention roller when a sheet feeding apparatus according to an example of the present disclosure performs a second self-diagnosis;

FIG. 14 is a view illustrating a state where a magnetic torque limiter and a drive shaft of a sheet feeding apparatus according to an example of the present disclosure are connected by a coupling;

FIG. 15 is a cross-sectional view schematically illustrating an image forming apparatus including two sheet feeding apparatuses according to an example of the present disclosure;

FIG. 16 is a view schematically illustrating an example of a sheet feeding apparatus according to the present disclosure;

FIG. 17A is a view illustrating a case where a sheet feeding apparatus is normally feeding a sheet according to an example of the present disclosure;

FIG. 17B is a view illustrating signals output from a first hall sensor and a second hall sensor in the case of FIG. 17A;

FIG. 18A is a view illustrating a case where two sheets are fed to a multi-feed prevention roller of a sheet feeding apparatus according to an example of the present disclosure;

FIG. 18B is a view illustrating signals output from a first hall sensor and a second hall sensor in the case of FIG. 18A;

FIG. 19A is a view illustrating a case where three or more sheets are fed to a multi-feed prevention roller of a sheet feeding apparatus according to an example of the present disclosure;

FIG. 19B is a view illustrating signals output from a first hall sensor and a second hall sensor in the case of FIG. 19B;

FIG. 20 is a plan view schematically illustrating a sheet feeding apparatus having a sheet return function according to an example of the present disclosure;

FIG. 21 is a side view illustrating an example case where the sheet feeding apparatus of FIG. 20 does not operate;

FIG. 22 is a side view illustrating an example case where the sheet feeding apparatus of FIG. 20 normally feeds a sheet;

FIG. 23 is a side view illustrating an example case where the sheet feeding apparatus of FIG. 20 returns the sheet to a retrying position;

FIG. 24 is a functional block diagram of a sheet feeding apparatus according to an example of the present disclosure;

FIG. 25 is a view schematically illustrating a sheet feeding apparatus according to another example of the present disclosure;

FIG. 26 is a plan view illustrating a multi-feed prevention roller of the sheet feeding apparatus of FIG. 25;

FIG. 27A is a view illustrating an example case where the sheet feeding apparatus of FIG. 25 normally feeds a sheet;

FIG. 27B is a view illustrating signals output from a first optical sensor and a second optical sensor in the case of FIG. 27A;

FIG. 28A is a view illustrating an example case where two sheets are fed to a multi-feed prevention roller when the multi-feed prevention roller of the sheet feeding apparatus of FIG. 25 is an active roller;

FIG. 28B is a view illustrating signals output from a first optical sensor and a second optical sensor in the case of FIG. 28A;

FIG. 29A is a view illustrating an example case where three sheets or more are fed to a multi-feed prevention roller when the multi-feed prevention roller of the sheet feeding apparatus of FIG. 25 is an active roller;

FIG. 29B is a view illustrating signals output from a first optical sensor and a second optical sensor in the case of FIG. 29A;

FIG. 30A is a view illustrating a case where two sheets are fed to a multi-feed prevention roller of a sheet feeding apparatus including a semi-active multi-feed prevention roller according to an example of the present disclosure;

FIG. 30B is a view illustrating signals output from a first optical sensor and a second optical sensor in the case of FIG. 30A;

FIG. 31A is a view illustrating a case where three sheets or more are fed to a multi-feed prevention roller of a sheet feeding apparatus including a semi-active multi-feed prevention roller according to an example of the present disclosure;

FIG. 31B is a view illustrating signals output from a first optical sensor and a second optical sensor in the case of FIG. 31A;

FIG. 32 is a view schematically illustrating a sheet feeding apparatus according to another example of the present disclosure;

FIG. 33 is a plan view illustrating a multi-feed prevention roller of the sheet feeding apparatus of FIG. 32;

FIG. 34A is a view illustrating an example case where the sheet feeding apparatus of FIG. 32 normally feeds a sheet;

FIG. 34B is a view illustrating signals output from a first optical sensor and a second optical sensor in the case of FIG. 34A;

FIG. 35A is a view illustrating an example case where two sheets are fed to a multi-feed prevention roller when the multi-feed prevention roller of the sheet feeding apparatus of FIG. 32 is an active roller;

FIG. 35B is a view illustrating signals output from a first optical sensor and a second optical sensor in the case of FIG. 35A;

FIG. 36A is a view illustrating an example case where three sheets or more are fed to a multi-feed prevention roller when the multi-feed prevention roller of the sheet feeding apparatus of FIG. 32 is an active roller;

FIG. 36B is a view illustrating signals output from a first photo sensor and a second photo sensor in the case of FIG. 36A;

FIG. 36C is a view illustrating an example case where pulse signals output from a first optical sensor and a second optical sensor are converted into a voltage in a case of FIG. 36A.

Throughout the drawings, like reference numerals will be understood to refer to like parts, components and structures.

MODE FOR INVENTION

Hereinafter, certain exemplary examples of the present disclosure will be described in detail with reference to the accompanying drawings.

The matters defined herein, such as a detailed construction and elements thereof, are provided to assist in a comprehensive understanding of this description. Thus, it is apparent that exemplary examples may be carried out without those defined matters. Also, well-known functions or constructions are omitted to provide a clear and concise description of exemplary examples. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary examples, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

The terms and words used in the following description and claims are not limited to the bibliographical meanings, but, are merely used by the inventor to enable a clear and consistent understanding of the present disclosure. Accordingly, it should be apparent to those skilled in the art that the following description of various examples of the present disclosure is provided for illustration purpose only and not for the purpose of limiting the present disclosure as defined by the appended claims and their equivalents.

FIG. 1 is a view schematically illustrating an example of a sheet feeding apparatus according to an example of the present disclosure, and FIG. 2 is a view illustrating a multi-feed prevention roller and a sheet feed roller of the sheet feeding apparatus of FIG. 1.

Referring to FIGS. 1 and 2, a sheet feeding apparatus 1 according to an example of the present disclosure may include a sheet stacker 10, a sheet feed roller 20, and a multi-feed prevention roller 30.

The sheet stacker 10 stacks at least one sheet S, picks up the stacked sheets S one by one, and feeds the picked sheet S toward the sheet feed roller 20. The sheet stacker 10 may include a sheet cassette 11 and a pickup roller 13 provided above the sheet cassette 11. The sheet cassette 11 is configured to accommodate a predetermined number of sheets S. The pickup roller 13 is formed to convey the sheet S positioned at the top of the sheets S stacked on the sheet cassette 11 toward the sheet feed roller 20.

The sheet feed roller 20 is provided at the front end of the sheet stacker 10 and moves the sheet S stacked on the sheet stacker 10 to a conveying roller 201. In detail, the sheet feed roller 20 is formed to move the sheet S picked up by the pickup roller 13 in the sheet stacker 10 to the conveying roller 201.

The conveying roller 201 is formed in a pair of rollers facing each other and moves the sheet S fed by the sheet feed roller 20 to an image former 220. FIG. 1 shows a case where the sheet feeding apparatus 1 according to an example of the present disclosure is disposed in an image forming apparatus 200 (see FIG. 15).

The sheet feed roller 20 is disposed to be rotated by a driving source 100. As an example, the driving source 100 may use a sheet feed motor. Since the structure in which the sheet feed motor rotates the sheet feed roller 20 is general, the illustration and description thereof are omitted.

The multi-feed prevention roller 30 is provided to face the sheet feed roller 20 and to prevent the multi-feed of sheets S fed from the sheet stacker 10. For example, the multi-feed prevention roller 30 is provided to be in contact with the sheet feed roller 20 at a predetermined pressure and is rotated by the rotation of the sheet feed roller 20 when a single sheet S is fed from the sheet stacker 10 so that the sheet S is conveyed to the conveying roller 201.

The multi-feed prevention roller 30 may be elastically supported by a multi-feed prevention roller holder 33 so that the multi-feed prevention roller 30 is in contact with the sheet feed roller 20 at a predetermined pressure. The multi-feed prevention roller holder 33 is elastically supported by elastic members 35 provided on a frame 3.

When two or more sheets S enter between the multi-feed prevention roller 30 and the sheet feed roller 20, the multi-feed prevention roller 30 prevents the two or more sheets S from passing in between the multi-feed prevention roller 30 and the sheet feed roller 20. Hereinafter, preventing two or more sheet S from passing between the sheet feed roller 20 and the multi-feed prevention roller 30 is referred as multi-feed prevention.

A magnetic torque limiter 40 is provided in the multi-feed prevention roller 30 for preventing the multi-feed of the sheets S. In detail, the magnetic torque limiter 40 is disposed coaxially with a rotation shaft 31 of the multi-feed prevention roller 30 and has a predetermined torque threshold value. Therefore, when a sheet conveyance frictional force generated between the multi-feed prevention roller 30 and the sheet feed roller 20 is larger than the torque threshold value, the multi-feed prevention roller 30 rotates in the direction of interlocking with the rotation of the sheet feed roller 20, that is, in a sheet conveying direction. However, when the sheet conveyance frictional force generated between the multi-feed prevention roller 30 and the sheet feed roller 20 is smaller than the torque threshold value, the multi-feed prevention roller 30 does not rotate with the sheet feed roller 20, but rotates in the opposite direction or remains stationary.

Accordingly, when a single sheet S enters between the multi-feed prevention roller 30 and the sheet feed roller 20, the sheet conveyance frictional force between the multi-feed prevention roller 30 and the sheet S becomes larger than the torque threshold value of the magnetic torque limiter 40 and the multi-feed prevention roller 30 rotates in the sheet conveying direction so that the sheet S is normally conveyed. However, when two or more sheets S enter between the multi-feed prevention roller 30 and the sheet feed roller 20, the sheet conveyance frictional force becomes smaller than the torque threshold value and the multi-feed prevention roller 30 rotates in the direction opposite to the sheet conveying direction or stops so that the conveyance of the sheet S is interrupted.

Hereinafter, the structure of the magnetic torque limiter 40 provided on one side of the multi-feed prevention roller 30 will be described with reference to FIGS. 3 and 4.

FIG. 3 is a cross-sectional view illustrating a structure of a magnetic torque limiter of a sheet feeding apparatus according to an example of the present disclosure, and FIG. 4 is a cross-sectional view illustrating the magnetic torque limiter of FIG. 3 taken along a line I-I.

Referring to FIGS. 3 and 4, the magnetic torque limiter 40 includes a plurality of permanent magnets 41 provided in the circumferential direction on the rotation shaft 31 of the multi-feed prevention roller 30. Each of the plurality of permanent magnets 41 is formed in a bar shape and is provided on the circumferential surface of a magnet support portion 32 provided coaxially with the rotation shaft 31 so that N poles and S poles are alternately arranged in the circumferential direction of the rotation shaft 31. The magnet support portion 32 is formed in a cylindrical shape larger in diameter than the rotation shaft 31 and may be formed integrally with the rotation shaft 31 of the multi-feed prevention roller 30.

In the present example, the plurality of permanent magnets 41 are provided on the outer circumferential surface of the magnet support portion 32 connected to the rotation shaft 31 of the multi-feed prevention roller 30. However, as another example, the plurality of permanent magnets 41 may be provided on the outer circumferential surface of a hollow cylindrical boss and the boss may be coaxially connected to the rotation shaft 31 of the multi-feed prevention roller 30.

The magnetic torque limiter 40 may include a housing 43 enclosing the plurality of permanent magnets 41 provided on the rotation shaft 31. A housing shaft 47 is provided on one side of the housing 43 and an opening 44 into which the rotation shaft 31 of the multi-feed prevention roller 30 is inserted is provided on the other side of the housing 43.

In addition, a magnetic member 45 is provided on the inner surface of the housing 43 to face the plurality of permanent magnets 41 so that a magnetic force is generated between the plurality of permanent magnets 41 and the magnetic member 45. The magnetic member 45 is formed in a hollow cylindrical shape. The magnetic member 45 is spaced apart in the radial direction by a predetermined distance from the plurality of permanent magnets 41.

The housing 43 is formed of a non-magnetic material such as plastic. The length L1 of the magnetic member 45 is formed to be shorter than the length L2 of the housing 43. Therefore, as illustrated in FIG. 3, portions 41*a* of the plurality of permanent magnets 41 directly face the inner surface of the housing 43 without facing the magnetic member 45. Accordingly, the magnetic force of the plurality of permanent magnets 41 is radiated to the outside of the housing 43 through a portion 43*a* of the housing 43 where the magnetic member 45 is not provided. Therefore, the portion 43*a* of the housing 43 through which the magnetic force of the plurality of permanent magnets 41 is radiated to the outside of the housing 43 over the entire circumference of the housing 43 may be referred to as a magnetic force emitting region. The magnetic force of the plurality of permanent magnets 41 is not radiated to the outside at the portion of the housing 43 where the magnetic member 45 is provided.

The housing shaft 47 is rotatably supported by a rotation support member (not illustrated) such as a bearing. The housing shaft 47 may be configured to receive or not to receive rotational force from the driving source 100.

When the housing shaft 47 is configured to receive the rotational force from the driving source 100, the multi-feed prevention roller 30 is rotatable by the driving source 100. At this time, the housing shaft 47 is connected to the driving shaft that receives the rotational force from the driving source 100 and rotates. The housing shaft 47 and the driving shaft of the driving source 100 may be coupled using a coupling such as a universal joint.

In the case where the multi-feed prevention roller 30 is configured to be rotated by the separate driving source 100 as described above, the multi-feed prevention roller 30 may be referred to as an active multi-feed prevention roller. As another example, the housing shaft 47 may be provided to only support the rotation of the multi-feed prevention roller 30 without receiving power from the driving source 100. When the housing shaft 47 is not connected to the driving source 100 as described above, the multi-feed prevention roller 30 can be rotated only by the rotation of the sheet feed roller 20. Such a multi-feed prevention roller 30 may be referred to as a semi-active multi-feed prevention roller.

A sensor 50 may be provided in the outer side of the housing 43 and may detect the magnetic force of the plurality of permanent magnets 41 radiated to the outside of the housing 43. A hall sensor capable of detecting a magnetic force may be used as the sensor 50.

The hall sensor 50 is provided in the outside of the housing 43 to face the portion 43*a* of the housing 43 where the magnetic member 45 is not provided on the inner surface of the housing 43. In other words, the hall sensor 50 is disposed in the outside of the housing 43 to face the portion 43*a* of the housing 43 facing the portions 41*a* of the plurality of permanent magnets 41 which do not overlap with the magnetic member 45, that is, a magnetic force emitting region.

For example, as illustrated in FIG. 4, the hall sensor 50 is disposed outside the magnetic torque limiter 40 in the radial direction of the magnetic torque limiter 40. The hall sensor 50 is provided on a separate bracket 55 and does not interfere with the magnetic torque limiter 40. The bracket 55 may be fixed to a frame 3 in which the sheet feeding apparatus 1 is provided. Therefore, when the magnetic torque limiter 40 rotates, the hall sensor 50 does not interfere with the magnetic torque limiter 40, and can detect the magnetic force emitted from the plurality of permanent magnets 41 of the magnetic torque limiter 40.

The hall sensor 50 may include two hall sensors 51 and 52 which are provided in the circumferential direction of the magnetic torque limiter 40 to detect the rotational direction of the magnetic torque limiter 40. For example, a first hall sensor 51 may be disposed on a horizontal line H passing the rotation center C of the magnetic torque limiter 40, and a second hall sensor 52 may be disposed at a predetermined angle from the first hall sensor 51 in the circumferential direction of the magnetic torque limiter 40.

When the first hall sensor 51 and the second hall sensor 52 are provided in the circumferential direction of the magnetic torque limiter 40 as described above, whether the magnetic torque limiter 40, that is, the plurality of permanent magnets 41 are rotated or not, and the rotational direction and displacement of the magnetic torque limiter 40 may be detected. Since the plurality of permanent magnets 41 are provided integrally with the multi-feed prevention roller 30, whether the multi-feed prevention roller 30 rotates or not, and the rotational direction and displacement of the multi-feed prevention roller 30 may be detected through the two hall sensors 51 and 52.

Although the case where the hall sensor 50 is composed of two hall sensors 51 and 52 has been described above, the hall sensor 50 is not limited thereto. For example, the hall sensor 50 may use a hall IC sensor 50' in which the two hall sensors 51 and 52 are embedded and integrated in a single body. The hall IC sensor 50' may be implemented in a form capable of detecting changes in the number of revolutions and the rotational direction of the magnetic torque limiter 40 from the number of pulses and the phase difference of the embedded two hall sensors 51 and 52.

As another example, the hall IC sensor 50' may be implemented so that the hall IC sensor 50' is arranged in the vertical direction or the horizontal direction with respect to the magnetic flex direction, and the pulse output and the switching of the rotational direction are detected from the magnetic flux phase difference of each of the embedded two hall sensors 51 and 52.

FIG. 5 is a view illustrating a structure of a sheet feeding apparatus according to an example of the present disclosure provided with a single hall IC sensor.

Referring to FIG. 5, the hall IC sensor 50' is disposed on a substrate 53, and the substrate 53 is fixed to a substrate holder 54. The substrate holder 54 may be fixed to a bracket 57 secured to the frame of the sheet feeding apparatus 1. Accordingly, when the magnetic torque limiter 40 rotates, the hall IC sensor 50' can detect the magnetic force radiated from the plurality of permanent magnets 41 of the magnetic torque limiter 40 in a stable state.

When a change in the magnetic force of the magnetic torque limiter 40 is detected using the single hall IC sensor 50' as illustrated in FIG. 5, it may be easy to arrange the hall sensor 50 in comparison with the case where a change in the magnetic force is detected using the two hall sensors 51 and 52 provided along the circumferential direction of the magnetic torque limiter 40 as illustrated in FIG. 4.

Hereinafter, another example of the magnetic torque limiter that can be used in the sheet feeding apparatus according to an example of the present disclosure will be described with reference to FIGS. 6 and 7.

FIG. 6 is a cross-sectional view illustrating another magnetic torque limiter of a sheet feeding apparatus according to an example of the present disclosure, and FIG. 7 is a cross-sectional view illustrating the magnetic torque limiter of FIG. 6 taken along a line II-II.

Referring to FIGS. 6 and 7, the magnetic torque limiter 40 may include a plurality of permanent magnets 41, a housing 43, and a magnetic member 45'.

The plurality of permanent magnets 41 are disposed in the circumferential direction on the outer circumferential surface of the magnet support portion 32 provided on the rotation shaft 31 of the multi-feed prevention roller 30, and are the same as or similar to the plurality of permanent magnets 41 of the magnetic torque limiter 40 according to the example illustrated in FIGS. 3 and 4; therefore, a detailed description thereof is omitted.

The housing 43 is disposed to surround the plurality of permanent magnets 41 provided on the rotation shaft 31 and is the same as or similar to the housing 43 of the magnetic torque limiter 40 according to the example illustrated in FIGS. 3 and 4; therefore, a detailed description thereof is omitted.

The magnetic member 45' is provided on the inner surface of the housing 43 and is formed to have substantially the same length as each of the plurality of permanent magnets 41. A plurality of slits 46 are formed in the circumferential direction near one end of the magnetic member 45'. The magnetic force generated in the plurality of permanent magnets 41 may be radiated to the outside of the housing 43 through the plurality of slits 46. Therefore, a portion 43*a* of the housing 43 corresponding to the plurality of slits 46 of the magnetic member 45' may be referred to as a magnetic force emitting region.

The hall sensor 50 as described above is disposed in the outside of the housing 43 and is provided to face the plurality of slits 46 through the side surface of the housing 43. In other words, the hall sensor 50 is disposed outside the housing 43 to face the portion 43*a* of the housing 43 facing the plurality of slits 46, that is, the magnetic force emitting region. Accordingly, when two hall sensors 51 and 52 are provided in the circumferential direction in the outside of the magnetic torque limiter 40, that is, in the outside of the housing 43, the hall sensors 51 and 52 can detect the magnetic force of the plurality of permanent magnets 41 that are radiated through the plurality of slits 46.

Therefore, the magnetic torque limiter 40 and the hall sensor 50 may constitute a roller self-diagnosis portion capable of diagnosing the life span of the multi-feed prevention roller 30.

The sheet feeding apparatus 1 according to an example of the present disclosure may include a controller 9 (see FIG. 9). For example, the controller 9 may include at least one processing circuit, various electronic components such an ASIC, ROM, RAM, and the like, or at least one program module.

The controller 9 may be configured to control the sheet feeding apparatus 1 to feed the sheets S stacked on the sheet cassette 11 one by one. In addition, the controller 9 may perform the roller self-diagnosis using the hall sensor 50. For example, the controller 9 may determine whether to replace the multi-feed prevention roller 30 by identifying the wear state of the multi-feed prevention roller 30 by using a signal input from the hall sensor 50.

When the controller 9 determines that the replacement of the multi-feed prevention roller 30 is required due to the lifetime of the multi-feed prevention roller 30, the controller 9 may also inform a user that the sheet feed roller 20 and the pickup roller 13 are required to be replaced together with the multi-feed prevention roller 30. Since the sheet feed roller 20 and the pickup roller 13 pickup and feed the sheets S stacked on the sheet cassette 11 one by one together with the multi-feed prevention roller 30, when the lifetime of the multi-feed prevention roller 30 is over, the sheet feed roller 20 and the pickup roller 13 may be determined to have reached the end of the their lifetime and may be required to be replaced together with the multi-feed prevention roller 30.

In addition, when the multi-feed prevention roller 30 of the sheet feeding apparatus 1 can be driven, the controller 9 may identify the connection state of the magnetic torque limiter 40. For example, when the assembled state of the magnetic torque limiter 40 and the drive shaft 49 (see FIG. 14) is poor, a regular rotation fluctuation may be detected by the hall sensor 50. When the rotation fluctuation detected by the hall sensor 50 exceeds a reference value, the controller 9 may determine that the connection state of the magnetic torque limiter 40 is poor.

In addition, the controller 9 may determine whether the multi-feed occurs in the multi-feed prevention roller 30 of the sheet feeding apparatus 1. A method by which the controller 9 detects the multi-feed will be described later.

When it is necessary to replace the multi-feed prevention roller 30, the sheet feed roller 20, and the pickup roller 13 or when the multi-feed of the sheets S occur, the controller 9 may be configured to inform the outside of the roller replacement and the occurrence of the multi-feed. When the sheet feeding apparatus 1 is disposed in an image forming apparatus 200 (see FIG. 15), the controller 9 may be configured as a part of a main controller 209 to control the operation of the image forming apparatus 200.

Hereinafter, a roller self-diagnosis method of a sheet feeding apparatus according to an example of the present disclosure will be described in detail with reference to FIGS. 8 and 9.

FIG. 8 is a view for explaining operation of a sheet feeding motor, a pickup roller, a sheet feed roller, and a multi-feed prevention roller of a sheet feeding apparatus according to an example of the present disclosure, and FIG. 9 is a functional block diagram of a sheet feeding apparatus according to an example of the present disclosure.

Referring to FIGS. 8 and 9, the sheet feeding apparatus 1 may include a sheet cassette 11, a pickup roller 13, a sheet feed roller 20, a multi-feed prevention roller 30, a sheet feed motor 100, a sheet feed clutch 81, a pickup clutch 82, a hall sensor 50, a controller 9, a storage portion 9-1, and a transmission portion 9-2.

The sheet cassette 11 is configured to receive a predetermined number of sheets S, and the pickup roller 13 is configured to move the sheet S positioned on the top of the sheets S stacked on the sheet cassette 11 toward the sheet feed roller 20.

The sheet feed roller 20 is provided at the leading end of the sheet cassette 11 and moves the sheet S picked up by the pickup roller 13 toward the conveying roller 201 (see FIG. 1).

The multi-feed prevention roller 30 is provided to face the sheet feed roller 20 and to prevent the multi-feed of the sheets S fed from the sheet cassette 11. In detail, the multi-feed prevention roller 30 is provided to be in contact with the sheet feed roller 20 at a predetermined pressure, and a magnetic torque limiter 40 is provided coaxially with the multi-feed prevention roller 30 (see FIG. 3). Accordingly, when one sheet S is conveyed from the sheet cassette 11, the multi-feed prevention roller 30 is rotated in the sheet conveying direction by the rotation of the sheet feed roller 20 so that the sheet S is conveyed toward the conveying roller 201. However, when two or more sheets S are conveyed, the multi-feed prevention roller 30 is rotated in the direction opposite to the sheet conveying direction or stops by the magnetic torque limiter 40, thereby preventing the multi-feed of the sheets S.

The sheet feed motor 100 generates rotational force capable of rotating the sheet feed roller 20, the pickup roller 13, and the multi-feed prevention roller 30. As another example, the rotational force of the sheet feed motor 100 may not be transmitted to the multi-feed prevention roller 30. However, the sheet feeding apparatus 1 as illustrated in FIG. 8 is configured so that the rotational force of the sheet feed motor 100 is transmitted to the multi-feed prevention roller 30.

The rotational force of the sheet feed motor 100 is transmitted to the sheet feed roller 20 through the sheet feed clutch 81. For example, when the sheet feed clutch 81 is turned on, the rotational force of the sheet feed motor 100 is transmitted to the sheet feed roller 20 and the pickup roller 13 so that the sheet feed roller 20 and the pickup roller 13 rotate. Conversely, when the sheet feed clutch 81 is turned off, the rotational force of the sheet feed motor 100 is not transmitted to the sheet feed roller 20 so that the sheet feed roller 20 and the pickup roller 13 do not rotate. In other words, the pickup roller 13 is configured to rotate together with the sheet feed roller 20 when the sheet feed roller 20 rotates.

When the sheet feed clutch 81 is turned on, the rotational force of the sheet feed motor 100 is transmitted to a pickup roller cam 83 through the pickup clutch 82, thereby lowering the pickup roller 13. For example, when the pickup clutch 82 is turned on while the sheet feed clutch 81 is turned on, the rotational force of the sheet feed motor 100 is transmitted to the pickup roller cam 83 so that the pickup roller cam 83 rotates. The pickup roller 13 is lowered by the rotation of the pickup roller cam 83 and is brought into contact with the sheet S of the sheet cassette 11.

Conversely, when the pickup clutch 82 is turned off, the rotational force of the sheet feed motor 100 is not transmitted to the pickup roller cam 83, so that the pickup roller cam 83 does not press the pickup roller 13 downward. Accordingly, the pickup roller 13 is kept spaced apart from the sheet S of the sheet cassette 11 by a pickup roller spring 14. When the sheet feed clutch 81 is turned off, the pickup roller 13 is spaced apart from the sheet S of the sheet cassette 11 by the pickup roller spring 14 regardless of whether the pickup clutch 82 is turned on or off.

Each of the sheet feed clutch 81 and the pickup clutch 82 may be implemented with an electromagnetic clutch whose on/off is controlled by the controller 9.

The rotational force of the sheet feed motor 100 is transmitted to the multi-feed prevention roller 30 to rotate the multi-feed prevention roller 30. Since the multi-feed prevention roller 30 is directly connected to the sheet feed motor 100, when the sheet feed motor 100 operates, the multi-feed prevention roller 30 also rotates in one direction.

A sheet feed sensor 86 capable of detecting the leading end of the sheet S having passed between the sheet feed roller 20 and the multi-feed prevention roller 30 may be provided in front of the sheet feed roller 20 in the conveying direction of the sheet S. A lift sensor 87 may be provided at one side of the multi-feed prevention roller 30 to detect that the multi-feed prevention roller 30 is raised and contacted with the sheet feed roller 20. In addition, a cam position sensor 88 for detecting the position of the cam may be provided at one side of a multi-feed prevention roller lowering cam 84 for lowering the multi-feed prevention roller 30.

The hall sensor 50 is disposed at one side of the magnetic torque limiter 40 that is provided coaxially with the multi-feed prevention roller 30 and is configured to detect the magnetic force radiated from the magnetic torque limiter 40 and to output a pulse signal corresponding to the magnetic force. The magnetic torque limiter 40 and the hall sensor 50 are described above; therefore, the detailed descriptions thereof are omitted.

The controller 9 is configured to perform the roller self-diagnosis and to store the result in the storage portion 9-1 or to output the result to the outside. A user or a maintenance service engineer may set the controller 9 to perform the roller self-diagnosis at a predetermined time interval. For example, the user or the maintenance service engineer may set the controller 9 to perform the roller self-diagnosis when the sheet feeding apparatus 1 is turned on, or when the image forming apparatus 200 (see FIG. 15) is turned on in the case where the sheet feeding apparatus 1 is disposed in the image forming apparatus 200.

If the image forming apparatus 200 including the sheet feeding apparatus 1 is always on, the controller 9 may be set to perform the roller self-diagnosis every predetermined time every morning.

The controller 9 of the sheet feeding apparatus 1 according to an example of the present disclosure may perform two types of roller self-diagnoses, that is, a first self-diagnosis and a second self-diagnosis. The roller self-diagnosis performed by the controller 9 will be described in detail below.

The storage portion 9-1 is configured to store the result of the roller self-diagnosis performed by the controller 9. In addition, the storage portion 9-1 may store the roller self-diagnosis program and reference values necessary for the roller self-diagnosis so that the controller 9 can perform the roller self-diagnosis. As the storage portion 9-1, various memories, for example, a random access memory (RAM) may be used.

The transmission portion 9-2 is configured to transmit information on the state of the sheet feeding apparatus 1, for example, a replacement request of the multi-feed prevention roller 30, the sheet feed roller 20, and the pickup roller 13 to an external device under the control of the controller 9.

The transmission portion 9-2 may be connected to the external device wirelessly or by wire. For example, the transmission portion 9-2 may be connected to a personal computer or a mobile device by wire or wirelessly. The mobile device may include a notebook computer, a tablet computer, a smartphone, and the like. In this case, the roller replacement request generated by the controller 9 may be output to the external device through the transmission portion 9-2.

When a program or an application connected to the service center of the image forming apparatus 200 is installed in the personal computer or the mobile device, the roller replacement request information may be provided to the service center via communication or the Internet. Also, when the roller replacement request is not made, the service center may acquire information on the state of each of the multi-feed prevention roller 30, the sheet feed roller 20, and the pickup roller 13 via the personal computer or the mobile device.

In addition, since the service center can detect the rotation state of the multi-feed prevention roller 30, the service center may grasp the operation status of the image forming apparatuses 200 and the plurality of sheet cassettes 11 provided in the respective image forming apparatuses 200 of all the users managed by the service center through communication in real time.

As another example, the transmission portion 9-2 may be configured to be connected to the cloud and web hard via the Internet. In this case, the roller replacement request generated in the controller 9 may be output to the cloud or web hard.

Also, as another example, the transmission portion 9-2 may be configured to receive a signal form the external device and to transmit the received signal to the controller 9 of the sheet feeding apparatus 1. In other words, the transmission portion 9-2 may be configured to exchange signals with the external device. In this case, the transmission portion 9-2 is implemented as a transmitting/receiving portion.

In this case, even when the user or the maintenance service engineer does not directly input the condition of the roller self-diagnosis to the image forming apparatus 200, the service center can input the roller self-diagnosis conditions of the multi-feed prevention roller 30, the sheet feed roller 20, and the pickup roller 13 by a remote operation.

When the sheet feeding apparatus 1 according to an example of the present disclosure is disposed in the image forming apparatus 200, the roller replacement request may be output through a display 91 or a speaker 92 provided in an operation panel 90 of the image forming apparatus 200.

Hereinafter, the case where the controller performs the first self-diagnosis will be described in detail with reference to FIGS. 10 to 12.

FIG. 10 is a view for explaining operation of a sheet feed motor, a pickup roller, a sheet feed roller, and a multi-feed prevention roller when a sheet feeding apparatus according to an example of the present disclosure performs a first self-diagnosis. FIG. 11 is a diagram illustrating a pulse signal output from a hall sensor when a sheet feeding apparatus according to an example of the present disclosure performs a first self-diagnosis. FIG. 12 is a perspective view illustrating a multi-feed prevention roller of a sheet feeding apparatus according to an example of the present disclosure which is unevenly worn.

The first self-diagnosis refers to that the controller 9 determines the lifetime of the multi-feed prevention roller 30 by using a signal output from the hall sensor 50 while the sheet feed motor 100 is rotating the sheet feed roller 20 in the state where the sheet feed roller 20 and the multi-feed prevention roller 30 are in contact with each other without the sheet S between the sheet feed roller 20 and the multi-feed prevention roller 30.

For example, in order to perform the first self-diagnosis, the controller 9 turns on the sheet feed motor 100, and then turns on the sheet feed clutch 81. Then the sheet feed motor 100 rotates and the rotational force of the sheet feed motor 100 is transmitted to the sheet feed roller 20 through the sheet feed clutch 81 so that the sheet feed roller 20 rotates.

At this time, since the pickup roller 13 is connected to the sheet feed roller 20, when the sheet feed roller 20 rotates, the pickup roller 13 also rotates. However, since the pickup clutch 82 is in the off state, the pickup roller 13 is positioned at the raised position by the pickup roller spring 14 and is spaced apart from the sheet S of the sheet cassette 11. Therefore, even when the pickup roller 13 rotates, the sheet S of the sheet cassette 11 is not fed between the sheet feed roller 20 and the multi-feed prevention roller 30.

Also, since the multi-feed prevention roller lowering cam 84 for lowering the multi-feed prevention roller 30 is at a position where the multi-feed prevention roller 30 is not pressed, the multi-feed prevention roller 30 is pressed upward by the elastic member 35 and is brought into contact with the sheet feed roller 20 at a predetermined pressure.

At this time, the rotational force of the sheet feed motor 100 is transmitted to the magnetic torque limiter 40 provided coaxially with the multi-feed prevention roller 30. At this time, the rotational force is transmitted to the magnetic torque limiter 40 in a direction opposite to the rotational direction of the sheet feed roller 20. The housing shaft 47 of the magnetic torque limiter 40 is connected to the drive shaft 49 which receives the rotational force from the sheet feed motor 100 by the coupling 48. Therefore, the housing 43 of the magnetic torque limiter 40 that receives the rotational force from the sheet feed motor 100 through the coupling 48 rotates in the direction opposite to the sheet feed roller 20.

However, since the sheet feed roller 20 and the multi-feed prevention roller 30 made of rubber having a high coefficient of friction are in contact with each other without a sheet, and the magnetic torque limiter 40 is configured to slip at a predetermined load or more, when the sheet feed roller 20 rotates, the multi-feed prevention roller 30 rotates along the sheet feed roller 20. For example, when the sheet feed roller 20 rotates in the clockwise direction in FIG. 10, the multi-feed prevention roller 30 rotates in the counter-clockwise direction by the sheet feed roller 20.

When the multi-feed prevention roller 30 rotates in the counter-clockwise direction, the plurality of permanent magnets 41 of the magnetic torque limiter 40 connected to the rotation shaft 31 of the multi-feed prevention roller 30 rotates at the same speed as the multi-feed prevention roller 30. Then, the hall sensor 50 disposed on one side of the magnetic torque limiter 40 outputs a pulse signal corresponding to the plurality of rotating permanent magnets 41 (see FIG. 11).

The controller 9 may detect the number of rotations of the multi-feed prevention roller 30 by using the pulse signal output from the hall sensor 50.

Accordingly, the controller 9 compares the number of rotations of the sheet feed roller 20 with the number rotations of the multi-feed prevention roller 30. When the difference between the number of rotations of the multi-feed prevention roller 30 and the number of rotations of the sheet feed roller 20 is greater than a predetermined value, that is, a reference number of rotations, the controller 9 may determine that the lifespan of the multi-feed prevention roller 30 is over. At this time, the number of rotations of the sheet feed roller 20 is determined by a power transmission mechanism (not illustrated) between the sheet feed motor 100 and the sheet feed roller 20, so that the controller 9 can rotate the sheet feed roller 20 at a desired number of rotations. The number of rotations of the sheet feed roller 20 may be kept constantly under the control of the controller 9 regardless of the abrasion of the sheet feed roller 20. The power transmission mechanism for transmitting the rotational force of the sheet feed motor 100 to the sheet feed roller 20 may be variously configured including gears, pulleys, and belts.

In general, when the sheet feed roller 20 and the multi-feed prevention roller 30 are new, the multi-feed prevention roller 30 rotates by a few percent less than the number of rotations of the sheet feed roller 20 due to the load of the magnetic torque limiter 40.

However, when the sheet feed roller 20 and the multi-feed prevention roller 30 are uniformly worn by repetition of a large number of sheet feeding operations, the number of rotations of the multi-feed prevention roller 30 may be reduced by several tens of percent (%) or more as compared with the number of rotations of the sheet feed roller 20 due to a reduction in the diameter and change in the friction coefficient of each of the sheet feed roller 20 and the multi-feed prevention roller 30.

When the multi-feed prevention roller 30 is worn, slip occurs between the multi-feed prevention roller 30 and the sheet feed roller 20, so that the pulse signal output from the hall sensor 50 has a wider pulse width T1' as the pulse signal indicated by the worn roller in FIG. 11. In other words, the pulse width T1' of the pulse signal of the worn roller is wider than the pulse width T1 of the pulse signal of the new roller as illustrated in FIG. 11. When the pulse width of the pulse signal is widened, the number of rotations of the roller calculated by using the pulse signal decreases.

Therefore, when the number of rotations of the multi-feed prevention roller 30 is reduced by several tens of percent compared with the number of rotations of the sheet feed roller 20, the controller 9 may determine that the lifespan of the multi-feed prevention roller 30 has expired. For example, when the number of rotations of the multi-feed prevention roller 30 is reduced by 30% or more compared to the number of rotations of the sheet feed roller 20, the controller 9 may determine that the lifetime of the multi-feed prevention roller 30 is over.

For example, when the controller 9 rotates the sheet feed roller 20 at 600 rpm and the number of rotations of the multi-feed prevention roller 30 measured using the hall sensor 50 is 400 rpm, the controller 9 may determine that the lifetime of the multi-feed prevention roller 30 is over because the decrease in the number of rotations of multi-feed prevention roller 30 is 200 rpm and about 33.3%. When it is determined that the lifetime of the multi-feed prevention roller 30 is over, the controller 9 may output an indication to request replacement of the multi-feed prevention roller 30 to the outside. At this time, since the sheet feed roller 20 is worn equally or similarly to the multi-feed prevention roller 30, the controller 9 may request the sheet feed roller 20 to be replaced with the multi-feed prevention roller 30. Further, since the pickup roller 13 is worn equally or similarly to the sheet feed roller 20, the controller 9 may indicate the pickup roller 13 to be replaced with the multi-feed prevention roller 30 as well.

In other words, in the case of the first self-diagnosis, the controller 9 drives the sheet feed motor 100 and controls the sheet feed clutch 81 and the pickup clutch 82 so that the sheet feed roller 20 is rotated by the rotational force of the sheet feed motor 100 and the pickup roller 13 is blocked from picking up and feeding the sheet S to the sheet feed roller 20. Then, the controller 9 may calculate the number of rotations of the multi-feed prevention roller 30 using the signal output from the hall sensor 50 and compare the number of rotations of the multi-feed prevention roller 30 and the number of rotations of the sheet feed roller 20, thereby determining the lifespan of the multi-feed prevention roller 30.

In addition, when the multi-feed prevention roller 30 is unevenly worn, the controller 9 may detect a section where the rotation fluctuation becomes larger during one rotation of the multi-feed prevention roller 30. Here, that the multi-feed prevention roller 30 is unevenly worn refers to the case in that the outer circumferential surface of the multi-feed prevention roller 30 is not uniformly worn, but a portion 30*a* of the multi-feed prevention roller 30 is worn more than the other portion thereof as illustrated in FIG. 12. In FIG. 12, reference numeral 30*a* denotes an unevenly worn portion of the multi-feed prevention roller 30.

When the multi-feed prevention roller 30 is unevenly worn, the pulse interval T of the unevenly worn portion becomes very large as illustrated in FIG. 11. Accordingly, when the interval T between the adjacent two pulses among the plurality of pulses corresponding to one rotation of the multi-feed prevention roller 30 output from the hall sensor 50 is greater than the reference pulse interval T', the controller 9 may determine that uneven wear occurs on the multi-feed prevention roller 30.

When the uneven wear generated on the multi-feed prevention roller 30 is equal to or larger than the reference value, the controller 9 may determine that the lifespan of the multi-feed prevention roller 30 is over and may output a replacement request for the multi-feed prevention roller 30 to the outside.

Hereinafter, the case where the controller performs the second self-diagnosis will be described in detail with reference to FIGS. 13 and 14.

FIG. 13 is a view for explaining operation of a sheet feeding motor, a pickup roller, a sheet feed roller, and a multi-feed prevention roller when a sheet feeding apparatus according to an example of the present disclosure performs a second self-diagnosis. FIG. 14 is a view illustrating a coupling connecting a magnetic torque limiter and a drive shaft of a sheet feeding apparatus according to an example of the present disclosure.

The second self-diagnosis refers to that the controller 9 identifies a connection state of the magnetic torque limiter 40 by using the signal output from the hall sensor 50 while the sheet feed motor 100 is rotating in the state where the sheet feed roller 20 and the multi-feed prevention roller 30 are in contact with each other without a sheet S between the sheet feed roller 20 and the multi-feed prevention roller 30 and the rotational force of the sheet feed motor 100 is blocked not to be transmitted to the sheet feed roller 20 and the pickup roller 13.

For example, in order to perform the second self-diagnosis, the controller 9 turns off the sheet feed clutch 81 and turns on the sheet feed motor 100. Then, although the sheet feed motor 100 rotates, the rotational force of the sheet feed motor 100 is blocked by the sheet feed clutch 81 and is not transmitted to the sheet feed roller 20. Therefore, the sheet feed roller 20 can freely rotate.

At this time, since the pickup roller 13 is connected to the sheet feed roller 20, when the sheet feed roller 20 does not rotate, the pickup roller 13 also does not rotate. Further, since the sheet feed clutch 81 is in the off state, the pickup roller 13 is kept in a raised position by the pickup roller spring 14 and is spaced apart from the sheet S of the sheet cassette 11. Accordingly, even when the sheet feed motor 100 rotates, the sheet S of the sheet cassette 11 in not fed between the sheet feed roller 20 and the multi-feed prevention roller 30.

In addition, since the multi-feed prevention roller lowering cam 84 for lowering the multi-feed prevention roller 30 is at a position where the multi-feed prevention roller 30 is not pressed, the multi-feed prevention roller 30 is pressed upward by the elastic member 35 and is brought into contact with the sheet feed roller 20 at a predetermined pressure.

At this time, the rotational force of the sheet feed motor 100 is transmitted to the magnetic torque limiter 40 provided coaxially with the multi-feed prevention roller 30. In detail, the housing shaft 47 of the magnetic torque limiter 40 is connected to the drive shaft 49 that receives the rotational force from the sheet feed motor 100 by the coupling 48 so that the housing 43 of the magnetic torque limiter 40 rotates. When the housing 43 of the magnetic torque limiter 40 rotates, the plurality of permanent magnets 41 provided inside the housing 43 also rotate. When the plurality of permanent magnets 41 rotate, the rotation shaft 31 provided with the plurality of permanent magnets 41 rotates, and therefore, the multi-feed prevention roller 30 also rotates. In the example illustrated in FIG. 13, when the sheet feed motor 100 rotates, the multi-feed prevention roller 30 rotates in the clockwise direction.

The sheet feed roller 20 and the multi-feed prevention roller 30 are in contact with each other and the sheet feed roller 20 is freely rotatable, so that when the multi-feed prevention roller 30 rotates, the sheet feed roller 20 is rotated along with the multi-feed prevention roller 30. For example, in FIG. 13, when the multi-feed prevention roller 30 rotates in the clockwise direction, the sheet feed roller 20 is rotated in the counter-clockwise direction by the multi-feed prevention roller 30.

The magnetic torque limiter 40 is connected to the drive shaft 49 that receives the rotational force of the sheet feed motor 100 by the coupling 48. The coupling 48 is a joint that connects a shaft and another shaft, such as a universal joint. For example, as illustrated in FIG. 14, the housing shaft 47 of the magnetic torque limiter 40 is connected to the drive shaft 49 that is rotated by the rotational force from the sheet feed motor 100 by the coupling 48. Accordingly, when the drive shaft 49 is rotated by the sheet feed motor 100, the housing shaft 47 of the magnetic torque limiter 40 coupled to the drive shaft 49 by the coupling 48 rotates.

In the case where the housing shaft 47 of the magnetic torque limiter 40 and the drive shaft 49 are arranged in a straight line by coupling 48, when the magnetic torque limiter 40 rotates, the pulse signal output from the hall sensor 50 is uniform.

However, when there is a large unacceptable positional error between the housing shaft 47 and the drive shaft 49, a regular variation may occur in the pulse signal output from the hall sensor 50. For example, when there is a positional error in the joint between the housing shaft 47 and the drive shaft 49, an abnormal pulse that the interval between two adjacent pulses among the plurality of pulses corresponding to one rotation of the magnetic torque limiter 40 is narrower or wider than the interval between the other pulses (a reference pulse interval) may occur. In this case, when the magnetic torque limiter 40 rotates, such an abnormal pulse is regularly generated every one rotation.

Such a regular rotation fluctuation due to the defective joint may cause vibration so that the upward contact pressure of the multi-feed prevention roller 30 fluctuates. When the upward contact pressure of the multi-feed prevention roller 30 fluctuates, the multi-feed of the sheets S is likely to occur.

Accordingly, when the controller 9 detects a regular rotation fluctuation from the pulse signal output from the hall sensor 50, the controller 9 may identify that a joint failure occurs and may output the occurrence of joint failure to the outside.

The second self-diagnosis may be used as a shipment inspection of the sheet feeding apparatus 1 at the factory. As a result of performing the second self-diagnosis, when a joint failure occurs, an operator may not shipment the sheet feeding apparatus 1, and may adjust the joint state between the housing shaft 47 of the magnetic torque limiter 40 and the drive shaft 49.

According to the sheet feeding apparatus 1 according to an example of the present disclosure as described above, the self-diagnosis is carried out by itself without feeding the actual sheet S to the multi-feed prevention roller 30, the sheet feed roller 20, and the pickup roller 13 which are required to be replaced due to the sheet feeding, and then the replacement of the multi-feed prevention roller 30, the sheet feed roller 20, and the pickup roller 13 may be requested before a sheet feeding failure occurs. Therefore, the miss-feed, jam, multi-feed, and the like of sheets may be prevented.

Hereinafter, an image forming apparatus provided with a sheet feeding apparatus according to an example of the present disclosure will be described with reference to FIG. 15.

FIG. 15 is a cross-sectional view schematically illustrating an image forming apparatus according to an example of the present disclosure including two sheet feeding apparatuses.

Referring to FIG. 15, an image forming apparatus 200 according to an example of the present disclosure may include a main body 210, two sheet feeding apparatuses 1, an image former 220, and a sheet discharger 230.

The main body 210 forms the appearance of the image forming apparatus 200, and accommodates and supports the two sheet feeding apparatuses 1, the image former 220, and the sheet discharger 230 therein.

The sheet feeding apparatus 1 accommodates a predetermined number of sheets S and is formed to pick up the sheets S one by one and supply the picked sheet to the image former 220. In the present example, two sheet feeding apparatuses 1 are stacked in the vertical direction. The structure and operation of the two sheet feeding apparatuses 1 are described above; therefore, detailed description thereof is omitted.

The image former 220 forms a predetermined image on the sheet S supplied from the sheet feeding apparatus 1. The image former 220 may include an exposure member 225 for forming an electrostatic latent image corresponding to the print data on an image carrier 222, a developing cartridge 221 for developing the electrostatic latent image formed on the image carrier 222 into a developer image, a transfer member 223 for transferring the developer image formed on the image carrier 222 to the sheet, and a fixing portion 224 for fixing the developer image onto the sheet. The image former 220 may be the same as or similar to the image former of the conventional image forming apparatus, and a detailed description thereof is omitted.

FIG. 15 shows the image forming apparatus 200 that forms a monochrome image using one image carrier 222. However, the sheet feeding apparatus 1 according to an example of the present disclosure may be used in a color image forming apparatus that prints a color image using a plurality of image carriers.

Further, the sheet feeding apparatus 1 according to an example of the present disclosure may be applied to an inkjet printer. Therefore, although not illustrated, the image former may be formed by an ink ejection head which ejects predetermined ink according to print data.

The sheet discharger 230 discharges the sheet having a predetermined image formed thereon through the image former 220 to the outside of the main body 210 of the image forming apparatus 200. The sheet discharger 230 may be configured as a pair of discharge rollers.

The main controller 209 is configured to control the image forming apparatus 200 and to form an image on the sheet S. The main controller 209 may include the above-described controller 9 that performs the roller self-diagnosis for each of the two sheet feeding apparatuses 1. The main controller 209 may perform the roller self-diagnosis for the sheet feeding apparatus 1 in the same manner as the controller 9 as described above, and thus a detailed description thereof is omitted.

The main controller 209 performs the roller self-diagnosis for each of the two sheet feeding apparatuses 1. When it is necessary to replace the multi-feed prevention roller 30, the sheet feed roller 20, and the pickup roller 13, the main controller 209 may inform the outside of it. For example, the main controller 209 may inform that it is necessary to replace the multi-feed prevention roller 30, the sheet feed roller 20, and the pickup roller 13 of any one of the two sheet feeding apparatuses 1 using the display 91 and the speaker 92 of the operation panel 90 (see FIG. 9) of the image forming apparatus 200.

In FIG. 15, the image forming apparatus 200 having two sheet feeding apparatuses 1 is described as an example. However, the sheet feeding apparatus 1 according to an example of the present disclosure may be applied to an image forming apparatus having three or more sheet feeding apparatuses. Also, the sheet feeding apparatus 1 according to an example of the present disclosure may be applied to an automatic document scanning apparatus and a sheet feeding apparatus of a large capacity provided separately from the image forming apparatus in which miss-feed, jamming, multi-feed, and the like of sheets are troublesome.

According to the sheet feeding apparatus of an example of the present disclosure as described above, in the image forming apparatus having a plurality of sheet feeding apparatuses, it is possible to identify the wear state of the multi-feed prevention roller or the joint failure with respect to each of the sheet feeding apparatuses. Therefore, the multi-feed prevention roller 30, the sheet feed roller 20, and the pickup roller 13 of the sheet feeding apparatus that need to be replaced may be replaced at an appropriate time. In other words, instead of replacing the rollers of all of the plurality of sheet feeding apparatuses, the multi-feed prevention roller, the sheet feed roller, and the pickup roller of only the sheet feeding apparatus frequently used by the user may be replaced, thereby enabling efficient maintenance.

In the above description, the sheet feeding apparatus according to an example of the present disclosure performs the roller self-diagnosis and requests replacement of the multi-feed prevention roller, the sheet feed roller, and the pickup roller. However, the sheet feeding apparatus according to an example of the present disclosure may be configured to detect the multi-feed of the sheets.

Hereinafter, a sheet feeding apparatus according to an example of the present disclosure configured to detect the multi-feed of sheets will be described.

FIG. 16 is a view schematically illustrating an example of a sheet feeding apparatus according to an example of the present disclosure.

Referring to FIGS. 16 and 2, the sheet feeding apparatus 1 according to an example of the present disclosure may include a sheet stacker 10, a sheet feed roller 20, and a multi-feed prevention roller 30.

The sheet stacker 10 stacks at least one sheet S, picks up the stacked sheets S one by one, and feeds the picked sheet S toward the sheet feed roller 20. The sheet stacker 10 may include a sheet cassette 11 and a pickup roller 13 provided above the sheet cassette 11. The sheet cassette 11 is configured to accommodate a predetermined number of sheets S. The pickup roller 13 is formed to move the sheet S positioned at the top of the sheets S stacked on the sheet cassette 11 toward the sheet feed roller 20.

The sheet feed roller 20 is disposed on one side of the sheet stacker 10 and moves the sheet S fed from the sheet stacker 10 toward the conveying roller 201. In detail, the sheet feed roller 20 is formed to move the sheet S picked up by the pickup roller 13 in the sheet stacker 10 toward the conveying roller 201. The conveying roller 201 moves the sheet S fed by the sheet feed roller 20 to the image former 220. FIG. 16 illustrates a case where the sheet feeding apparatus 1 according to an example of the present disclosure is disposed in the image forming apparatus.

The sheet feed roller 20 is disposed to be rotatable by the driving source 100. As an example, the driving source 100 may use a drive motor. The structure in which the drive motor 100 rotates the sheet feed roller 20 is general; therefore, the illustration and description thereof are omitted.

The multi-feed prevention roller 30 is provided to face the sheet feed roller 20 and to prevent the multi-feed of the sheets S fed from the sheet stacker 10. In detail, the multi-feed prevention roller 30 is provided to be in contact with the sheet feed roller 20 at a predetermined pressure. When one sheet S is fed from the sheet stacker 10, the multi-feed prevention roller 30 is rotated by the sheet feed roller 20 to move the sheet S to the conveying roller 201. The multi-feed prevention roller 30 may be elastically supported by the multi-feed prevention roller holder 33 so that the multi-feed prevention roller 30 is in contact with the sheet feed roller 20 at a predetermined pressure. The multi-feed prevention roller holder 33 is elastically supported by an elastic member 35 provided on the frame 3.

When two or more sheets S enter between the multi-feed prevention roller 30 and the sheet feed roller 20, the multi-feed prevention roller 30 prevents the two or more sheets S from passing between the multi-feed prevention roller 30 and the sheet feed roller 20. Hereinafter, the prevention of the two or more sheets S from passing between the sheet feed roller 20 and the multi-feed prevention roller 30 is referred to as multi-feed prevention.

For the multi-feed prevention, a magnetic torque limiter 40 is provided in the multi-feed prevention roller 30. In detail, the magnetic torque limiter 40 is provided on the rotation shaft 31 of the multi-feed prevention roller 30 and has a predetermined threshold torque value. Therefore, when the sheet conveyance frictional force generated between the multi-feed prevention roller 30 and the sheet feed roller 20 is larger than the threshold torque value, the multi-feed prevention roller 30 rotates in a direction of interlocking with the rotation of the sheet feed roller 20, that is, in the sheet conveying direction. However, when the sheet conveyance frictional force generated between the multi-feed prevention roller 30 and the sheet feed roller 20 is smaller than the threshold torque value, the multi-feed prevention roller 30 does not rotate along with the sheet feed roller 20, but rotates in the opposite direction or remains stationary.

Accordingly, when one sheet S enters between the multi-feed prevention roller 30 and the sheet feed roller 20, the sheet conveyance frictional force between the multi-feed prevention roller 30 and the sheet S becomes larger than the threshold torque value of the magnetic torque limiter 40. Therefore, the multi-feed prevention roller 30 rotates in the sheet conveying direction, so that the sheet S is normally conveyed. However, when two or more sheets S enter between the multi-feed prevention roller 30 and the sheet feed roller 20, the conveyance of the sheet S is blocked by the multi-feed prevention roller 30.

The structure of the magnetic torque limiter 40 provided at one side of the multi-feed prevention roller 30 is described above; therefore, detailed description thereof is omitted.

The magnetic torque limiter 40 and the hall sensor 50, which is disposed at one side of the magnetic torque limiter 40 and detects the magnetic force radiated from the magnetic torque limiter 40, may constitute a multi-feed detector capable of detecting whether or not the multi-feed of the sheets S occurs in the multi-feed prevention roller 30.

The sheet feeding apparatus 1 according to an example of the present disclosure may include a controller 9 (see FIG. 24). The controller 9 may identify whether the multi-feed occurs in the multi-feed prevention roller 30 of the sheet feeding apparatus 1 by using signals input from the hall sensors 51 and 52. When the multi-feed of the sheets S occurs, the controller 9 may be configured to stop the driving source 100 that rotates the pickup roller 13 of the sheet stacker 10 and the sheet feed roller 20 and to inform the outside of the occurrence of the multi-feed. When the sheet feeding apparatus 1 is disposed in the image forming apparatus, the controller 9 may be formed as a part of a main controller to control the operation of the image forming apparatus.

Hereinafter, the operation of the sheet feeding apparatus according to an example of the present disclosure will be described with reference to FIGS. 17A to 19B.

First, a case in which the sheet feeding apparatus normally feeds one sheet will be described with reference to FIGS. 17A and 17B.

FIG. 17A is a view illustrating a case where a sheet feeding apparatus according to an example of the present disclosure normally feeds a sheet, and FIG. 17B is a view illustrating signals output from a first hall sensor and a second hall sensor in the case of FIG. 17A.

Referring to FIG. 17A, one sheet S is picked up by the pickup roller 13 and enters between the sheet feed roller 20 and the multi-feed prevention roller 30. In this case, since the sheet conveyance frictional force generated between the multi-feed prevention roller 30 and the sheet S is larger than the threshold torque value of the magnetic torque limiter 40, the multi-feed prevention roller 30 is rotated by the sheet feed roller 20. For example, as illustrated in FIG. 17A, when the sheet feed roller 20 rotates in the clockwise direction, the multi-feed prevention roller 30 rotates in the counter-clockwise direction due to the frictional force against the sheet S and causes the sheet S to be conveyed in the sheet conv (a direction of arrow A).

At this time, the two hall sensors 51 and 52 provided on one side of the magnetic torque limiter 40 output pulse signals in the order of A-phase and B-phase as illustrated in FIG. 17B. For example, the first hall sensor 51 outputs the A-phase pulse signal, and then the second hall sensor 52 outputs the B-phase pulse signal delayed by t time with respect to the A-phase pulse signal. When the A-phase pulse signal and the B-phase pulse signal are output from the first and second hall sensors 51 and 52 as illustrated in FIG. 17B, the controller 9 determines that the sheet S is normally fed.

Next, a case where the sheet stacker 10 feeds two sheets S will be described with reference to FIGS. 18A and 18B.

FIG. 18A is a view illustrating a case where two sheets are fed to a multi-feed prevention roller of a sheet feeding apparatus according to an example of the present disclosure, and FIG. 18B is a view illustrating signals output from a first hall sensor and a second hall sensor in the case of FIG. 18A.

Referring to FIG. 18A, two sheets S are picked up by the pickup roller 13 and enter between the sheet feed roller 20 and the multi-feed prevention roller 30. In this case, since the sheet conveyance frictional force generated between the multi-feed prevention roller 30 and the sheet S is smaller than the threshold torque value of the magnetic torque limiter 40, the multi-feed prevention roller 30 is not rotated by the sheet feed roller 20, but is rotated by the driving source 100 connected to the multi-feed prevention roller 30. For example, as illustrated in FIG. 18A, when the sheet feed roller 20 rotates in the clockwise direction, the multi-feed prevention roller 30 is rotated in the clockwise direction by the driving source 100, so that the lower sheet is conveyed to the sheet cassette 11. Therefore, when the multi-feed of the sheets S occurs, the multi-feed prevention roller 30 rotates in the opposite direction with respect to the direction in which the sheet S is normally conveyed.

At this time, the order of the pulse signals output from the two hall sensors 51 and 52 provided on one side of the magnetic torque limiter 40 changes. For example, as illustrated in FIG. 18B, the pulse signals, which output in the order of A-phase and B phase from the first and second hall sensors 51 and 52 during forward rotation, changes in the order of B-phase and A-phase when the multi-feed prevention roller 30 is rotated in the opposite direction due to the occurrence of the multi-feed. In detail, when the multi-feed occurs, the second hall sensor 52 outputs the B-phase pulse signal, and then the first hall sensor 51 outputs the A-phase pulse signal delayed by the t time with respect to the B-phase pulse signal. When a predetermined period time (T1 msec) elapses after the order of the A-phase pulse signal and the B-phase pulse signal is changed, the controller 9 may stop the sheet feed roller 20 and the multi-feed prevention roller 30 and inform the outside of the occurrence of the multi-feed.

Finally, a case where the sheet stacker 10 feeds three or more sheets S will be described with reference to FIGS. 19A and 19B.

FIG. 19A is a view illustrating a case where three or more sheets are fed to a multi-feed prevention roller of a sheet feeding apparatus according to an example of the present disclosure, and FIG. 19B is a view illustrating signals output from a first hall sensor and a second hall sensor in the case of FIG. 19A.

Referring to FIG. 19A, a large number of sheets S, for example, three or more sheets S are picked up by the pickup roller 13 and enter between the sheet feed roller 20 and the multi-feed prevention roller 30. In this case, since the frictional force applied to the multi-feed prevention roller 30 by the large number of sheets S inserted between the sheet feed roller 20 and the multi-feed prevention roller 30 is larger than the threshold torque value of the magnetic torque limiter 40, the multi-feed prevention roller 30 rotates in conjunction with the sheet feed roller 20. For example, as illustrated in FIG. 19A, when the sheet feed roller 20 rotates in the clockwise direction, the multi-feed prevention roller 30 is rotated in the sheet conveying direction (the direction of arrow A), that is, in the counter-clockwise direction by the frictional force against the large number of sheets S. At this time, since the large number of sheets S are inserted between the sheet feed roller 20 and the multi-feed prevention roller 30, a lower side displacement amount (arrow B), which is the distance that the multi-feed prevention roller 30 moves downward, increases. The lower side displacement of the multi-feed prevention roller 30 may be detected by the two hall sensors 51 and 52.

At this time, the two hall sensors 51 and 52 provided on one side of the magnetic torque limiter 40 output pulse signals in the order of A-phase and B-phase as illustrated in FIG. 19B. However, the pulse interval of each of the A-phase pulse signal and the B-phase pulse signal becomes shorter than in the case of normal rotation. For example, when the multi-feed prevention roller 30 rotates in the forward direction, the first hall sensor 51 outputs the A-phase pulse signal, and the second hall sensor 52 outputs the B-phase pulse signal delayed by t times with respect to the A-phase pulse signal. At this time, the pulse interval of each of the A-phase pulse signal and the B-phase pulse signal is T1. When the large number of sheets S are inserted between the multi-feed prevention roller 30 and the sheet feed roller 20, as illustrated in FIG. 19B, the order of the A-phase pulse signal and the B-phase pulse signal output from the first and second hall sensors 51 and 52 is the same, but the pulse interval of each of the A-phase pulse signal and the B-phase pulse signal is shortened to T2 (msec). When a predetermined period time (T3 msec) elapses after detecting that the pulse interval of each of the A-phase pulse signal and the B-phase pulse signal is shorten, the controller 9 may stop the sheet feed roller 20 and the multi-feed prevention roller 30 and inform the outside of the occurrence of the multi-feed of the large number of sheets.

Hereinafter, a sheet feeding apparatus configured to return the sheet S to the sheet stacker 10 and to retry the sheet feeding operation when the controller 9 recognizes the occurrence of multi-feed in the multi-feed prevention roller 30 will be described with reference to FIGS. 20 to 24.

FIG. 20 is a plan view schematically illustrating a sheet feeding apparatus according to an example of the present disclosure having a sheet return function. FIG. 21 is a side view illustrating a case where the sheet feeding apparatus of FIG. 20 does not operate. FIG. 22 is a side view illustrating a case where the sheet feeding apparatus of FIG. 20 normally feeds a sheet, and FIG. 23 is a side view illustrating a case where the sheet feeding apparatus of FIG. 20 returns the sheet to a retrying position. FIG. 24 is a functional block diagram of the sheet feeding apparatus of FIG. 20.

Referring to FIGS. 20 and 21, the sheet feeding apparatus 1 according to an example of the present disclosure may include a sheet cassette 11 and a pickup roller 13. The pickup roller 13 is provided over the sheet cassette 11, picks up one sheet stacked on the sheet cassette 11 and feeds the picked sheet to a sheet feed roller 20. The pickup roller 13 is provided on a pickup roller shaft 13*a* which is rotatably disposed in a sheet feed roller holder 21. A pickup roller gear 13*b* is coaxially disposed on the pickup roller shaft 13*a* at one side of the pickup roller 13. Accordingly, when the pickup roller gear 13*b* rotates, the pickup roller 13 rotates.

On one side of the pickup roller 13, that is, downstream of the sheet conveying direction, the sheet feed roller 20 is provided. The sheet feed roller 20 is provided on a sheet feed roller shaft 20*a* which is rotatably disposed on the sheet feed roller holder 21. A sheet feed roller gear 20*b* is coaxially disposed on the sheet feed roller shaft 20*a* at one side of the sheet feed roller 20. At this time, the pickup roller shaft 13*a* and the sheet feed roller shaft 20*a* are provided parallel to each other, and the pickup roller gear 13*b* and the sheet feed roller gear 20*b* are spaced apart from each other. At one side of the sheet feed roller holder 21, there is provided an idle gear 15 which is engaged with the pickup roller gear 13*b* and the sheet feed roller gear 20*b*. The idle gear 15 is rotatably disposed on an idle gear shaft 15*a* provided in the sheet feed roller holder 21. Therefore, when the sheet feed roller gear 20*b* rotates, the pickup roller gear 13*b* rotates through the idle gear 15. Accordingly, when the sheet feed roller 20 rotates, the pickup roller 13 rotates together.

A sheet feed pulley 23 is provided at one end of the sheet feed roller shaft 20*a*, that is, at an end opposite to the side where the sheet feed roller 20 is disposed. A drive clutch 27 may be provided between the sheet feed pulley 23 and the sheet feed roller shaft 20*a*. The drive clutch 27 selectively blocks the rotation of the sheet feed pulley 23 from being transmitted to the sheet feed roller shaft 20*a*. For example, when the drive clutch 27 is turned on, the rotation of the sheet feed pulley 23 is transmitted to the sheet feed roller shaft 20*a*. When the drive clutch 27 is turned off, the rotation of the sheet feed pulley 23 is prevented from being transmitted to the sheet feed roller shaft 20*a*. Therefore, when the drive clutch 27 is turned off, the sheet feed roller 20 does not rotate even when the sheet feed pulley 23 rotates. The on/off of the drive clutch 27 may be controlled by the controller 9.

The sheet feed pulley 23 receives rotational force from a first drive motor 101 through a sheet feed belt 24. For example, a feed drive pulley 25 is provided on a motor shaft 101*a* of the first drive motor 101, and the feed drive pulley 25 is connected with the sheet feed pulley 23 by the sheet feed belt 24. Thus, when the motor shaft 101*a* of the first drive motor 101 rotates, the feed drive pulley 25 rotates. The rotation of the feed drive pulley 25 is transmitted to the sheet feed pulley 23 through the sheet feed belt 24, so that the sheet feed pulley 23 rotates.

A pickup roller spring 120 to apply a force to pull the sheet feed roller holder 21 in the upward direction is provided at one side of the sheet feed roller holder 21. One end of the pickup roller spring 120 is fixed to a frame (not illustrated) where the sheet feeding apparatus is disposed, and the other end of the pickup roller spring 120 is fixed to one side surface of the sheet feed roller holder 21. At this time, the other end of the pickup roller spring 120 is fixed to the opposite side of the pickup roller 13 about the sheet feed roller shaft 20*a*. Thus, the pickup roller spring 120 causes the pickup roller 13 to move downward.

The multi-feed prevention roller 30 is rotatably disposed below the sheet feed roller 20. The magnetic torque limiter 40 is provided on the rotation shaft 31 of the multi-feed prevention roller 30. A multi-feed prevention pulley 48 is provided on the housing shaft 47 of the magnetic torque limiter 40. Accordingly, when the multi-feed prevention pulley 48 rotates, the magnetic torque limiter 40 rotates and the multi-feed prevention roller 30 rotates.

The multi-feed prevention roller 30 is rotatably disposed in a multi-feed prevention roller holder 33. The multi-feed prevention roller holder 33 is provided to receive an elastic force in the upward direction by the elastic member 35. Therefore, the multi-feed prevention roller 30 is kept in contact with the sheet feed roller 20 at a predetermined pressure by the elastic member 35.

A first intermediate pulley 131 is rotatably disposed on one side of the multi-feed prevention roller holder 33. In detail, the first intermediate pulley 131 is disposed coaxially with an intermediate shaft 130, which is rotatably disposed on one side of the multi-feed prevention roller holder 33. The first intermediate pulley 131 is connected with the multi-feed prevention pulley 48 through a multi-feed prevention belt 135. Therefore, when the first intermediate pulley 131 rotates, the multi-feed prevention pulley 48 is rotated by the multi-feed prevention belt 135. When the multi-feed prevention pulley 48 rotates, the multi-feed prevention roller 30 rotates through the magnetic torque limiter 40.

A second intermediate pulley 132 is coaxially disposed at the other end of the intermediate shaft 130. Therefore, when the second intermediate pulley 132 rotates, the intermediate shaft 130 rotates, and thereby the first intermediate pulley 131 rotates. The second intermediate pulley 132 is provided to be rotatable by the rotational force transmitted from the first drive motor 101 through an intermediate belt 136. For example, a multi-feed prevention drive pulley 133 may be provided on the motor shaft 101*a* of the first drive motor 101. The multi-feed prevention drive pulley 133 is connected with the second intermediate pulley 132 through the intermediate belt 136. Therefore, when the multi-feed prevention drive pulley 133 rotates, the second intermediate pulley 132 is rotated by the intermediate belt 136. The multi-feed prevention drive pulley 133 is disposed on the motor shaft 101*a* of the first drive motor 101 coaxially with the feed drive pulley 25. Therefore, when the motor shaft 101*a* of the first drive motor 101 rotates, the feed drive pulley 25 and the multi-feed prevention drive pulley 133 rotates integrally. Accordingly, the first drive motor 101 can rotate the sheet feed roller 20 and the multi-feed prevention roller 30.

A multi-feed prevention roller release cam 140 may be provided on one side of the multi-feed prevention roller holder 33. One end of the multi-feed prevention roller release cam 140 is fixed to a release cam shaft 141, and the other end is provided to be in contact with a protrusion 33*a* of the multi-feed prevention roller holder 33. Therefore, when the multi-feed prevention roller release cam 140 rotates in the counter-clockwise direction, the protrusion 33*a* of the multi-feed prevention roller holder 33 is pivoted upward. When the protrusion 33*a* is pivoted upward, the multi-feed prevention roller holder 33 is rotated in the clockwise direction about the intermediate shaft 130 so that the multi-feed prevention roller 30 is moved away from the sheet feed roller 20. When the multi-feed prevention roller release cam 140 rotates in the opposite direction, the force applied to the protrusion 33*a* of the multi-feed prevention roller holder 33 is removed, so that the multi-feed prevention roller holder 33 is pivoted upward by the elastic member 35 and the multi-feed prevention roller 30 is brought close to the sheet feed roller 20.

A release cam pulley 142 is provided at one end of the release cam shaft 141, that is, at the end opposite to where the multi-feed prevention roller release cam 140 is disposed. When the release cam pulley 142 rotates, the release cam shaft 141 rotates, whereby the multi-feed prevention roller release cam 140 rotates.

The release cam pulley 142 is configured to receive the rotational force from a second drive motor 102. In other words, a release cam drive pulley 144 is coaxially disposed on a motor shaft 102*a* of the second drive motor 102, and the release cam drive pulley 144 is connected with the release cam pulley 142 through a release cam belt 143. Therefore, when the motor shaft 102*a* of the second drive motor 102 rotates, the release cam drive pulley 144 rotates, whereby the release cam belt 143 rotates. Then, the release cam pulley 142 is rotated by the release cam belt 143.

In addition, a pickup roller lifting cam 150 may be provided on one side the sheet feed roller holder 21. One end of the pickup roller lifting cam 150 is fixed to a lifting cam shaft 151, and the other end is provided to be in contact with a protruding portion 21*a* of the sheet feed roller holder 21. Therefore, when the pickup roller lifting cam 150 rotates in the clockwise direction, the protruding portion 21*a* of the sheet feed roller holder 21 may be pivoted downward. When the protruding portion 21*a* of the sheet feed roller holder 21 is pivoted downward, the sheet feed roller holder 21 is rotated in the counter-clockwise direction about the sheet feed roller shaft 20*a* so that the pickup roller 13 is moved away from the sheet stacked on the sheet cassette 11. When the pickup roller lifting cam 150 rotates in the opposite direction, the force applied to the protruding portion 21*a* of the sheet feed roller holder 21 is removed so that the sheet feed roller holder 21 receives a force in the upward direction by the sheet feed roller spring 120. Therefore, the sheet feed roller holder 21 rotates in the clockwise direction, and the pickup roller 13 comes into contact with the sheet.

A lifting cam pulley 152 is disposed on one side of the pickup roller lifting cam 150 coaxially with the lifting cam shaft 151. When the lifting cam pulley 152 rotates, the lifting cam shaft 151 rotates, whereby the pickup roller lifting cam 150 rotates.

The lifting cam pulley 152 is configured to receive the rotational force from the second drive motor 102. In other words, a lifting cam drive pulley 154 is coaxially disposed on the motor shaft 102*a* of the second drive motor 102, and the lifting cam drive pulley 154 is connected with the lifting cam pulley 152 through the lifting cam belt 153. Therefore, when the motor shaft 102*a* of the second drive motor 102 rotates, the lifting cam drive pulley 154 rotates, and thereby the lifting cam belt 153 rotates. Then, the lifting cam pulley 152 is rotated by the lifting cam belt 153. The lifting cam drive pulley 154 is disposed on the motor shaft 102*a* of the second drive motor 102 coaxially with the release cam drive pulley 144 as described above. Therefore, when the motor shaft 102*a* of the second drive motor 102 rotates, the lifting cam drive pulley 154 and the release cam drive pulley 144 rotate integrally. Thus, the second drive motor 102 can rotate the multi-feed prevention roller release cam 140 and the pickup roller lifting cam 150 at the same time.

Hereinafter, the operation of the sheet feeding apparatus having the sheet return function will be described with reference to FIGS. 20 to 24 attached hereto.

The positions of the pickup roller 13, the sheet feed roller 20, and the multi-feed prevention roller 30 when the sheet feeding apparatus 1 does not operate are illustrated in FIG. 21.

In detail, since the pickup roller lifting cam 150 is spaced apart from the protruding portion 21*a* of the sheet feed roller holder 21, the sheet feed roller holder 21 is rotated in the clockwise direction around the sheet feed roller shaft 20*a* by the sheet feed roller spring 120 so that the pickup roller 13 comes into contact with the sheet S.

Further, since the multi-feed prevention roller release cam 140 pushes the protrusion 33*a* of the multi-feed prevention roller holder 33 upwardly, the multi-feed prevention roller holder 33 rotates in the clockwise direction around the intermediate shaft 130. Therefore, the multi-feed prevention roller 30 is spaced apart from the sheet feed roller 20. When the multi-feed prevention roller 30 and the sheet feed roller 20 are separated from each other before the sheet feeding apparatus 1 stops operating, deformation that occurs when the multi-feed prevention roller 30 and the sheet feed roller 20 are in contact with each other for a long time may be prevented.

In this state, when the controller 9 receives a sheet feed command, the controller 9 controls the first drive motor 101 and the second drive motor 102 to change the sheet feeding apparatus 1 to the state as illustrated in FIG. 22, thereby conveying the sheet S.

In detail, the controller 9 rotates the second drive motor 102 in one direction, and thereby the multi-feed prevention roller release cam 140 is positioned in a horizontal state. For example, in FIG. 21, the motor shaft 102*a* of the second drive motor 102 is rotated in the clockwise direction so that the multi-feed prevention roller release cam 140 is positioned in a horizontal state. Thus, since the force of pushing the protrusion 33*a* of the multi-feed prevention roller holder 33 upward is removed, the elastic member 35 provided below the multi-feed prevention roller holder 33 presses the multi-feed prevention roller holder 33 upward so that the multi-feed prevention roller 30 comes into contact with the sheet feed roller 20.

When the motor shaft 102*a* of the second drive motor 102 rotates in the clockwise direction, the pickup roller lifting cam 150 rotates in the clockwise direction. Accordingly, when the multi-feed prevention roller release cam 140 is positioned in the horizontal state, the pickup roller lifting cam 150 is also positioned in the horizontal state. At this time, since the pickup roller lifting cam 150 does not apply a force to the protruding portion 21*a* of the sheet feed roller holder 21, the pickup roller 13 keeps in contact with the sheet S.

In this state, the controller 9 rotates the motor shaft 101*a* of the first drive motor 101 in one direction so that the pickup roller 13 and the sheet feed roller 20 feed the sheet S. For example, the controller 9 controls the first drive motor 101 to rotate the motor shaft 101*a* in the clockwise direction. Then, the feed drive pulley 25 provided on the motor shaft 101*a* of the first drive motor 101 rotates, thereby rotating the sheet feed belt 24. When the sheet feed belt 24 rotates, the sheet feed pulley 23 provided on the sheet feed roller shaft 20*a* rotates in the clockwise direction. At this time, since the drive clutch 27 connecting the sheet feed pulley 23 and the sheet feed roller shaft 20*a* is in the on state, when the sheet feed pulley 23 rotates, the sheet feed roller shaft 20*a* rotates integrally.

Therefore, when the sheet feed roller shaft 20*a* rotates in the clockwise direction, the sheet feed roller gear 20*b* and the sheet feed roller 20 rotate integrally in the clockwise direction. When the sheet feed roller gear 20*b* rotates, the pickup roller gear 13*b* connected by the idle gear 15 rotates. At this time, when the sheet feed roller gear 20*b* rotates in the clockwise direction, the idle gear 15 rotates in the counter-clockwise direction and the pickup roller gear 13*b* rotates in the clockwise direction. Therefore, the pickup roller 13 provided on the pickup roller shaft 13*a* integrally with the pickup roller gear 13*b* also rotates in the clockwise direction. Then, one of the sheets S stacked on the sheet cassette 11 is picked up by the pickup roller 13 and conveyed between the sheet feed roller 20 and the multi-feed prevention roller 30.

When one sheet S enters between the multi-feed prevention roller 30 and the sheet feed roller 20, the sheet conveyance frictional force generated between the sheet S and the multi-feed prevention roller 30 is larger than the threshold torque value of the magnetic torque limiter 40 so that the multi-feed prevention roller 30 is rotated in the counter-clockwise direction by the sheet feed roller 20. Therefore, the sheet S that enters between the sheet feed roller 20 and the multi-feed prevention roller 30 is conveyed in the sheet conveying direction (the direction of arrow A).

When the sheet stacker 10 picks up and feeds the sheet S, two or more sheets S may enter between the sheet feed roller 20 and the multi-feed prevention roller 30, resulting in the multi-feed of the sheets. At this time, the controller 9 may perform a retry mode in which the sheets S positioned between the sheet feed roller 20 and the multi-feed prevention roller 30 are returned to the sheet cassette 11 and then the sheet S is fed again.

A state in which the controller 9 returns the sheets S positioned between the sheet feed roller 20 and the multi-feed prevention roller 30 to the sheet cassette 11 is illustrated in FIG. 23.

In detail, the controller 9 rotates the motor shaft 102*a* of the second drive motor 102 in the clockwise direction so that the pickup roller lifting cam 150 presses the protruding portion 21*a* of the sheet feed roller holder 21 downward. When the pickup roller lifting cam 150 presses the protruding portion 21*a* of the sheet feed roller holder 21 downward, the sheet feed roller holder 21 rotates in the counter-clockwise direction about the sheet feed roller shaft 20*a* so that the pickup roller 13 is spaced apart from the sheet cassette 11. At this time, the multi-feed prevention roller release cam 140 also rotates in the clockwise direction so that the multi-feed prevention roller release cam 140 is spaced apart from the protrusion 33*a* of the multi-feed prevention roller holder 33. Accordingly, the multi-feed prevention roller holder 33 is not subjected to the force by the multi-feed prevention roller release cam 140, so that the multi-feed prevention roller 30 keeps to press the sheet feed roller 20.

In addition, the controller 9 controls the drive clutch 27 provided on the sheet feed roller shaft 20*a* to be turned off.

In this state, the controller 9 rotates the motor shaft 101*a* of the first drive motor 101 in the clockwise direction. Then, the feed drive pulley 25 provided on the motor shaft 101*a* of the first drive motor 101 rotates, thereby rotating the sheet feed belt 24. When the sheet feed belt 24 rotates, the sheet feed pulley 23 provided on the sheet feed roller shaft 20*a* rotates in the clockwise direction. At this time, since the drive clutch 27 connecting the sheet feed pulley 23 and the sheet feed roller shaft 20*a* is in the off state, the sheet feed roller shaft 20*a* does not rotate even when the sheet feed pulley 23 rotates. Therefore, the sheet feed roller gear 20*b* and the sheet feed roller 20 integrally provided on the sheet feed roller shaft 20*a* are not rotated either. When the sheet feed roller gear 20*b* does not rotate, the pickup roller gear 13*b* connected by the idle gear 15 also does not rotate. At this time, the sheet feed roller 20 connected to the sheet feed roller shaft 20*a* by the one-way clutch 20*c* can freely rotate in the counter-clockwise direction.

When the motor shaft 101*a* of the first drive motor 101 rotates in the clockwise direction, the multi-feed prevention drive pulley 133 rotates integrally with the motor shaft 101*a* together with the feed drive pulley 25. When the motor shaft 101*a* of the first drive motor 101 rotates in the clockwise direction, the multi-feed prevention drive pulley 133 also rotates in the clockwise direction. When the multi-feed prevention drive pulley 133 rotates in the clockwise direction, the second intermediate pulley 132 provided on the intermediate shaft 130 also rotates in the clockwise direction by the intermediate belt 136. When the second intermediate pulley 132 rotates in the clockwise direction, the first intermediate pulley 131 provided on the intermediate shaft 130 also rotates in the clockwise direction. When the first intermediate pulley 131 rotates in the clockwise direction, the multi-feed prevention pulley 48 disposed on one side of the magnetic torque limiter 40 rotates in the clockwise direction. When the multi-feed prevention pulley 48 rotates in the clockwise direction, the magnetic torque limiter 40 rotates in the clockwise direction, and thereby the multi-feed prevention roller 30 rotates in the clockwise direction.

Since the multi-feed prevention roller 30 presses the sheet feed roller 20 by the elastic member 35, when the multi-feed prevention roller 30 rotates in the clockwise direction, the sheet S positioned between the multi-feed prevention roller 30 and the sheet feed roller 20 may be returned to the sheet cassette 11. At this time, the sheet feed roller 20 rotates in the counter-clockwise direction by the friction between the sheet feed roller 20 and the sheet S, so that the sheet S can be moved in the direction (a direction of arrow C) opposite to the sheet conveying direction.

Therefore, the drive clutch 27 for selectively blocking the rotational force transmitted to the sheet feed roller 20, the first drive motor 101 for rotating the multi-feed prevention roller 30, and the multi-feed prevention roller 30 may constitute a sheet return unit that returns two or more sheet S conveyed between the multi-feed prevention roller 30 and the sheet feed roller 20 to the sheet cassette 11.

When the operation of returning the sheets S positioned between the multi-feed prevention roller 30 and the sheet feed roller 20 to the sheet cassette 11 is completed, the controller 9 controls the first drive motor 101 and the second drive motor 102 so that the sheet feed roller 20, the pickup roller 13, and the multi-feed prevention roller 30 are brought into the state shown in FIG. 22 as described above, and thereby the sheet S stacked on the sheet stacker 10 is conveyed to the sheet feed roller 20 again.

When the feeding operation of the sheet S is completed, the controller 9 controls the first drive motor 101 and the second drive motor 102 so that the sheet feed roller 20, the pickup roller 13, and the multi-feed prevention roller 30 are brought into the state of FIG. 21 from the state of FIG. 22 as described above.

In detail, the controller 9 rotates the second drive motor 102 in one direction so that the multi-feed prevention roller release cam 140 is rotated in the counter-clockwise direction. For example, in FIG. 22, the motor shaft 102*a* of the second drive motor 102 is rotated in the counter-clockwise direction so that the multi-feed prevention roller release cam 140 is rotated in the counter-clockwise direction from the horizontal state. Then, the multi-feed prevention roller release cam 140 presses the protrusion 33*a* of the multi-feed prevention roller holder 33 upward, so that the multi-feed prevention roller holder 33 rotates in the clockwise direction about the intermediate shaft 130. Then, the elastic member 35 provided below the multi-feed prevention roller holder 33 is compressed, and the multi-feed prevention roller 30 is spaced apart from the sheet feed roller 20.

When the motor shaft 102*a* of the second drive motor 102 rotates in the counter-clockwise direction, the pickup roller lifting cam 150 also rotates in the counter-clockwise direction. Then, the pickup roller lifting cam 150 does not apply a force to the protruding portion 21*a* of the sheet feed roller holder 21, so that the pickup roller 13 remains in contact with the sheet S.

When the sheet S is jammed between the sheet feed roller 20 and the multi-feed prevention roller 30, the controller 9 controls the first drive motor 101 and the second drive motor 102 so that the sheet feed roller 20 and the multi-feed prevention roller 30 are spaced apart from each other as illustrated in FIG. 21.

With the sheet feeding apparatus 1 according to an example of the present disclosure as described above, when a multi-feed occurs between the multi-feed prevention roller 30 and the sheet feed roller 20, the sheet S may be automatically returned to the sheet cassette 11, and then the sheet feeding operation may be performed again.

The sheet feeding apparatus as described above is configured to transmit rotation of the first drive motor and the second drive motor by using belts and pulleys, but the power transmission structure is not limited thereto. The belt power transmission structure may be changed to a gear power transmission structure.

Hereinafter, a sheet feeding apparatus according to another example of the present disclosure will be described with reference to FIGS. 25 and 26.

FIG. 25 is a view schematically illustrating a sheet feeding apparatus according to another example of the present disclosure, and FIG. 26 is a plan view illustrating a multi-feed prevention roller of the sheet feeding apparatus of FIG. 25.

Referring to FIGS. 25 and 26, a sheet feeding apparatus 1 according to an example of the present disclosure may include a sheet stacker 10, a sheet feed roller 20, a multi-feed prevention roller 30, and a multi-feed detector.

The sheet stacker 10 stacks at least one sheet S, picks up the stacked sheets S one by one, and feeds the picked sheet toward the sheet feed roller 20. The sheet stacker 10 may include a sheet cassette 11 and a pickup roller 13 provided above the sheet cassette 11. The sheet cassette 11 is configured to accommodate a predetermined number of sheets S. The pickup roller 13 is formed to move the sheet S positioned at the top of the sheets S stacked on the sheet cassette 11 toward the sheet feed roller 20.

The sheet feed roller 20 is disposed on one side of the sheet stacker 10 and feeds the sheet S stacked on the sheet stacker 10 toward the conveying roller 201. In detail, the sheet feed roller 20 is formed to move the sheet S picked up by the pickup roller 13 in the sheet stacker 10 toward the conveying roller 201. The conveying roller 201 moves the sheet S fed by the sheet feed roller 20 to an image former (not illustrated).

The sheet feed roller 20 is disposed to be rotatable by a driving source (not illustrated). As an example, the driving source may use a drive motor. The structure in which the drive motor rotates the sheet feed roller 20 is general; therefore, the illustration and description thereof are omitted.

The multi-feed prevention roller 30 is provided to face the sheet feed roller 20 and to prevent the multi-feed of the sheets S fed from the sheet stacker 10. In detail, the multi-feed prevention roller 30 is provided to be in contact with the sheet feed roller 20 at a predetermined pressure. When one sheet S is fed between the multi-feed prevention roller 30 and the sheet feed roller 20 from the sheet stacker 10, the multi-feed prevention roller 30 is rotated by the sheet feed roller 20 to allow the sheet S to convey to the conveying roller 201. However, when two or more sheets S enter between the multi-feed prevention roller 30 and the sheet feed roller 20, the multi-feed prevention roller 30 prevents the two or more sheets S from passing between the multi-feed prevention roller 30 and the sheet feed roller 20.

For the multi-feed prevention, a magnetic torque limiter 40 is provided in the multi-feed prevention roller 30. In detail, the magnetic torque limiter 40 is provided on the rotation shaft 31 of the multi-feed prevention roller 30 and has a predetermined threshold torque value. The structure of the magnetic torque limiter 40 is the same as or similar to that of the above-described example. Accordingly, when one sheet S enters between the multi-feed prevention roller 30 and the sheet feed roller 20, the magnetic torque limiter 40 allows the multi-feed prevention roller 30 to be rotated by the sheet feed roller 20 so that the sheet S is normally conveyed. However, when two or more sheets S enter between the multi-feed prevention roller 30 and the sheet feed roller 20, the magnetic torque limiter 40 blocks two or more sheets S from being conveyed.

The multi-feed detector may include a rotary encoder 60 coaxially disposed on the rotation shaft 31 at one side of the multi-feed prevention roller 30 and a sensor 65 to detect rotation and displacement of the rotary encoder 60. The sensor 65 may be disposed on one side of the rotary encoder 60.

The rotary encoder 60 is formed in the shape of a disk, and a plurality of slots 61 are formed on the disk at regular intervals in the circumferential direction. The sensor 65 outputs a pulse signal corresponding to the rotation of the rotary encoder 60 and may be implemented by optical sensors 66 and 67 including light emitting portions 66*a* and 67*b* and light receiving portions 66*b* and 67*b*. The light receiving portions 66*b* and 67*b* of the optical sensors 66 and 67 may output pulse signals in accordance with the rotation of the rotary encoder 60. The sensor 65 may include two optical sensors 66 and 67 to detect the rotational direction of the rotary encoder 60. The two optical sensors 66 and 67, that is, a first optical sensor 66 and a second optical sensor 67 may be provided adjacent to each other in the circumferential direction of the rotary encoder 60. The first and second optical sensors 66 and 67 may be formed as a single body.

For example, the first optical sensor 66 and the second optical sensor 67 may be disposed above and below the horizontal line H passing through the rotation center C of the rotary encoder 60. As described above, by providing the first optical sensor 66 and the second optical sensor 67 in the circumferential direction of the rotary encoder 60, it is possible to detect the rotation state, the rotation direction, and the displacement of the rotary encoder 60. Since the rotary encoder 60 is integrally provided with the multi-feed prevention roller 30, it is possible to detect the rotation state, the rotation direction, and the displacement of the multi-feed prevention roller 30 through the two optical sensors 66 and 67. The two optical sensors 66 and 67 may be disposed on a bracket 69 provided separately from the sheet feeding apparatus 1 so as not to interfere with the rotation of the rotary encoder 60.

Hereinafter, the operation of the sheet feeding apparatus according to an example of the present disclosure will be described with reference to FIGS. 27A to 29B.

First, a case in which the sheet feeding apparatus normally feeds one sheet will be described with reference to FIGS. 27A and 27B.

FIG. 27A is a view illustrating a case where a sheet feeding apparatus according to an example of the present disclosure normally feeds a sheet, and FIG. 27B is a view illustrating signals output from a first optical sensor and a second optical sensor in the case of FIG. 27A.

Referring to FIG. 27A, one sheet S is picked up by the pickup roller 13 and enters between the sheet feed roller 20 and the multi-feed prevention roller 30. In this case, since the sheet conveyance frictional force generated between the multi-feed prevention roller 30 and the sheet S is larger than the threshold torque value of the magnetic torque limiter 40, the multi-feed prevention roller 30 is rotated by the sheet feed roller 20. For example, as illustrated in FIG. 27A, when the sheet feed roller 20 rotates in the clockwise direction, the multi-feed prevention roller 30 rotates in the counter-clockwise direction due to the frictional force against the sheet S and causes the sheet S to be conveyed in the sheet conveying direction (the direction of arrow A).

At this time, the two optical sensors 66 and 67 provided on one side of the rotary encoder 60 output pulse signals in the order of A-phase and B-phase as illustrated in FIG. 27B. For example, the first optical sensor 66 outputs the A-phase pulse signal, and then the second optical sensor 67 outputs the B-phase pulse signal delayed by t times with respect to the A-phase pulse signal. When the A-phase pulse signal and the B-phase pulse signal are output from the first and second optical sensors 66 and 67 as illustrated in FIG. 27B, the controller 9 determines that the sheet S is normally fed.

Next, a case where the sheet feeding apparatus 1 feeds two sheets S will be described with reference to FIGS. 28A and 28B.

FIG. 28A is a view illustrating a case where two sheets are fed to a multi-feed prevention roller of a sheet feeding apparatus according to an example of the present disclosure, and FIG. 28B is a view illustrating signals output from a first optical sensor and a second optical sensor in the case of FIG. 28A.

Referring to FIG. 28A, two sheets S are picked up by the pickup roller 13 and enter between the sheet feed roller 20 and the multi-feed prevention roller 30. In this case, since the sheet conveyance frictional force generated between the multi-feed prevention roller 30 and the sheet S is smaller than the threshold torque value of the magnetic torque limiter 40, the multi-feed prevention roller 30 is not rotated by the sheet feed roller 20, but is rotated by the driving source connected to the multi-feed prevention roller 30. For example, as illustrated in FIG. 28A, when the sheet feed roller 20 rotates in the clockwise direction, the multi-feed prevention roller 30 is rotated in the clockwise direction by the driving source, so that the lower sheet is conveyed to the sheet cassette 11 of the sheet stacker 10. Therefore, when the multi-feed of the sheets S occurs, the multi-feed prevention roller 30 rotates in the opposite direction with respect to the rotation direction in which the sheet S is normally conveyed.

At this time, the order of the pulse signals output from the two optical sensors 66 and 67 provided on one side of the rotary encoder 60 changes. For example, as illustrated in FIG. 28B, the pulse signals, which output in the order of A-phase and B phase from the first and second optical sensors 66 and 67 during forward rotation, changes in the order of B-phase and A-phase when the multi-feed prevention roller 30 rotates in the reverse direction due to the occurrence of the multi-feed. In detail, when the multi-feed occurs, the second optical sensor 67 outputs the B-phase pulse signal, and then the first optical sensor 66 outputs the A-phase pulse signal delayed by the t times with respect to the B-phase pulse signal. When a predetermined period time (T1 msec) elapses after the order of the A-phase pulse signal and the B-phase pulse signal is changed, the controller 9 may stop the sheet feed roller 20 and the multi-feed prevention roller 30 and inform the outside of the occurrence of the multi-feed of the sheets S.

Finally, a case where the sheet feeding apparatus 1 feeds three or more sheets S will be described with reference to FIGS. 29A and 29B.

FIG. 29A is a view illustrating a case where three or more sheets are fed to a multi-feed prevention roller of a sheet feeding apparatus according to an example of the present disclosure, and FIG. 29B is a view illustrating signals output from a first optical sensor and a second optical sensor in the case of FIG. 29A.

Referring to FIG. 29A, a large number of sheets S, for example, three or more sheets S are picked up by the pickup roller 13 and enter between the sheet feed roller 20 and the multi-feed prevention roller 30. In this case, since the frictional force applied to the multi-feed prevention roller 30 by the large number of sheets S inserted between the sheet feed roller 20 and the multi-feed prevention roller 30 is larger than the threshold torque value of the magnetic torque limiter 40, the multi-feed prevention roller 30 rotates in conjunction with the sheet feed roller 20. For example, as illustrated in FIG. 29A, when the sheet feed roller 20 rotates in the clockwise direction, the multi-feed prevention roller 30 is rotated in the sheet conveying direction (the direction of arrow A), that is, in the counter-clockwise direction by the frictional force against the large number of sheets S. At this time, since the large number of sheets S are inserted between the sheet feed roller 20 and the multi-feed prevention roller 30, a lower side displacement amount (arrow B) of the multi-feed prevention roller 30 increases. The lower side displacement B of the multi-feed prevention roller 30 may be detected by the two optical sensors 66 and 67.

At this time, the two optical sensors 66 and 67 provided on one side of the rotary encoder 60 output pulse signals in the order of A-phase and B-phase as illustrated in FIG. 29B. However, the pulse interval of each of the A-phase pulse signal and the B-phase pulse signal becomes shorter than in the case of normal rotation. For example, when the multi-feed prevention roller 30 rotates in the forward direction, the first optical sensor 66 outputs the A-phase pulse signal, and the second optical sensor 67 outputs the B-phase pulse signal delayed by t times with respect to the A-phase pulse signal. At this time, the pulse interval of each of the A-phase pulse signal and the B-phase pulse signal is T1.

When the large number of sheets S are inserted between the multi-feed prevention roller 30 and the sheet feed roller 20, as illustrated in FIG. 29B, the order of the A-phase pulse signal and the B-phase pulse signal output from the first and second optical sensors 66 and 67 and 52 is the same, but the pulse interval of each of the A-phase pulse signal and the B-phase pulse signal is shortened to T2 (msec). When a predetermined period time (T3 msec) elapses after detecting that the pulse interval of each of the A-phase pulse signal and the B-phase pulse signal is shorten, the controller 9 may stop the sheet feed roller 20 and the multi-feed prevention roller 30 and inform the outside of the occurrence of the multi-feed of the large number of sheets.

In the above description, the sheet feeding apparatus 1 has an active multi-feed prevention roller 30 that the multi-feed prevention roller 30 is configured to be rotated by the driving source. However, the sheet feeding apparatus 1 may use a semi-active multi-feed prevention roller that the multi-feed prevention roller is configured not to receive the power from the driving source as the multi-feed prevention roller.

The structure of the sheet feeding apparatus including the semi-active multi-feed prevention roller is the same as or similar to that of the sheet feeding apparatus according to the example illustrated in FIGS. 25 and 26 except that the driving shaft for transmitting the rotational force from the separate driving source is not connected to the housing shaft of the magnetic torque limiter. Therefore, the description of the structure of the sheet feeding apparatus including the semi-active multi-feed prevention roller is omitted.

Hereinafter, the operation of the sheet feeding apparatus including the semi-active multi-feed prevention roller will be described.

First, when one sheet S enters between the sheet feed roller 20 and the multi-feed prevention roller 30, the multi-feed prevention roller 30 is rotated by the sheet conveyance frictional force, so that the two optical sensors 66 and 67 output the A-phase pulse signal and the B-phase pulse signal in the same manner as illustrated in FIG. 27B. When the A-phase pulse signal and the B-phase pulse signal are output from the first and second optical sensors 66 and 67 as illustrated in FIG. 27B, the controller 9 determines that the sheet S is normally fed.

Next, a case where the sheet stacker 10 feeds two sheets S will be described with reference to FIGS. 30A and 30B.

FIG. 30A is a view illustrating a case where two sheets are fed to a multi-feed prevention roller of a sheet feeding apparatus including a semi-active multi-feed prevention roller according to an example of the present disclosure, and FIG. 30B is a view illustrating signals output from a first optical sensor and a second optical sensor in the case of FIG. 30A.

Referring to FIG. 30A, two sheets S are picked up by the pickup roller 13 and enter between the sheet feed roller 20 and the multi-feed prevention roller 30. In this case, since the sheet conveyance frictional force generated between the multi-feed prevention roller 30 and the sheet S is smaller than the threshold torque value of the magnetic torque limiter 40, the multi-feed prevention roller 30 is not rotated by the sheet feed roller 20, and remains in a stationary state. For example, as illustrated in FIG. 30A, in the case where the sheet feed roller 20 rotates in the clockwise direction, when the two sheets S are conveyed between the multi-feed prevention roller 30 and the sheet feed roller 20, the multi-feed prevention roller 30 is stopped regardless of the rotation of the sheet feed roller 20.

At this time, the pulse signals are not output from the two optical sensors 66 and 67 provided on one side of the rotary encoder 60. For example, as illustrated in FIG. 30B, during forward rotation, the pulse signals are output in the order of A-phase and B phase from the first and second optical sensors 66 and 67. However, when the multi-feed prevention roller 30 does not rotate due to the occurrence of the multi-feed of the sheets S, the A-phase pulse signal and the B-phase pulse signal are not output. When a predetermined period of time (T1 msec) elapses after the pulse signal is not output after any one of the A-phase pulse signal and the B-phase pulse signal is output, the controller 9 may stop the sheet feed roller 20 and inform the outside of the occurrence of the multi-feed of the sheets S.

Finally, a case where the sheet stacker 10 feeds three or more sheets S between the multi-feed prevention roller 30 and the sheet feed roller 20 will be described with reference to FIGS. 31A and 31B.

FIG. 31A is a view illustrating a case where three sheets or more are fed to a multi-feed prevention roller of a sheet feeding apparatus including a semi-active multi-feed prevention roller according to an example of the present disclosure, and FIG. 31B is a view illustrating signals output from a first optical sensor and a second optical sensor in the case of FIG. 31A.

Referring to FIG. 31A, a large number of sheets S, for example, three or more sheets S are picked up by the pickup roller 13 and enter between the sheet feed roller 20 and the multi-feed prevention roller 30. In this case, since the frictional force applied to the multi-feed prevention roller 30 by the large number of sheets S inserted between the sheet feed roller 20 and the multi-feed prevention roller 30 is larger than the threshold torque value of the magnetic torque limiter 40, the multi-feed prevention roller 30 rotates in conjunction with the sheet feed roller 20. For example, as illustrated in FIG. 31A, when the sheet feed roller 20 rotates in the clockwise direction, the multi-feed prevention roller 30 is rotated in the sheet conveying direction (the direction of arrow A), that is, in the counter-clockwise direction by the frictional force against the large number of sheets S. At this time, since the large number of sheets S are inserted between the sheet feed roller 20 and the multi-feed prevention roller 30, a lower side displacement amount (arrow B) of the multi-feed prevention roller 30 increases. The lower side displacement B of the multi-feed prevention roller 30 may be detected by the two optical sensors 66 and 67.

At this time, the two optical sensors 66 and 67 provided on one side of the rotary encoder 60 output pulse signals in the order of A-phase and B-phase as illustrated in FIG. 31B. However, the pulse interval of each of the A-phase pulse and the B-phase pulse becomes shorter than in the case of normal rotation. For example, when the multi-feed prevention roller 30 rotates in the forward direction, the first optical sensor 66 outputs the A-phase pulse signal, and the second optical sensor 67 outputs the B-phase pulse signal delayed by t times with respect to the A-phase pulse signal. At this time, the pulse interval of each of the A-phase pulse signal and the B-phase pulse signal is T1. When the large number of sheets S are inserted between the multi-feed prevention roller 30 and the sheet feed roller 20, as illustrated in FIG. 31B, the order of the A-phase pulse signal and the B-phase pulse signal output from the first and second optical sensors 66 and 67 and 52 is the same, but the pulse interval of each the A-phase pulse signal and the B-phase pulse signal is shortened to T2 (msec). When a predetermined period (T3 msec) elapses after detecting that the pulse interval of each of the A-phase pulse signal and the B-phase pulse signal is shorten, the controller 9 may stop the sheet feed roller 20 and inform the outside of the occurrence of the multi-feed of the large number of sheets.

In the above description, two optical sensors 66 and 67 of the multi-feed detector are disposed adjacent to each other. However, the arrangement of the two optical sensors 66 and 67 is not limited thereto. For example, the two optical sensors 66 and 67 may be arranged at intervals of about 90 degrees.

Hereinafter, a sheet feeding apparatus including a multi-feed detector in which two optical sensors are arranged at about 90 degrees will be described with reference to FIGS. 32 and 33.

FIG. 32 is a view schematically illustrating a sheet feeding apparatus according to another example of the present disclosure, and FIG. 33 is a plan view illustrating a multi-feed prevention roller of the sheet feeding apparatus of FIG. 32.

Referring to FIGS. 32 and 33, a sheet feeding apparatus 1 according to an example of the present disclosure may include a sheet stacker 10, a sheet feed roller 20, a multi-feed prevention roller 30, and a multi-feed detector.

The sheet stacker 10, the sheet feed roller 20, and the multi-feed prevention roller 30 are the same as or similar to the sheet stacker 10, the sheet feed roller 20, and the multi-feed prevention roller 30 of the sheet feeding apparatus 1 as illustrated in FIGS. 25 and 26; therefore, detailed descriptions thereof are omitted.

The multi-feed detector may include a rotary encoder 70 coaxially disposed on the rotation shaft 31 at one side of the multi-feed prevention roller 30 and sensors 76 and 77 to detect rotation and displacement of the rotary encoder 70. The sensors 76 and 77 may be disposed on one side of the rotary encoder 70.

The rotary encoder 70 is formed in the shape of a disk, and a plurality of slots 71 are formed on the disk at regular intervals in the circumferential direction. The sensors 76 and 77 output a pulse signal corresponding to the rotation of the rotary encoder 70 and may be implemented by optical sensors including light emitting portions 76*a* and 77*a* and light receiving portions 76*b* and 77*b*.

The light receiving portions 76*b* and 77*b* of the optical sensors 76 and 77 may output pulse signals in accordance with the rotation of the rotary encoder 70. The sensors 76 and 77 may include two optical sensors 66 and 67, that is, a first optical sensor 76 and a second optical sensor 77 to detect the rotational direction of the rotary encoder 70.

The two optical sensors 76 and 77 may be disposed at intervals of about 90 degrees with respect to the rotation center C of the rotary encoder 70. For example, the first optical sensor 76 is disposed on a horizontal line H passing through the center C of the rotary encoder 70 and the second optical sensor 77 is disposed on a vertical line V passing through the center C of the rotary encoder 70. In the case of the sheet feeding apparatus 1 as illustrated in FIG. 32, the first optical sensor 76 is disposed on the left side of the rotary encoder 70 and the second optical sensor 77 is disposed on the lower side of the rotary encoder 70.

When the first optical sensor 76 and the second optical sensor 77 are provided at intervals of about 90 degrees with respect to the center C of the rotary encoder 70 as described above, the rotation state, the rotation direction, and the displacement of the rotary encoder 70 may be detected. Since the rotary encoder 60 is provided to rotate integrally with the multi-feed prevention roller 30, it is possible to detect the rotation state, the rotation direction, and the displacement of the multi-feed prevention roller 30 through the two optical sensors 76 and 77. The two optical sensors 76 and 77 may be disposed on a bracket 79 provided separately from the sheet feeding apparatus 1 so as not to interfere with the rotation of the rotary encoder 70.

Hereinafter, the operation of the sheet feeding apparatus according to an example of the present disclosure will be described with reference to FIGS. 34A to 36B.

FIG. 34A is a view illustrating a case where a sheet feeding apparatus according to an example of the present disclosure normally feeds a sheet, and FIG. 34B is a view illustrating signals output from a first optical sensor and a second optical sensor in the case of FIG. 34A.

Referring to FIG. 34A, one sheet S is picked up by the pickup roller 13 and enters between the sheet feed roller 20 and the multi-feed prevention roller 30. In this case, since the sheet conveyance frictional force generated between the multi-feed prevention roller 30 and the sheet S is larger than the threshold torque value of the magnetic torque limiter 40, the multi-feed prevention roller 30 is rotated by the sheet feed roller 20. For example, as illustrated in FIG. 34A, when the sheet feed roller 20 rotates in the clockwise direction, the multi-feed prevention roller 30 rotates in the counter-clockwise direction due to the frictional force against the sheet S and causes the sheet S to be conveyed in the sheet conveying direction (the direction of arrow A).

At this time, the two optical sensors 76 and 77 provided on one side and lower side of the rotary encoder 70 output pulse signals in the order of A-phase and B-phase as illustrated in FIG. 34B. For example, the first optical sensor 76 outputs the A-phase pulse signal, and then the second optical sensor 77 outputs the B-phase pulse signal delayed by t times with respect to the A-phase pulse signal. When the A-phase pulse signal and the B-phase pulse signal are output from the first and second optical sensors 76 and 77 as illustrated in FIG. 34B, the controller 9 determines that the sheet S is normally fed.

Next, a case where the sheet stacker 10 feeds two sheets S will be described with reference to FIGS. 35A and 35B.

FIG. 35A is a view illustrating a case where two sheets are fed to a multi-feed prevention roller of a sheet feeding apparatus according to an example of the present disclosure, and FIG. 35B is a view illustrating signals output from a first optical sensor and a second optical sensor in the case of FIG. 35A.

Referring to FIG. 35A, two sheets S are picked up by the pickup roller 13 and enter between the sheet feed roller 20 and the multi-feed prevention roller 30. In this case, since the sheet conveyance frictional force generated between the multi-feed prevention roller 30 and the sheet S is smaller than the threshold torque value of the magnetic torque limiter 40, the multi-feed prevention roller 30 is not rotated by the sheet feed roller 20, but is rotated by the driving source connected to the multi-feed prevention roller 30. For example, as illustrated in FIG. 35A, when the sheet feed roller 20 rotates in the clockwise direction, the multi-feed prevention roller 30 is rotated in the clockwise direction by the driving source, so that the lower sheet is conveyed to the sheet cassette 11 of the sheet stacker 10. Therefore, when the multi-feed of the sheets S occurs, the multi-feed prevention roller 30 rotates in a direction opposite to the rotation direction when the sheet S is normally conveyed.

At this time, the order of the pulse signals output from the two optical sensors 76 and 77 provided on one side and lower side of the rotary encoder 70 changes. For example, as illustrated in FIG. 35B, the pulse signals, which output in the order of A-phase and B phase from the first and second optical sensors 76 and 77 during forward rotation, changes in the order of B-phase and A-phase when the multi-feed prevention roller 30 rotates in the opposite direction due to the occurrence of the multi-feed of the sheets S. In detail, when the multi-feed occurs, the second optical sensor 77 outputs the B-phase pulse signal, and then the first optical sensor 76 outputs the A-phase pulse signal delayed by the t times with respect to the B-phase pulse signal. When a predetermined period of time (T1 msec) elapses after the order of the A-phase pulse signal and the B-phase pulse signal is changed, the controller 9 may stop the sheet feed roller 20 and the multi-feed prevention roller 30 and inform the outside of the occurrence of the multi-feed of the sheet S.

Finally, a case where the sheet stacker 10 feeds three or more sheets S will be described with reference to FIGS. 36A and 36B.

FIG. 36A is a view illustrating a case where three or more sheets are fed to a multi-feed prevention roller of a sheet feeding apparatus according to an example of the present disclosure, and FIG. 36B is a view illustrating signals output from a first optical sensor and a second optical sensor in the case of FIG. 36A.

Referring to FIG. 36A, a large number of sheets S, for example, three or more sheets S are picked up by the pickup roller 13 and enter between the sheet feed roller 20 and the multi-feed prevention roller 30. In this case, since the frictional force applied to the multi-feed prevention roller 30 by the large number of sheets S inserted between the sheet feed roller 20 and the multi-feed prevention roller 30 is larger than the threshold torque value of the magnetic torque limiter 40, the multi-feed prevention roller 30 rotates in conjunction with the sheet feed roller 20. For example, as illustrated in FIG. 36A, when the sheet feed roller 20 rotates in the clockwise direction, the multi-feed prevention roller 30 is rotated in the sheet conveying direction (the direction of arrow A), that is, in the counter-clockwise direction by the frictional force against the large number of sheets S. At this time, since the large number of sheets S are inserted between the sheet feed roller 20 and the multi-feed prevention roller 30, a lower side displacement amount (arrow B) in which the multi-feed prevention roller 30 moves downward increases. The lower side displacement B of the multi-feed prevention roller 30 may be detected by the two optical sensors 76 and 77.

At this time, the two optical sensors 76 and 77 provided on one side and lower side of the rotary encoder 70 output pulse signals in the order of A-phase and B-phase as illustrated in FIG. 36B. The pulse interval of the A-phase pulse signal is shorter than that of the normal rotation but the pulse interval of the B-phase pulse signal is the same as that of the normal rotation. For example, when the multi-feed prevention roller 30 rotates in the forward direction, the first optical sensor 76 outputs the A-phase pulse signal, and the second optical sensor 77 outputs the B-phase pulse signal delayed by t times with respect to the A-phase pulse signal. At this time, the pulse interval of each of the A-phase pulse signal and the B-phase pulse signal is T1. When the large number of sheets S are inserted between the multi-feed prevention roller 30 and the sheet feed roller 20, as illustrated in FIG. 36B, the order of the A-phase pulse signal and the B-phase pulse signal output from the first and second optical sensors 76 and 77 is the same, but the pulse interval of the A-phase pulse signal is shortened to T2 (msec). However, since the second optical sensor 77 is disposed on the vertical line V passing through the center C of the rotary encoder 70, even when the multi-feed prevention roller 30 moves downward, the second optical sensor 77 cannot detect a change in the position of the slots 71 of the rotary encoder 70. Therefore, the second optical sensor 77 outputs a normal B-phase pulse signal. When the difference between the A-phase pulse signal and the B-phase pulse signal occurs, the controller 9 determines that the multi-feed of a large number of sheet occurs.

As another example, the frequency of the pulse signal output from each of the first optical sensor 76 and the second optical sensor 77 may be converted into a voltage to determine whether the multi-feed of a large number of sheets occurs.

FIG. 36C is a view illustrating a case where a frequency of a pulse signal output from each of a first optical sensor and a second optical sensor is converted into a voltage in the case of FIG. 36A.

Referring to FIG. 36C, the A phase represents that the frequency of the A-phase pulse signal of FIG. 36B is converted into a voltage. When the rotary encoder 70 rotates normally, the first optical sensor 76 outputs pulse signals at T1 time intervals as illustrated in FIG. 36B. When the pulse signals in this case is converted into a voltage, it may be represented by a voltage of Δa as illustrated in FIG. 36C. When the multi-feed of a large number of sheets occurs, the first optical sensor 76 outputs pulse signals at T2 time intervals as illustrated in FIG. 36B so that the number of pulses increases. When the frequency of the pulse signal in this case is converted into a voltage, it may be shown that the voltage is increased by Δb as in the portion K in FIG. 36C. Therefore, when the multi-feed of a large number of sheets occurs, the voltage of the A phase pulse signal becomes Δa+Δb.

When the multi-feed of a large number of sheets occurs, the B-phase pulse signal output from the second optical sensor 77 does not change as illustrated in FIG. 36B. Therefore, when the frequency of the pulse signal in this case is converted into a voltage, it may be represented by a voltage of Δa as illustrated in FIG. 36C.

Accordingly, in the case where the frequency of the pulse signal output from each of the first optical sensor 76 and the second optical sensor 77 is converted into a voltage, when the voltage difference between the output signals of the first optical sensor 76 and the second optical sensor 77 is Δb, the controller 9 may determine that the multi-feed of a large number of sheets occurs.

In the above description, the sheet feeding apparatus includes the active multi-feed prevention roller configured to be rotatable by the driving source as the multi-feed prevention roller. However, the sheet feeding apparatus may use a semi-active multi-feed prevention roller configured not to receive the power from the driving source as the multi-feed prevention roller, and its operation is similar to the above-described example. Therefore, a detailed description thereof is omitted.

As described above, the sheet feeding apparatus according to an example of the present disclosure can detect the rotation state, the rotation direction, and the downward displacement of the multi-feed prevention roller by using the magnetic torque limiter and the hall sensor provided on one side of the multi-feed prevention roller. Therefore, the multi-feed of the sheets may be reliably detected with a simple configuration.

Further, the sheet feeding apparatus according to an example of the present disclosure can detect the rotation state, the rotation direction, and the downward displacement of the multi-feed prevention roller by using the rotary encoder and the optical sensors provided on one side of the multi-feed prevention roller. Therefore, the multi-feed of the sheets may be reliably detected with a simple configuration. Accordingly, with an example of the present disclosure, it is possible to provide a sheet feeding apparatus having a low-cost, small-sized, and highly reliable multi-feed detecting function.

In addition, the sheet feeding apparatus according to an example of the present disclosure automatically returns the sheets positioned between the sheet feed roller and the multi-feed prevention roller to the sheet stacker and then performs the sheet feeding operation again. Therefore, the operation ratio of the sheet feeding apparatus according to an example of the present disclosure may be improved.

In the above description, the sheet feeding apparatus according to an example of the present disclosure is applied to an image forming apparatus. However, the sheet feeding apparatus according to an example of the present disclosure is not limited thereto. The sheet feeding apparatus according to an example of the present disclosure may be used for facsimile, an automatic document scanning apparatus, a large capacity paper feeding apparatus, and the like in which a large amount of sheets need to be fed.

While the examples of the present disclosure have been described, additional variations and modifications of the examples may occur to those skilled in the art once they learn of the basic inventive concepts.

Therefore, it is intended that the appended claims shall be construed to include both the above examples and all such variations and modifications that fall within the spirit and scope of the inventive concepts.

The invention claimed is:

1. A sheet feeding apparatus comprising:

a sheet stacker to stack at least one sheet;

a sheet feed roller disposed at one side of the sheet stacker and to feed a sheet fed from the sheet stacker;

a multi-feed prevention roller disposed to face the sheet feed roller and to prevent multi-feed of sheets fed from the sheet stacker;

a magnetic torque limiter disposed coaxially with the multi-feed prevention roller;

a hall sensor disposed at one side of the magnetic torque limiter and to detect a rotation and a rotational direction of the magnetic torque limiter; and a controller to, control rotation of the sheet feed roller in a state in which the sheet feed roller and the multi-feed prevention roller are in contact with each other without a sheet, and control to determine a value indicative of usage corresponding to the multi-feed prevention roller according to a signal indicative of the detected rotation and rotational direction of the magnetic torque limiter output from the hall sensor, wherein the magnetic torque limiter includes, a plurality of permanent magnets provided circumferentially on a rotation shaft of the multi-feed prevention roller, a housing to surround the plurality of permanent magnets, and a magnetic member provided on an inner circumferential surface of the housing and facing the plurality of permanent magnets; and wherein a portion of the housing facing the hall sensor is provided with a magnetic force emitting region through which a magnetic force of a permanent magnet among the plurality of permanent magnets is radiated to an outside of the housing over a circumferential region of the housing to cause the detection of the rotation and the rotational direction of the magnetic torque limiter by the hall sensor.

2. The sheet feeding apparatus of claim 1, wherein a length of the magnetic member is smaller than a length of each of the plurality of permanent magnets, and wherein the magnetic force emitting region does not overlap with the magnetic member and is formed as a portion of the housing facing the plurality of permanent magnets.

3. The sheet feeding apparatus of claim 1, wherein the magnetic member includes a plurality of slits provided in a circumferential direction, and wherein the magnetic force emitting region is formed as a portion of the housing corresponding to the plurality of slits of the magnetic member.

4. The sheet feeding apparatus of claim 1, wherein the hall sensor comprises two hall sensors provided in a circumferential direction of the magnetic torque limiter.

5. The sheet feeding apparatus of claim 1, wherein the hall sensor comprises a hall IC sensor in which two hall sensors are integrated.

6. The sheet feeding apparatus of claim 1, further comprising:

a pickup roller to pick up the at least one sheet stacked on the sheet stacker;

a sheet feed motor to rotate at least one or a combination of the pickup roller, the sheet feed roller, or the multi-feed prevention roller;

a sheet feed clutch to selectively transmit a rotational force of the sheet feed motor to the sheet feed roller; and a pickup clutch to selectively transmit the rotational force supplied from the sheet feed clutch to the pickup roller, wherein when determining the value corresponding to the multi-feed prevention roller, the controller is to, control driving the sheet feed motor, control the sheet feed clutch and the pickup clutch so that the sheet feed roller is rotated by the rotational force of the sheet feed motor and the pickup roller is blocked from picking up the sheet, and determine the value indicative of the usage corresponding to the multi-feed prevention roller according to the signal indicative of the detected rotation and rotational direction of the magnetic torque limiter output from the hall sensor, in response to the rotation of the multi-feed prevention roller.

7. The sheet feeding apparatus of claim 6, wherein the controller is to further, compare a number of rotations of the sheet feed roller and a number of rotations of the multi-feed prevention roller, and determine that the value indicative of the usage corresponding to the multi-feed prevention roller further indicates a lifetime of the multi-feed prevention roller is over, when a difference between the number of rotations of the multi-feed prevention roller and the number of rotations of the sheet feed roller is larger than a reference number of rotations.

8. The sheet feeding apparatus of claim 6, wherein the controller is to further, determine that the value indicative of the usage corresponding to the multi-feed prevention roller further indicates a lifetime of the multi-feed prevention roller is over, when an interval between two adjacent pulse signals among a plurality of pulse signals corresponding to one rotation of the multi-feed prevention roller output form the hall sensor is larger than a reference pulse interval.

9. The sheet feeding apparatus of claim 1, further comprising:

a pickup roller to pick up the at least one sheet stacked on the sheet stacker;

a sheet feed motor to rotate at least one or a combination of the pickup roller, the sheet feed roller, or the multi-feed prevention roller;

a sheet feed clutch to selectively transmit a rotational force of the sheet feed motor to the sheet feed roller; and a pickup clutch to selectively transmit the rotational force supplied from the sheet feed clutch to the pickup roller, wherein the controller is to, control driving the sheet feed motor, control the sheet feed clutch so that the rotational force of the sheet feed motor is blocked from transmitting to the sheet feed roller, and determine a state of a joint that couples the magnetic torque limiter to the sheet feed motor, by using the signal output from the hall sensor.

10. The sheet feeding apparatus of claim 1, further comprising:

a pickup roller to pick up the at least one sheet stacked on the sheet stacker;

a sheet feed motor to rotate the pickup roller and the sheet feed roller;

a sheet feed clutch to selectively transmit a rotational force of the sheet feed motor to the sheet feed roller; and a pickup clutch to selectively transmit the rotational force supplied from the sheet feed clutch to the pickup roller, wherein when determining the value indicative of the usage corresponding to the multi-feed prevention roller, the controller drives the sheet feed motor, controls the sheet feed clutch and the pickup clutch so that the sheet feed roller is rotated by the rotational force of the sheet feed motor and the pickup roller is blocked from picking up the sheet, and determines the value using the signal output from the hall sensor.

11. The sheet feeding apparatus of claim 10, wherein the controller is to further, compare a number of rotations of the sheet feed roller and a number of rotations of the multi-feed prevention roller, and determine that the lifetime of the multi-feed prevention roller further indicates a lifetime of the multi-feed prevention roller is over when a difference between the number of rotations of the multi-feed prevention roller and the number of rotations of the sheet feed roller is larger than a reference number of rotations.

12. The sheet feeding apparatus of claim 10, wherein the controller is to further, determine that the value indicative of the usage corresponding to the multi-feed prevention roller further indicates a lifetime of the multi-feed prevention roller is over, when an interval between two adjacent pulse signals among a plurality of pulse signals corresponding to one rotation of the multi-feed prevention roller output form the hall sensor is larger than a reference pulse interval.

13. An image forming apparatus comprising:

a main body including an image former;

at least one sheet feeding apparatus to feed a sheet to the image former; and a controller to control the image former and the at least one sheet feeding apparatus to form an image on the sheet, wherein the at least one sheet feeding apparatus includes:

a sheet stacker to stack at least one sheet;

a sheet feed roller disposed at one side of the sheet stacker and to feed a sheet fed from the sheet stacker to the image former;

a multi-feed prevention roller disposed to face the sheet feed roller and to prevent multi-feed of sheets fed from the sheet stacker;

a magnetic torque limiter disposed coaxially with the multi-feed prevention roller; and a hall sensor disposed at one side of the magnetic torque limiter and to detect a rotation and a rotational direction of the magnetic torque limiter, wherein the controller is to, control to determine a value indicative of usage corresponding to the multi-feed prevention roller according to a signal indicative of the detected rotation and rotational direction of the magnetic torque limiter output from the hall sensor; and wherein the magnetic torque limiter includes, a plurality of permanent magnets provided circumferentially on a rotation shaft of the multi-feed prevention roller;

a housing to surround the plurality of permanent magnets; and a magnetic member provided on an inner circumferential surface of the housing and facing the plurality of permanent magnets, wherein a portion of the housing facing the hall sensor is provided with a magnetic force emitting region through which a magnetic force of a permanent magnet among the plurality of permanent magnets is radiated to an outside of the housing over a circumferential region of the housing to cause the detection of the rotation and the rotational direction of the magnetic torque limiter by the hall sensor.

14. The image forming apparatus of claim 13, wherein the controller is to rotate the sheet feed roller in a state in which the sheet feed roller and the multi-feed prevention roller are in contact with each other without the sheet and to identify a lifetime of the multi-feed prevention roller according to the determined value.

* * * * *